US007487837B2

(12) United States Patent
Bailey et al.

(10) Patent No.: US 7,487,837 B2
(45) Date of Patent: Feb. 10, 2009

(54) RISER ROTATING CONTROL DEVICE

(75) Inventors: Thomas F. Bailey, Houston, TX (US); James W. Chambers, Hackett, AR (US)

(73) Assignee: Weatherford/Lamb, Inc., Houston, TX (US)

( * ) Notice: Subject to any disclaimer, the term of this patent is extended or adjusted under 35 U.S.C. 154(b) by 329 days.

(21) Appl. No.: 10/995,980

(22) Filed: Nov. 23, 2004

(65) Prior Publication Data

US 2006/0108119 A1 May 25, 2006

(51) Int. Cl.
*E21B 29/12* (2006.01)

(52) U.S. Cl. ..... 166/345; 166/338; 166/250.01; 166/360; 285/920

(58) Field of Classification Search ..... 166/341, 166/338, 345, 343, 344, 348, 351, 360, 255.1, 166/250.01, 85.1; 285/920; 251/92
See application file for complete search history.

(56) References Cited

U.S. PATENT DOCUMENTS

| | | | |
|---|---|---|---|
| 517,509 | A | 4/1894 | Williams |
| 1,157,644 | A | 10/1915 | London |
| 1,472,952 | A | 11/1923 | Anderson |
| 1,503,476 | A | 8/1924 | Childs et al. |
| 1,528,560 | A | 3/1925 | Myers et al. |
| 1,546,467 | A | 7/1925 | Bennett |
| 1,560,763 | A | 11/1925 | Collins |
| 1,700,894 | A | 2/1929 | Joyce et al. |
| 1,708,316 | A | 4/1929 | MacClatchie |
| 1,769,921 | A | 7/1930 | Hansen |
| 1,776,797 | A | 9/1930 | Sheldon |
| 1,813,402 | A | 7/1931 | Hewitt |
| 1,831,956 | A | 11/1931 | Harrington |
| 1,836,470 | A | 12/1931 | Humason et al. |
| 1,902,906 | A | 3/1933 | Seamark |
| 1,942,366 | A | 1/1934 | Seamark |

(Continued)

FOREIGN PATENT DOCUMENTS

AU 199927822 B2 9/1999

(Continued)

OTHER PUBLICATIONS

U.S. Appl. No. 60/079,641, Abandoned, but Priority Claimed in above U.S. Patent Nos. 6,230,824B1 and 6,102,673 and PCT WO 99/50524, filed Mar. 27, 1998.

(Continued)

*Primary Examiner*—Thomas A Beach
(74) *Attorney, Agent, or Firm*—Strasburger & Price, LLP

(57) ABSTRACT

A latch assembly is connectable to a riser. A rotating control device can be positioned with the riser, sealing the rotating control device with the latch assembly and removably latching the rotating control device to the latch assembly and to the riser. The latch assembly can be remotely actuated. The latch assembly can provide an auxiliary safety mechanism to provide a backup actuation mechanism to unlatch the rotating control device from the latch assembly. The latch assembly can be bolted to the riser. Alternately, the latch assembly can be latched with the riser using a similar latching mechanism as used to latch the latch assembly to the rotating control device. A pressure transducer protector assembly can protect a transducer for monitoring wellbore pressure in the riser. A remote indicator panel can indicate the status of the latch assembly.

124 Claims, 30 Drawing Sheets

U.S. PATENT DOCUMENTS

| | | | | | |
|---|---|---|---|---|---|
| 2,036,537 | A | | 4/1936 | Otis | |
| 2,071,197 | A | | 2/1937 | Burns et al. | |
| 2,124,015 | A | | 7/1938 | Stone et al. | |
| 2,126,007 | A | | 8/1938 | Guiberson et al. | |
| 2,144,682 | A | | 1/1939 | MacClatchie | |
| 2,163,813 | A | | 6/1939 | Stone et al. | |
| 2,165,410 | A | | 7/1939 | Penick et al. | |
| 2,170,915 | A | | 8/1939 | Schweitzer | |
| 2,170,916 | A | | 8/1939 | Schweitzer et al. | |
| 2,175,648 | A | | 10/1939 | Roach | |
| 2,176,355 | A | | 10/1939 | Otis | |
| 2,185,822 | A | | 1/1940 | Young | |
| 2,199,735 | A | | 5/1940 | Beckman | |
| 2,222,082 | A | | 11/1940 | Leman et al. | |
| 2,233,041 | A | | 2/1941 | Alley | |
| 2,243,340 | A | | 5/1941 | Hild | |
| 2,243,439 | A | | 5/1941 | Pranger et al. | |
| 2,287,205 | A | | 6/1942 | Stone | |
| 2,303,090 | A | | 11/1942 | Pranger et al. | |
| 2,313,169 | A | | 3/1943 | Penick et al. | |
| 2,325,556 | A | | 7/1943 | Taylor, Jr. et al. | |
| 2,338,093 | A | | 1/1944 | Caldwell | |
| 2,480,955 | A | | 9/1949 | Penick | |
| 2,506,538 | A | | 5/1950 | Bennett | |
| 2,529,744 | A | | 11/1950 | Schweitzer | |
| 2,609,836 | A | | 9/1952 | Knox | |
| 2,628,852 | A | | 2/1953 | Voytech | |
| 2,646,999 | A | | 7/1953 | Barske | |
| 2,649,318 | A | | 8/1953 | Skillman | |
| 2,731,281 | A | | 1/1956 | Knox | |
| 2,746,781 | A | | 5/1956 | Jones | |
| 2,760,750 | A | | 8/1956 | Schweitzer, Jr. et al. | |
| 2,760,795 | A | | 8/1956 | Vertson | |
| 2,764,999 | A | | 10/1956 | Stanbury | |
| 2,808,229 | A | | 10/1957 | Bauer et al. | |
| 2,808,230 | A | | 10/1957 | McNeill et al. | |
| 2,846,178 | A | | 8/1958 | Minor | |
| 2,846,247 | A | | 8/1958 | Davis | |
| 2,853,274 | A | | 9/1958 | Collins | |
| 2,862,735 | A | | 12/1958 | Knox | |
| 2,886,350 | A | | 5/1959 | Horne | |
| 2,904,357 | A | | 9/1959 | Knox | |
| 2,927,774 | A | | 3/1960 | Ormsby | |
| 2,929,610 | A | | 3/1960 | Stratton | |
| 2,962,096 | A | * | 11/1960 | Knox | 285/27 |
| 2,995,196 | A | | 8/1961 | Gibson et al. | |
| 3,023,012 | A | | 2/1962 | Wilde | |
| 3,029,083 | A | | 4/1962 | Wilde | |
| 3,032,125 | A | | 5/1962 | Hiser et al. | |
| 3,033,011 | A | | 5/1962 | Garrett | |
| 3,052,300 | A | | 9/1962 | Hampton | |
| 3,096,999 | A | * | 7/1963 | Ahlstone et al. | 166/340 |
| 3,100,015 | A | | 8/1963 | Regan | |
| 3,128,614 | A | | 4/1964 | Auer | |
| 3,134,613 | A | | 5/1964 | Regan | |
| 3,176,996 | A | | 4/1965 | Barnett | |
| 3,203,358 | A | | 8/1965 | Regan et al. | |
| 3,209,829 | A | | 10/1965 | Haeber | |
| 3,216,731 | A | | 11/1965 | Dollison | |
| 3,225,831 | A | | 12/1965 | Knox | |
| 3,259,198 | A | | 7/1966 | Montgomery et al. | |
| 3,268,233 | A | | 8/1966 | Brown | |
| 3,285,352 | A | | 11/1966 | Hunter | |
| 3,288,472 | A | | 11/1966 | Watkins | |
| 3,289,761 | A | | 12/1966 | Smith et al. | |
| 3,294,112 | A | | 12/1966 | Watkins | |
| 3,313,345 | A | | 4/1967 | Fischer | |
| 3,313,358 | A | | 4/1967 | Postlewaite et al. | |
| 3,323,773 | A | | 6/1967 | Walker | |
| 3,333,870 | A | | 8/1967 | Watkins | |
| 3,347,567 | A | | 10/1967 | Watkins | |
| 3,360,048 | A | | 12/1967 | Watkins | |
| 3,372,761 | A | | 3/1968 | van Gils | |
| 3,387,851 | A | | 6/1968 | Cugini | |
| 3,397,928 | A | | 8/1968 | Galle | |
| 3,400,938 | A | | 9/1968 | Williams | |
| 3,405,763 | A | | 10/1968 | Pitts et al. | |
| 3,421,580 | A | | 1/1969 | Fowler et al. | |
| 3,443,643 | A | * | 5/1969 | Jones | 175/25 |
| 3,445,126 | A | | 5/1969 | Watkins | |
| 3,452,815 | A | | 7/1969 | Watkins | |
| 3,472,518 | A | | 10/1969 | Harlan | |
| 3,476,195 | A | | 11/1969 | Galle | |
| 3,485,051 | A | | 12/1969 | Watkins | |
| 3,492,007 | A | | 1/1970 | Jones | |
| 3,493,043 | A | | 2/1970 | Watkins | |
| 3,529,835 | A | | 9/1970 | Lewis | |
| 3,583,480 | A | | 6/1971 | Regan | |
| 3,587,734 | A | | 6/1971 | Shaffer | |
| 3,603,409 | A | | 9/1971 | Watkins | |
| 3,621,912 | A | | 11/1971 | Wooddy, Jr. | |
| 3,631,834 | A | | 1/1972 | Gardner et al. | |
| 3,638,721 | A | | 2/1972 | Harrison | |
| 3,638,742 | A | | 2/1972 | Wallace | |
| 3,653,350 | A | | 4/1972 | Koons et al. | |
| 3,661,409 | A | | 5/1972 | Brown et al. | |
| 3,664,376 | A | | 5/1972 | Watkins | |
| 3,667,721 | A | | 6/1972 | Vujasinovic | |
| 3,677,353 | A | | 7/1972 | Baker | |
| 3,724,862 | A | | 4/1973 | Biffle | |
| 3,741,296 | A | * | 6/1973 | Murman et al. | 166/338 |
| 3,779,313 | A | | 12/1973 | Regan | |
| 3,815,673 | A | | 6/1974 | Bruce et al. | |
| 3,827,511 | A | | 8/1974 | Jones | |
| 3,847,215 | A | | 11/1974 | Herd | |
| 3,868,832 | A | | 3/1975 | Biffle | |
| 3,872,717 | A | * | 3/1975 | Fox | 73/84 |
| 3,924,678 | A | | 12/1975 | Ahlstone | |
| 3,934,887 | A | | 1/1976 | Biffle | |
| 3,952,526 | A | | 4/1976 | Watkins et al. | |
| 3,955,622 | A | | 5/1976 | Jones | |
| 3,965,987 | A | | 6/1976 | Biffle | |
| 3,976,148 | A | | 8/1976 | Maus et al. | |
| 3,984,990 | A | | 10/1976 | Jones | |
| 3,992,889 | A | | 11/1976 | Watkins et al. | |
| 3,999,766 | A | | 12/1976 | Barton | |
| 4,037,890 | A | | 7/1977 | Kurita et al. | |
| 4,046,191 | A | | 9/1977 | Neath | |
| 4,052,703 | A | * | 10/1977 | Collins et al. | 714/2 |
| 4,063,602 | A | | 12/1977 | Howell et al. | |
| 4,091,881 | A | | 5/1978 | Maus | |
| 4,098,341 | A | | 7/1978 | Lewis | |
| 4,099,583 | A | | 7/1978 | Maus | |
| 4,109,712 | A | | 8/1978 | Regan | |
| 4,143,880 | A | | 3/1979 | Bunting et al. | |
| 4,143,881 | A | | 3/1979 | Bunting | |
| 4,149,603 | A | | 4/1979 | Arnold | |
| 4,154,448 | A | | 5/1979 | Biffle | |
| 4,157,186 | A | | 6/1979 | Murray et al. | |
| 4,183,562 | A | | 1/1980 | Watkins et al. | |
| 4,200,312 | A | | 4/1980 | Watkins | |
| 4,208,056 | A | | 6/1980 | Biffle | |
| 4,216,835 | A | * | 8/1980 | Nelson | 175/10 |
| 4,222,590 | A | | 9/1980 | Regan | |
| 4,281,724 | A | | 8/1981 | Garrett | |
| 4,282,939 | A | | 8/1981 | Maus et al. | |
| 4,285,406 | A | | 8/1981 | Garrett et al. | |
| 4,291,772 | A | | 9/1981 | Beynet | |
| 4,293,047 | A | | 10/1981 | Young | |
| 4,304,310 | A | | 12/1981 | Garrett | |
| 4,310,058 | A | | 1/1982 | Bourgoyne, Jr. | |
| 4,312,404 | A | | 1/1982 | Morrow | |
| 4,313,054 | A | | 1/1982 | Martini | |
| 4,326,584 | A | | 4/1982 | Watkins | |

4,335,791 A 6/1982 Evans
4,337,653 A * 7/1982 Chauffe ..... 73/152.43
4,349,204 A 9/1982 Malone
4,353,420 A 10/1982 Miller
4,355,784 A 10/1982 Cain
4,361,185 A 11/1982 Biffle
4,363,357 A 12/1982 Hunter
4,367,795 A 1/1983 Biffle
4,378,849 A 4/1983 Wilks
4,383,577 A 5/1983 Pruitt
4,386,667 A 6/1983 Millsapps, Jr.
4,387,771 A * 6/1983 Jones ..... 166/341
4,398,599 A 8/1983 Murray
4,406,333 A 9/1983 Adams
4,407,375 A 10/1983 Nakamura
4,413,653 A 11/1983 Carter, Jr.
4,416,340 A 11/1983 Bailey
4,423,776 A 1/1984 Wagoner et al.
4,424,861 A 1/1984 Carter, Jr. et al.
4,427,072 A * 1/1984 Lawson ..... 166/345
4,439,068 A * 3/1984 Pokladnik ..... 405/169
4,440,232 A 4/1984 LeMoine
4,441,551 A 4/1984 Biffle
4,444,250 A 4/1984 Keithahn et al.
4,444,401 A 4/1984 Roche et al.
4,448,255 A 5/1984 Shaffer et al.
4,456,062 A 6/1984 Roche et al.
4,456,063 A 6/1984 Roche
4,457,489 A * 7/1984 Gilmore ..... 251/148
4,478,287 A * 10/1984 Hynes et al. ..... 166/341
4,480,703 A 11/1984 Garrett
4,484,753 A 11/1984 Kalsi
4,486,025 A 12/1984 Johnston
4,497,592 A * 2/1985 Lawson ..... 405/202
4,500,094 A 2/1985 Biffle
4,502,534 A 3/1985 Roche et al.
4,509,405 A 4/1985 Bates
4,524,832 A 6/1985 Roche et al.
4,526,243 A 7/1985 Young
4,527,632 A 7/1985 Chaudot
4,529,210 A 7/1985 Biffle
4,531,580 A 7/1985 Jones
4,531,593 A 7/1985 Elliott et al.
4,540,053 A 9/1985 Baugh et al.
4,546,828 A 10/1985 Roche
4,553,591 A 11/1985 Mitchell
D282,073 S 1/1986 Bearden et al.
4,566,494 A 1/1986 Roche
4,595,343 A 6/1986 Thompson et al.
4,597,447 A 7/1986 Roche et al.
4,597,448 A 7/1986 Baugh
4,611,661 A 9/1986 Hed et al.
4,618,314 A 10/1986 Hailey
4,621,655 A 11/1986 Roche
4,626,135 A 12/1986 Roche
4,630,680 A * 12/1986 Elkins ..... 166/342
4,632,188 A 12/1986 Schuh et al.
4,646,826 A 3/1987 Bailey et al.
4,646,844 A 3/1987 Roche et al.
4,651,830 A * 3/1987 Crotwell ..... 166/338
4,688,633 A * 8/1987 Barkley ..... 166/341
4,697,484 A 10/1987 Klee et al.
4,709,900 A 12/1987 Dyhr
4,712,620 A 12/1987 Lim et al.
4,719,937 A 1/1988 Roche et al.
4,722,615 A 2/1988 Bailey et al.
4,727,942 A 3/1988 Galle et al.
4,736,799 A 4/1988 Ahlstone
4,745,970 A 5/1988 Bearden et al.
4,749,035 A 6/1988 Cassity
4,754,820 A 7/1988 Watts et al.
4,759,413 A * 7/1988 Bailey et al. ..... 175/6
4,765,404 A 8/1988 Bailey et al.
4,783,084 A 11/1988 Biffle
4,813,495 A 3/1989 Leach
4,817,724 A 4/1989 Funderburg, Jr. et al.
4,825,938 A 5/1989 Davis
4,828,024 A 5/1989 Roche
4,832,126 A 5/1989 Roche
4,836,289 A 6/1989 Young
4,882,830 A * 11/1989 Carstensen ..... 29/421.1
4,909,327 A 3/1990 Roche
4,949,796 A 8/1990 Williams
4,955,436 A 9/1990 Johnston
4,955,949 A 9/1990 Bailey et al.
4,962,819 A 10/1990 Bailey et al.
4,971,148 A 11/1990 Roche et al.
4,984,636 A 1/1991 Bailey et al.
5,009,265 A 4/1991 Bailey et al.
5,022,472 A 6/1991 Bailey et al.
5,028,056 A 7/1991 Bemis et al.
5,040,600 A 8/1991 Bailey et al.
5,062,479 A 11/1991 Bailey et al.
5,072,795 A 12/1991 Delgado et al.
5,076,364 A 12/1991 Hale et al.
5,085,277 A 2/1992 Hopper
5,137,084 A 8/1992 Gonzales et al.
5,147,559 A * 9/1992 Brophey et al. ..... 210/744
5,154,231 A 10/1992 Bailey et al.
5,163,514 A 11/1992 Jennings
5,178,215 A 1/1993 Yenulis et al.
5,182,979 A * 2/1993 Morgan ..... 92/5 R
5,184,686 A 2/1993 Gonzalez
5,195,754 A 3/1993 Dietle
5,213,158 A 5/1993 Bailey et al.
5,215,151 A 6/1993 Smith et al.
5,224,557 A 7/1993 Yenulis et al.
5,230,520 A 7/1993 Dietle et al.
5,251,869 A 10/1993 Mason
5,255,745 A * 10/1993 Czyrek ..... 166/347
5,277,249 A 1/1994 Yenulis et al.
5,279,365 A 1/1994 Yenulis et al.
5,305,839 A 4/1994 Kalsi et al.
5,320,325 A 6/1994 Young et al.
5,322,137 A 6/1994 Gonzales
5,325,925 A 7/1994 Smith et al.
5,348,107 A 9/1994 Bailey et al.
5,443,129 A 8/1995 Bailey et al.
5,588,491 A 12/1996 Tasson et al.
5,607,019 A 3/1997 Kent
5,647,444 A 7/1997 Williams
5,662,171 A 9/1997 Brugman et al.
5,662,181 A 9/1997 Williams et al.
5,671,812 A 9/1997 Bridges
5,678,829 A 10/1997 Kalsi et al.
5,738,358 A 4/1998 Kalsi et al.
5,823,541 A 10/1998 Dietle et al.
5,829,531 A 11/1998 Hebert et al.
5,848,643 A 12/1998 Carbaugh et al.
5,873,576 A 2/1999 Dietle et al.
5,878,818 A 3/1999 Hebert et al.
5,901,964 A 5/1999 Williams et al.
5,944,111 A 8/1999 Bridges
6,007,105 A 12/1999 Dietle et al.
6,016,880 A 1/2000 Hall et al.
6,036,192 A 3/2000 Dietle et al.
6,102,123 A 8/2000 Bailey et al.
6,102,673 A 8/2000 Mott et al.
6,109,348 A 8/2000 Caraway
6,109,618 A 8/2000 Dietle
6,112,810 A 9/2000 Bailey et al.
6,129,152 A 10/2000 Hosie et al.
6,138,774 A 10/2000 Bourgoyne et al.
6,202,745 B1 3/2001 Reimert et al.
6,213,228 B1 4/2001 Saxman
6,227,547 B1 5/2001 Dietle et al.

| | | | |
|---|---|---|---|
| 6,230,824 | B1 | 5/2001 | Peterman et al. |
| 6,244,359 | B1 | 6/2001 | Bridges et al. |
| 6,263,982 | B1 | 7/2001 | Hannegan et al. |
| 6,325,159 | B1 | 12/2001 | Peterman et al. |
| 6,354,385 | B1 | 3/2002 | Ford et al. |
| 6,450,262 | B1 | 9/2002 | Regan |
| 6,457,529 | B2 | 10/2002 | Calder et al. |
| 6,470,975 | B1 | 10/2002 | Bourgoyne et al. |
| 6,478,303 | B1 | 11/2002 | Radcliffe |
| 6,520,253 | B2 | 2/2003 | Calder |
| 6,547,002 | B1 | 4/2003 | Bailey et al. |
| 6,554,016 | B2 | 4/2003 | Kinder |
| RE38,249 | E | 9/2003 | Tasson et al. |
| 6,655,460 | B2 | 12/2003 | Bailey et al. |
| 6,702,012 | B2 | 3/2004 | Bailey et al. |
| 6,732,804 | B2 | 5/2004 | Hosie et al. |
| 6,749,172 | B2 | 6/2004 | Kinder |
| 6,843,313 | B2 | 1/2005 | Hult |
| 6,896,048 | B2 | 5/2005 | Mason et al. |
| 6,913,092 | B2 | 7/2005 | Bourgoyne |
| 7,004,444 | B2 | 2/2006 | Kinder |
| 7,032,691 | B2 | 4/2006 | Humphreys |
| 7,040,394 | B2 | 5/2006 | Bailey et al. |
| 7,044,237 | B2 | 5/2006 | Leuchtenberg |
| 7,080,685 | B2 | 7/2006 | Bailey et al. |
| 2001/0040052 | A1 | 11/2001 | Bourgoyne et al. |
| 2001/0050185 | A1 | 12/2001 | Calder |
| 2003/0070842 | A1 | 4/2003 | Bailey et al. |
| 2003/0079912 | A1 | 5/2003 | Leuchtenberg |
| 2003/0102136 | A1 | 6/2003 | Nelson et al. |
| 2003/0106712 | A1 | 6/2003 | Bourgoyne et al. |
| 2003/0121671 | A1 | 7/2003 | Bailey et al. |
| 2004/0055755 | A1 | 3/2004 | Roesner et al. |
| 2004/0084220 | A1 | 5/2004 | Bailey et al. |
| 2004/0108108 | A1 | 6/2004 | Bailey et al. |
| 2004/0238175 | A1 | 12/2004 | Wade et al. |
| 2005/0000698 | A1 | 1/2005 | Bailey et al. |
| 2005/0151107 | A1 | 7/2005 | Shu |
| 2005/0241833 | A1 | 11/2005 | Bailey et al. |
| 2006/0102387 | A1 | 5/2006 | Bourgoyne et al. |
| 2006/0108119 | A1 | 5/2006 | Bailey et al. |

FOREIGN PATENT DOCUMENTS

| | | | |
|---|---|---|---|
| AU | 200028183 | A1 | 9/2000 |
| AU | 200028183 | B2 | 9/2000 |
| CA | 2363132 | A1 | 9/2000 |
| CA | 2447196 | A1 | 4/2004 |
| EP | 0290250 | A2 | 11/1988 |
| EP | 0290250 | A3 | 11/1988 |
| EP | 267140 | B1 | 3/1993 |
| GB | 2067235 | A | 7/1981 |
| GB | 2394741 | A | 5/2004 |
| WO | WO 99/45228 | A1 | 9/1999 |
| WO | WO 99/50524 | A2 | 10/1999 |
| WO | WO 99/51852 | A1 | 10/1999 |
| WO | WO 99/50524 | A3 | 12/1999 |
| WO | WO00/52299 | A | 9/2000 |
| WO | WO 00/52299 | A | 9/2000 |
| WO | WO 00/52299 | A1 | 9/2000 |
| WO | WO 00/52300 | A1 | 9/2000 |
| WO | WO 02/50398 | A1 | 6/2002 |
| WO | WO 03/071091 | A1 | 8/2003 |

OTHER PUBLICATIONS

Cameron Iron Works, "The Modular T BOP Stack System," 5 pages (© 1985).

Cooper Cameron Corporation, Cameron Division, Cameron HC Collet Connector, 12 pages (© 1996).

"Riserless drilling: circumventing the size/cost cycle in deepwater—Conoco, Hydril project seek enabling technologies to drill in deepest water depths economically," Offshore Drilling Technology, pp. 49, 50, 52, 53, 54 and 55 (May 1996).

Williams Tool Co., Inc.,"Home Page—Under Construction Williams Rotating Control Heads," 2 pages; "Seal-Ability for the pressures of drilling," 2 pages; "Williams Model 7000 Series Rotating Control Heads," 1 page; "Williams Model 7000 & 7100 Series Rotating Control Heads," 2 pages; "Williams Model IP1000 Rotating Control Head," 2 pages; "Williams Conventional Models 8000 & 9000," 2 pages; "Applications Where using a Williams rotating control head while drilling is a plus," 1 page; "Williams *higher pressure* rotating control head systems are Ideally Suited for New Technology Flow Drilling and Closed Loop Underbalanced Drilling (UBD) Vertical and Horizontal," 2 pages; and "How to Contact Us," 2 pages (undated).

"Shallow Flow Diverter JIP Spurred by Deepwater Washouts," Offshore—World Trends and Technology for Offshore Oil and Gas Operations, Seismic, cover page, table of contents and p. 90 (Mar. 1998).

Williams Tool Co., Inc., Rotating Control Heads and Strippers for Air, Gas, Mud, and Geothermal Drilling Worldwide—Sales Rental Service, 19 pages (© 1988).

Williams Tool Co., Inc., Untitled brochure, 19 pages (© 1991).

"Fig. 14, Floating Piston Drilling Choke Design," 1 page (May 1997).

Charles R. "Rick" Stone, "Blowout Preventer Testing for Underbalanced Drilling," 24 pages (Sep. 1997).

Williams Tool Co., Inc., "Instructions, Assemble & Disassemble Model 9000 Bearing Assembly," cover page and 27 pages (undated).

Williams Tool Co., Inc., "Rotating Control Heads Making Drilling Safer While Reducing Costs Since 1968," 4 pages (© 1989).

Williams Tool Co., Inc., "International Model 7000 Rotating Control Head," 4 pages (© 1991).

Williams Tool Co., Inc., "Williams Rotating Control Heads, Reduce Costs Increase Safety Reduce Environmental Impact," 4 pages (© 1995).

Williams Tool Co., Inc., "Sales-Rental-Service, Williams Rotating Control Heads and Strippers for Air, Gas, Mud, and Geothermal Drilling," 7 pages (© 1982).

Williams Tool Co., Inc., "Rotating Control Heads and Strippers for Air, Gas, Mud, Geothermal and Pressure Drilling," 19 pages (© 1991).

Williams Tool Co., Inc., "The *When*? and *Why*? of Rotating Control Head Usage," The Brief, 2 pages ( Jan. 1996).

Adam T. Bourgoyne, Jr., "Rotating control head applications increasing," Oil & Gas Journal, PennWell Publishing Company, 4 pages (Oct. 9, 1995).

Composite Catalog-Grant Rotating Drilling Head for Air, Gas or Mud Drilling, 1 page (1966-1967).

Composite Catalog Grant Oil Tool Company Rotating Drilling Head Models 7068, 7368, 8068 (Patented), Equally Effective with Air, Gas, or Mud Circulation Media, 3 pages (1976-1977).

Darryl A. Bourgoyne, "A Subsea Rotating Control Head for Riserless Drilling Applications," International Association of Drilling Contractors International Deep Water Well Control Conference held in Houston, Texas, 14 pages (Aug. 26-27, 1998).

Don Hannegan, "Applications Widening for Rotating Control Heads," Drilling Contractor, cover page, table of contents and pp. 17 and 19, (Jul. 1996).

Composite Catalog, Hughes Offshore Subsea Systems and Equipment, Hughes Drilling Equipment Composite Catalog, pp. 2986-3004 (1986-1987).

Williams Tool Co., Inc., "Technical Specifications Model for The Model 7100," 3 pages (undated).

Williams Tool Co., Inc., "Underbalanced Drilling (UBD), The Attraction of UBD," 2 pages (undated).

Williams Tool Co., Inc., "Applications Where Using a Williams Rotating Control Head While Drilling is a Plus," 2 pages (undated).

Williams Tool Co., Inc., "Model 7100," 3 pages (undated).

Composite Catalog, Hughes Offshore 1982/1983, Regan Products, Two cover sheets and 4308-27 thru 4308-43, and end sheet (1982).

"1-Coflexip Sales Offices, 2-The Flexible Steel Pipe for Drilling and Service Applications, 3-New 5" I.D. General Drilling Flexible, 4-Applications, and 5-Illustration," Coflexip Brochure; 5 pages (undated).

Ron Baker, "A Primer of Oilwell Drilling", Fourth Edition, Published by Petroleum Extension Service, The University of Texas at Austin, Austin, Texas, in cooperation with International Association of Drilling Contractors Houston Texas, 3 cover pages and pp. 42-49 (© 1979).
Dutch Enterprises Inc., "Lock down Lubricator System," "Safety with Savings," pp. D-3 through D-18 (undated).
Hydril GL series Annular Blowout Preventers, cover sheet and 2 pages (1998).
Hydril Company, Other Hydril Product Information (The GH Gas Handler Series Product is Listed), pp. D-49 through D47 (© 1996).
NL Rig Equipment/NL Industries, Inc., "Shaffer Type 79 Rotating Blowout Preventer," Brochure, pp. D-49 through D-54 (undated).
Shaffer, A Varco Company, Cover page and pp. 1562-1568 (undated).
Colin P. Leach, "Avoiding Explosive Unloading of Gas in a Deep Water Riser When SOBM is in Use," 9 pages (1998).
Clovis A. Lopes, "Feasibility Study of Dual Density Mud System for Deepwater Drilling Operations," Offshore Technology Conference Paper No. 8465, pp. 257-266 (1997).
"Offshore Drilling with Light Weight Fluids Joint Industry Project Presentation," pp. C-3 through C-11 (Apr. 1998).
Edson Y. Nakagawa, "Application of Aerated-Fluid Drilling in Deepwater", SPE/IADC 52787, SPE/IADC Drilling Conference, Amsterdam, Holland, 5 pages (Mar. 9-11, 1999).
Inter-Tech Drilling Solutions Ltd./Big D Rentals & Sales Ltd., "Inter-Tech Drilling Solutions Ltd.'s RBOP™ Means Safety and Experience for Underbalanced Drilling", and "Rotating BOP," 2 pages (1981).
Shaffer® A Varco Company, "Pressure Control While Drilling," 2 pages (Undated).
Shaffer® A Varco Company, "Field Exposure (As of Aug. 1998)," 1 page (Aug. 1998).
"Rotating Spherical BOP," 1 page (undated).
Edson Yoshihito Nakagawa, "JIP's Work Brightens Outlook for UBD in Deep Waters," American Oil & Gas Reporter, Apr. 1999, pp. 52-53, 56, 58-60 and 62-63 (Apr. 1999).
"Seal-Tech 1500 PSI Rotating Blowout Preventer," 3 pages (undated).
TechCorp Industries, "RPM System 3000™ Rotating Blowout Preventer, Setting a new standard in Well Control", 4 pages (undated).
Williams Tool Co., Inc., "RiserCap™ Materials Presented at the 1999 LSU/MMS/IADC Well Control Workshop," pp. 1-14 (Mar. 24-25, 1999).
John Rogers Smith, "The 1999 LSU/MMS Well Control Workshop: An overview," World Oil, Cover page and pp. 4, 41-42, and 44-45 (Jun. 1999).
Dag Oluf Nessa, "Offshore underbalanced drilling system could revive field developments," World Oil, vol. 218, No. 10, 1 Cover page and pp. 3, 83-84, 86, and 88 (Oct. 1997).
D. O. Nessa, "*Offshore underbalanced drilling system could revive field developments*", World Oil Exploration Drilling Production, vol. 218 No. 7, Cover Page and pp. 3, 61-64, and 66 (Jul. 1997).
*PCT Search Report*, International Application No. PCT/US99/06695, 4 pages (Date of Completion May 27, 1999).
*PCT Search Report*, International Application No. PCT/GB00/00731, 3 pages (Date of Completion Jun. 16, 2000).
National Academy of Sciences—National Research Council, "*Design of a Deep Ocean Drilling Ship*", Cover Page and pp. 114-121 (Undated but cited in above U.S. Patent No. 6,230,824B1).
A. Cress, "History and Development of a Rotating Blowout Preventer," IADC/SPE 23931, 1992 IADC/SPE Drilling Conference, pp. 757-773 (Feb. 1992).
Rehm, Bill, "Practical Underbalanced Drilling and Workover," Petroleum Extension Service, The University Of Texas At Austin Continuing & Extended Education, Cover page, title page, copyright page, and pp. 6-6, 11-2, 11-3, G-9, and G-10 (2002).
Williams Tool Company, "RiserCap™: Rotating Control Head System For Floating Drilling Rig Applications," 4 unnumbered pages (© 1999).
Antonio C.V.M. Lage, "Drilling With Aerated Drilling Fluid From a Floating Unit Part 2: Drilling the Well," SPE 71361, 11 pages (© 2001).
Helio Santos, "Drilling with Aerated Fluid from a Floating Unit, Part 1: Planning, Equipment, Tests, and Rig Modifications," SPE/IADC 67748, SPE/IADC Drilling Conference, 8 pages (© 2001).
E. Y. Nakagawa, "Planning of Deepwater Drilling Operations with Aerated Fluids," SPE 54283, Society of Petroleum Engineers, 7 pages (© 1999).
E. Y. Nakagawa, "Implementing the Light-Weight Fluids Drilling Technology in Deepwater Scenarios," 1999 LSU/MMS Well Control Workship, 12 pages (Mar. 24-25, 1999).
Stewart & Stevenson, "Stewart & Stevenson Introduces First Dual Gradient Riser,", http:www.ssss.com/ssss/20000831.asp, 2 pages (Aug. 31, 2000).
Williams Tool Co., Inc., "Williams Tool Company Introduces the . . . Virtual Riser™," 4 pages (© 1998).
"PETEX Publications," Petroleum Extension Service, University of Texas at Austin, 12 pages (last modified Dec. 6, 2002).
"BG in the Caspian region," SPE Review, Issue 164, 3 pages (May 2003).
"Field Cases as of Mar. 3, 2003," Impact Fluid Solutions, 6 pages, (Mar. 3, 2003).
Maurer Technology, Inc., "Determine the Safe Application of Underbalanced Drilling Techniques in Marine Environments—Technical Proposal," Cover Page and pp. 2-13 (Jun. 17, 2002).
Colbert, John W, "John W. Colbert, P.E. Vice President Engineering Biographical Data," Signa Engineering Corp., 2 pages (undated).
Parker Drilling Co., "Technical Training Courses," http://www.parkerdrilling.com/news/tech.html, 5 pages (last visited, Sep. 5, 2003).
"Drilling equipment: Improvements from data recording to slim hole," Drilling Contractor, pp. 30-32 (Mar./Apr. 2000).
"Drilling conference promises to be informative," Drilling Contractor, p. 10 (Jan./Feb. 2002).
OGCI, Inc., "Underbalanced and Air Drilling," http://www.ogci.com/course_info.asp?courseID=410, 2 pages (2003).
Society of Petroleum Engineers, "2003 SPE Calendar," Google cache of http://www.spe.org/spe/cda/views/events/eventMaster/0,1470,1648_2194_632303,00.html for "mud cap drilling," 2 pages (2001).
Schlumberger Limited, "Oilfield Glossary: reverse-circulating valve," 1 page (2003).
Ross D.Murphy, "A drilling contractor's view of underbalanced drilling," World Oil Magazine, vol. 223, No. 5, 9 pages (May 2002).
"Weatherford UnderBalanced Services: General Underbalance Presentation to the DTI," 71 pages (© 2002).
Rach, Nina M., "Underbalanced, near-balanced drilling are possible offshore," Oil & Gas Journal, pp. 39-44, (Dec. 1, 2003).
Neil Forrest, "Subsea Equipment for Deep Water Drilling Using Dual Gradient Mud System," SPE/IADC 67707, SPE/IADC Drilling Conference, pp. 1-8, (© 2001).
D.M. Hannegan, "Deepwater Drilling with Lightweight Fluids—Essential Equipment Required," SPE/IADC 67708, SPE/IADC Drilling Conference, pp. 1-6 (© 2001).
Don M Hannegan, "Underbalanced Operations Continue Offshore Movement," SPE 68491, Society of Petroleum Engineers, Inc., pp. 1-3 (© 2001).
D. Hannegan, "Underbalanced Drilling—Perceptions and Realities of Today's Technology in Offshore Applications," IADC/SPE 74448, IADC/SPE Drilling Conference, pp. 1-9 (© 2002).
Don M. Hannegan, "Well Control Considerations—Offshore Applications of Underbalanced Drilling Technology," SPE/IADC 79854, SPE/IADC Drilling Conference, pp. 1-14 (© 2003).
Karen Bybee, "Offshore Applications of Underbalanced-Drilling Technology," Journal of Petroleum Technology, Cover Page and pp. 51-52 (Jan. 2004).
Darryl A. Bourgoyne, "A Subsea Rotating Control Head for Riserless Drilling Applications," IADC International Deep Water Well Control Conference, pp. 1-14 (Aug. 26-27, 1998).
Antonio C.V.M. Lage, "Drilling With Aerated Drilling Fluid From a Floating Unit Part 2: Drilling the Well," SPE 71361, Society of Petroleum Engineers, pp. 1-11 (Sep. 30-Oct. 3, 2001).
William Furlow, "Shell's seafloor pump, solids removal key to ultra-deep, dual-gradient drilling (Skid ready for commercialization),"

Offshore World Trends and Technology for Offshore Oil and Gas Operations, Cover page, table of contents, pp. 54, 2 pages, and p. 106 (Jun. 2001).
Michael V. Rowden, "Advances in riserless drilling pushing the deepwater surface string envelope (Alternative to seawater, CaCl2 sweeps)," Offshore World Trends and Technology for Offshore Oil and Gas Operations, Cover page, table of contents, pp. 56, 58, and 106 (Jun. 2001).
John Boyle, "Multi Purpose Intervention Vessel Presentation," M.O. S.T. Multi Operational Service Tankers, Weatherford International, 43 pages (© 2003).
GB Search Report, International Application No. GB 0324939.8, 1 page (Jan. 21, 2004).
Terwogt, Jan, "Pressured Mud Cap Drilling—Advanced Well Control for Subsea Wells," Petromin Subsea Asia Conference, Kuala Lumpur, Malaysia, 8 pages (Sep. 20-21, 2004).
*PCT Search Report*, International Application No. PCT/EP2004/052167, 4 pages (Date of Completion Nov. 25, 2004).
*PCT Written Opinion of the International Searching Authority*, International Application No. PCT/EP2004/052167, 6 pages.
*Supplementary European Search Report* No. EP 99908371, 3 pages (Date of Completion Oct. 22, 2004).
*General Catalog*, 1970-1971, Vetco Offshore, Inc., Subsea Systems; cover page, company page and numbered pp. 4800, 4816-4818; 6 pages total, in particular see numbered p. 4816 for "patented" Vetco H-4 connectors.
*General Catalog*, 1972-73, Vetco Offshore, Inc., Subsea Systems; cover page, company page and numbered pp. 4498, 4509-4510; 5 pages total.
*General Catalog*, 1974-75, Vetco Offshore, Inc.; cover page, company page and numbered pp. 5160, 5178-5179; 5 pages total.
*General Catalog*, 1976-1977, Vetco Offshore, Inc., Subsea Drilling and Completion Systems; cover page and numbered pp. 5862-5863, 5885; 4 pages total.
*General Catalog*, 1982-1983, Vetco; cover page and numbered pp. 8454-8455, 8479; 4 pages total.
*Shaffer, A Varco Company: Pressure Control While Drilling System*, http://www.tulsaequip.com; printed Jun. 21, 2004; 2 pages.
*Performance Drilling by Precision Drilling. A Smart Equation*, Precision Drilling; © 2002 Precision Drilling Corporation; 12 pages, in particular see 9th page for "Northland's patented RBOP . . .".
*RPM System 3000™ Rotating Blowout Preventer: Setting a New Standard in Well Control*, Weatherford, Underbalanced Systems; © 2002-2005 Weatherford; Brochure #333.01, 4 pages.
*Managed Pressure Drilling in Marine Environments*, Don Hannegan, P.E.; Drilling Engineering Association Workshop, Moody Gardens, Galveston, Jun. 22-23, 2004; © 2004 Weatherford; 28 pages.
Hold™ 2500 RCD Rotating Control Device web page and brochure, http://www.smith.com/hold2500; printed Oct. 27, 2004; 5 pages.
Rehm, Bill, "Practical Underbalanced Drilling and Workover," Petrolelum Extension Service, The University of Texas at Austin Continuing & Extended Education, cover page, title page, copyright page and pp. 6-1 to 6-9, 7-1 to 7-9 (2002).
"Pressured Mud Cap Drilling from A Semi-Submersible Drilling Rig", J.H. Terwogt, SPE, L.B. Makiaho and N. van Beelen, SPE, Shell Malaysia Exploration and Production; B.J. Gedge, SPE, and J. Jenkins, Weatherford Drilling and Well Services (6 pages total); © 2005 (This paper was prepared for presentation at the SPE/IADC Drilling Conference held in Amsterdam, The Netherlands, Feb. 23-25, 2005).
European Search Report for EP 05 27 0083, Application No. 05270083.8-2315, European Patent Office, Mar. 2, 2006 (5 pages).
Netherlands Search Report for NL No. 1026044, dated Dec. 14, 2005 (3 pages).
Int'l. Search Report for PCT/GB 00/00731 corresponding to U.S. Patent No. 6,470,975 (Jun. 16, 2000) (2 pages).
GB0324939.8 Examination Report corresponding to U.S. Patent No. 6,470,975 (Mar. 21, 2006) (6 pages).
GB0324939.8 Examination Report corresponding to U.S. Patent No. 6,470,975 Jan. 22, 2004) (3 pages).
2003/0106712 Family Lookup Report (Jun. 15, 2006) (5 pages).
6,470,975 Family Lookup Report (Jun. 15, 2006) (5 pages).
AU S/N 28183/00 Examination Report corresponding to U.S. Patent No. 6,470,975 (1 page) (Sep. 9, 2002).
NO S/N 20013953 Examination Report corresponding to U.S. Patent No. 6,470,975 w/one page of English translation (3 pages) (Apr. 29, 2003).
Nessa; D.O. & Tangedahl, M.L. & Saponja, J.: Part 1: "Offshore underbalanced drilling system could revive field developments", World Oil, vol. 218 No. 7, Cover Page, 3, 61-64 and 66 (Jul. 1997); and Part 2: "Making this valuable reservior drilling/completion technique work on a conventional offshore drilling platform."—World Oil, vol. 218 No. 10, Cover Page, 3, 83, 84, 86 and 88 (Oct. 1997) (see 5A, 5G above and 5I below).
Int'l. Search Report for PCT/GB 00/00731 corresponding to U.S. Patent No. 6,470,975 (4 pages) (Jun. 27, 2000).
Int'l. Preliminary Examination Report for PCT/GB 00/00731 corresponding to U.S. Patent No. 6,470,975 (7 pages) (Dec. 14, 2000).
NL Examination Report for WO 00/52299 corresponding to this U.S. Appl. No. 10/281,534 (3 pages) (Dec. 19, 2003).
AU S/N 28181/00 Examination Report corresponding to U.S. Patent No. 6,263,982 (1 page) (Sep. 6, 2002).
EU Examination Report for WO 00/906522.8-2315 corresponding to U.S. Patent No. 6,263,982 (4 pages) (Nov. 29, 2004).
NO S/N 20013952 Examination Report w/two pages of English translation corresponding to U.S. Patent No. 6,263,982 (4 pages) (Jul. 22, 2005).
PCT/GB00/00726 Int'l. Preliminary Examination Report corresponding to U.S. Patent No. 6,263,982 (10 pages) (Jun. 26, 2001).
PCT/GB00/00726 Written Opinion corresponding to U.S. Patent No. 6,263,982 (7 pages) (Dec. 18, 2000).
PCT/GB00/00726 International Search Report corresponding to U.S. Patent No. 6,263,982 (3 pages) (Mar. 2, 1999).
AU S/N 27822/99 Examination Report corresponding to U.S. Patent No. 6,138,774 (1 page) (Oct. 15, 2001).
EU 99908371.0-1266-US9903888 European Search Report corresponding to U.S. Patent No. 6,138,774 (3 pages) (Nov. 2, 2004).
NO S/N 20003950 Examination Report w/one page of English translation corresponding to U.S. Patent No. 6,138,774 (3 pages) (Nov. 1, 2004).
PCT/US990/03888 Notice of Transmittal of International Search Report corresponding to U.S. Patent No. 6,138,774 (6 pages) (Aug. 4, 1999).
PCT/US99/03888 Written Opinion corresponding to U.S. Patent No. 6,138,744 (5 pages) (Dec. 21, 1999).
PCT/US99/03888 Notice of Transmittal of International Preliminary Examination Report corresponding to U.S. Patent No. 6,138,774 (15 pages) (Jun. 12, 2000).
EU Examination Report for 05270083.8-2315 corresponding to US 2006/0108119 A1 published May 25, 2006 (11 pages) (May 10, 2006).
Tangedahl, M.J., et al. "Rotating Preventers: Technology for Better Well Control", World Oil, Gulf Publishing Company, Houston, TX, US, vol. 213, No. 10, Oct. 1, 1992, numbered pages 63-64 and 66 (3 pages) XP 000288328 ISSN: 0043-8790 (see YYYY, 5X above).
U.S. Appl. No. 10/281,534, filed Oct. 28, 2002, Darryl Bourgoyne et al.
U.S. Appl. No. 10/995,980, filed Nov. 23, 2004, Thomas F. Bailey et al.
U.S. Appl. No. 11/284,308, filed Nov. 21, 2005, Darryl Bourgoyne et al.
U.S. Appl. No. 60/122,530, Priority Claimed in U.S. Patent No. 6,470,975B1, filed Mar. 2, 1999.
Tangedahl, M.J., et al, "Rotating Preventers: Technology for Better Well Control", World Oil, Gulf Publishing Company, Houston, TX, US, vol. 213, No. 10, Oct. 1992, numbered pages 63-64 and 66 (3 pages).

* cited by examiner

RISER ROTATING CONTROL DEVICE

CROSS-REFERENCE TO RELATED APPLICATIONS

N/A

STATEMENTS REGARDING FEDERALLY SPONSORED RESEARCH OR DEVELOPMENT

N/A

REFERENCE TO A MICROFICHE APPENDIX

N/A

BACKGROUND OF THE INVENTION

1. Field of the Invention

The present invention relates to the field of oilfield drilling equipment and in particular to an apparatus and method for remotely sealing and latching a rotating control device with a riser.

2. Description of the Related Art

Conventional offshore drilling techniques focus upon a decades-old technique that was hydraulic pressure generated by a preselected fluid inside the wellbore to control pressures in a formation being drilled. However, a majority of known resources, gas hydrates excluded, are considered economically undrillable with conventional techniques.

Pore pressure depletion, the need to drill in deeper water, and increasing drilling costs indicate that the amount of known resources considered economically undrillable will continue to increase. Newer techniques, such as underbalanced drilling and managed pressure drilling have been used to control pressure in the wellbore. However, these techniques present a need for pressure management devices such as rotating control devices and diverters.

Rotating control devices have been used in conventional offshore drilling. A rotating control device is a drill-through device with a rotating seal that contacts and seals against the drillstring (drill pipe, casing, Kelly, etc.) for the purposes of controlling the pressure or fluid flow to the surface. However, rig operators typically bolt conventional rotating control devices to a riser below the rotary table of a drilling rig. Such a fixed connection has presented health, safety, and environmental (HSE) problems for drilling operators because retrieving the rotating control device has required unbolting the rotating control device from the riser, requiring personnel to go below the rotary table of the rig in the moon pool to disconnect the rotating control device. In addition to the HSE concerns, the retrieval procedure is complex and time consuming, decreasing operational efficiency of the rig. Furthermore, space in the area above the riser typically limits the drilling rig operator's ability to install equipment on top of the riser.

BRIEF SUMMARY OF THE INVENTION

In brief, a rotating control device can be stabbed into and removably latched to an upper section of the riser or a riser or bell nipple positioned on the riser (hereinafter both referred to as a "housing section"), sealing the rotating control device to the upper section of the housing section. A remotely actuatable latch assembly latches the rotating control device to the housing section. Remote actuation allows an operator to unlatch the rotating control device from the riser quickly, without sending personnel into the moon pool to disconnect the rotating control device. Similarly, the rotating control device can be remotely latched with a latch assembly latched to the housing section. The latch assembly can be remotely latched and unlatched with the housing section.

In one embodiment, a latch assembly is bolted or otherwise fixedly attached to the riser. The rotating control device then latches with the latch assembly and seals with the latch assembly. A piston in the latch assembly moves between a first and a second position, respectively compressing a retainer member, which can be a plurality of spaced-apart dog members, radially inwardly to latch with the rotating control device and allowing the retainer member to disengage from the rotating control device. In a further embodiment, a second piston can urge the first piston to move to the second position, providing a backup unlatching mechanism. The rotating control device has a latching formation that engages with the retainer member to latch the rotating control device with the latch assembly. The rotating control device can have a shoulder that lands on a landing formation of the housing section to limit downhole movement of the rotating control device.

In another embodiment, the latch assembly itself is latchable to the housing section, using a similar piston mechanism as used to latch the rotating control device to the latch assembly. In this other embodiment, a third piston, when moved to a first position, expands a second retainer member, which can be a plurality of spaced-apart dog members, radially outwardly, engaging a latching formation of the housing section, to latch the latch assembly to the housing section. The latch assembly can be remotely actuated. The housing section has a landing formation that engages a landing shoulder of the latch assembly, limiting downhole movement of the latch assembly. The latch assembly also has a landing formation that engages a landing shoulder of the rotating control device, to limit downhole movement of the rotating control device.

In one embodiment, while a tool joint can be used to remove the rotating control device from the latch assembly, eyelets on an upper surface of the rotating control device are provided for moving the rotating control device before installation and could be used for positioning the rotating control device with the latch assembly. In another embodiment, eyelets on an upper surface of the latch assembly can be used to position the latch assembly with the housing section.

BRIEF DESCRIPTION OF THE SEVERAL VIEWS OF THE DRAWINGS

A better understanding of the present invention can be obtained when the following detailed description of various disclosed embodiments is considered in conjunction with the following drawings, in which.

DETAILED DESCRIPTION OF THE INVENTION

Although the following is described in terms of a fixed offshore platform environment, other embodiments are contemplated for onshore use. Additionally, although the following is described in terms of oilfield drilling, the disclosed embodiments can be used in other operating environments and for drilling for non-petroleum fluids.

Figure 1:
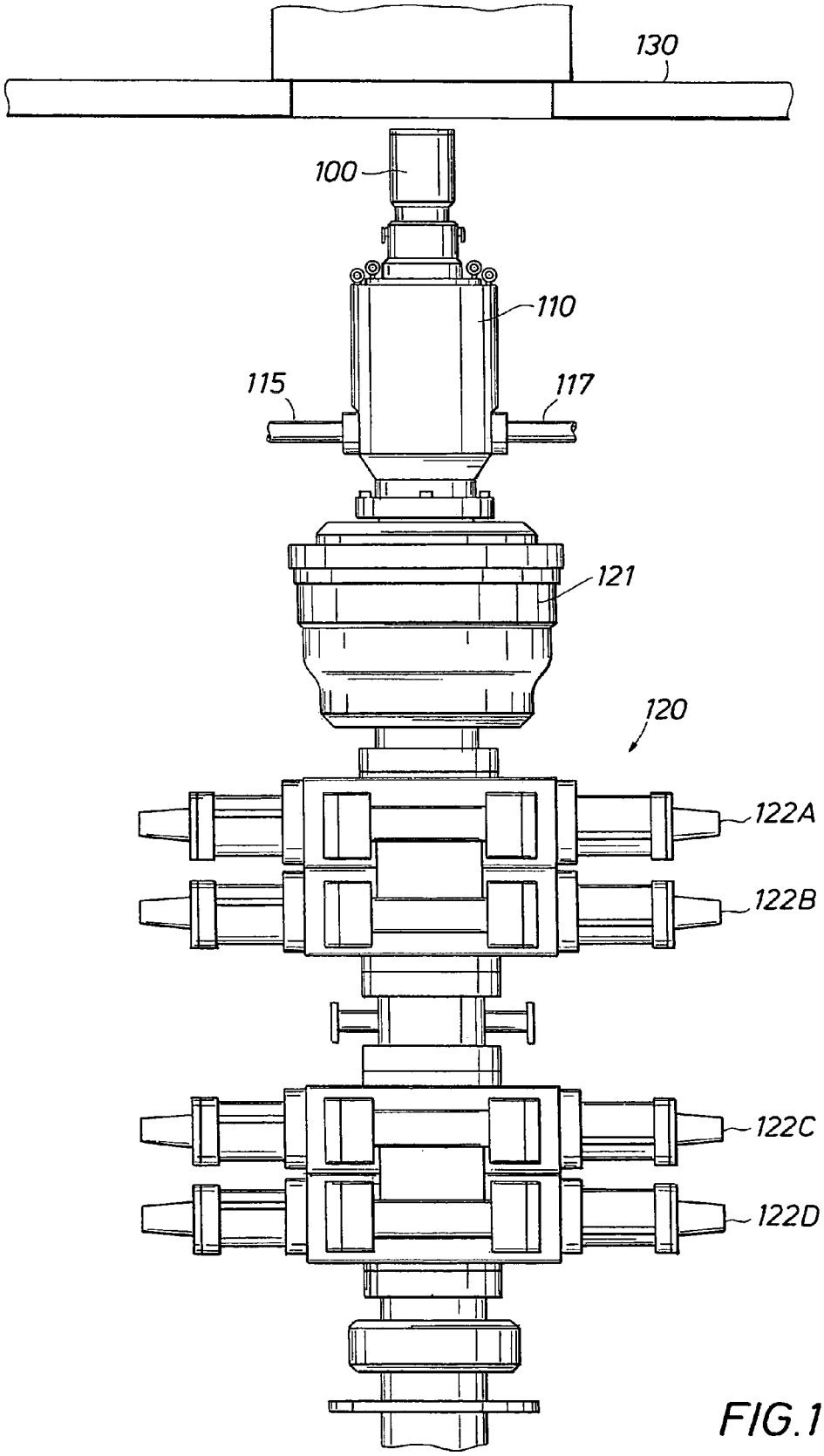
FIG. 1 is an elevational view of a rotating control device and a dual diverter housing positioned on a blowout preventer stack below a rotary table.

Turning to FIG. 1, a rotating control device 100 is shown latched into a riser or bell nipple 110 above a typical blowout preventer (BOP) stack, generally indicated at 120. As illustrated in FIG. 1, the exemplary BOP stack 120 contains an annular BOP 121 and four ram-type BOPs 122A-122D. Other BOP stack 120 configurations are contemplated and the configuration of these BOP stacks is determined by the work being performed. The rotating control device 100 is shown below the rotary table 130 in a moon pool of a fixed offshore drilling rig, such as a jackup or platform rig. The remainder of the drilling rig is not shown for clarity of the figure and is not significant to this application. Two diverter conduits 115 and 117 extend from the riser nipple 110. The diverter conduits 115 and 117 are typically rigid conduits; however, flexible conduits or lines are contemplated. With the rotating control device 100 latched with the riser nipple 110, the combination of the rotating control device 100 and riser nipple 110 functions as a rotatable marine diverter. In this configuration, the operator can rotate drill pipe (not shown) while the rotating marine diverter is closed or connected to a choke, for managed pressure or underbalanced drilling. The present invention could be used with the closed-loop circulating systems as disclosed in U.S. Patent Application Publication No. 2003/0079912 A1 published May 1, 2003 entitled "Drilling System and Method", International Publication No. 02/50398 A1 published Jun. 27, 2002 entitled "Closed Loop Fluid-Handling System for Well Drilling", and International Publication No. WO 03/071091 A1 published Aug. 28, 2003 entitled "Dynamic Annular Pressure Control Apparatus and Method." The disclosures of U.S. Patent Application Publication No. 2003/0079912 A1, International Publication No. WO 02/50398 A1 and International Publication No. WO 03/071091 A1 are incorporated herein in their entirety for all purposes.

Figure 2:
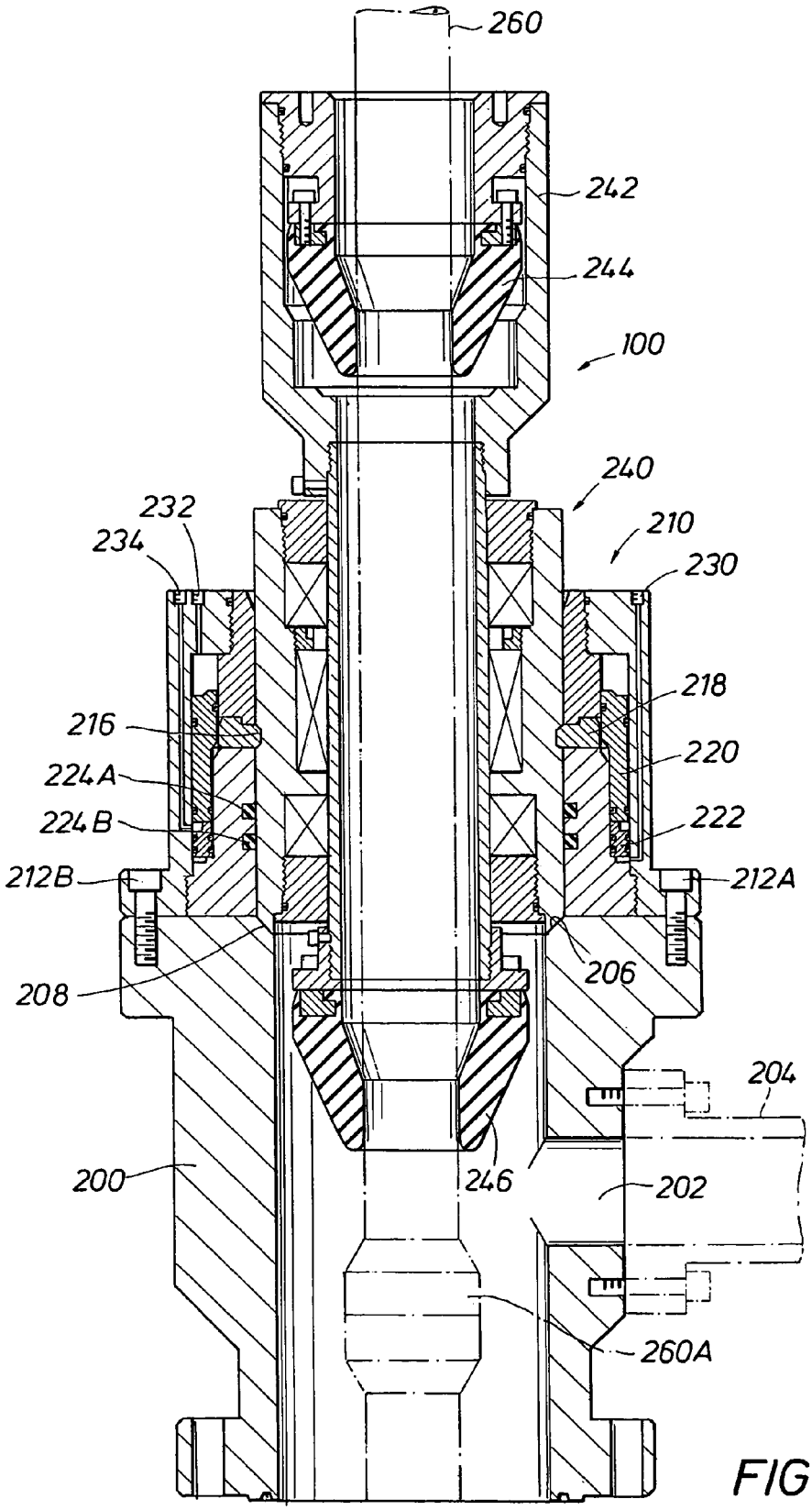
FIG. 2 is a cross-section view of one embodiment of the rotating control device and a single hydraulic latch assembly to better illustrate the rotating control device shown in elevational view in FIG. 1.

FIG. 2 is a cross-section view of an embodiment of a single diverter housing section, riser section, or other applicable wellbore tubular section (hereinafter a "housing section"), and a single hydraulic latch assembly to better illustrate the rotating control device 100 of FIG. 1. As shown in FIG. 2, a latch assembly separately indicated at 210 is bolted to a housing section 200 with bolts 212A and 212B. Although only two bolts 212A and 212B are shown in FIG. 2, any number of bolts and any desired arrangement of bolt positions can be used to provide the desired securement and sealing of the latch assembly 210 to the housing section 200. As shown in FIG. 2, the housing section 200 has a single outlet 202 for connection to a diverter conduit 204, shown in phantom view; however, other numbers of outlets and conduits can be used, as shown, for example, in the dual diverter embodiment of FIG. 1 with diverter conduits 115 and 117. Again, this conduit 204 can be connected to a choke. The size, shape, and configuration of the housing section 200 and latch assembly 210 are exemplary and illustrative only, and other sizes, shapes, and configurations can be used to allow connection of the latch assembly 210 to a riser. In addition, although the hydraulic latch assembly is shown connected to a nipple, the latch assembly can be connected to any conveniently configured section of a wellbore tubular or riser.

A landing formation 206 of the housing section 200 engages a shoulder 208 of the rotating control device 100, limiting downhole movement of the rotating control device 100 when positioning the rotating control device 100. The relative position of the rotating control device 100 and housing section 200 and latching assembly 210 are exemplary and illustrative only, and other relative positions can be used.

Figure 2A:
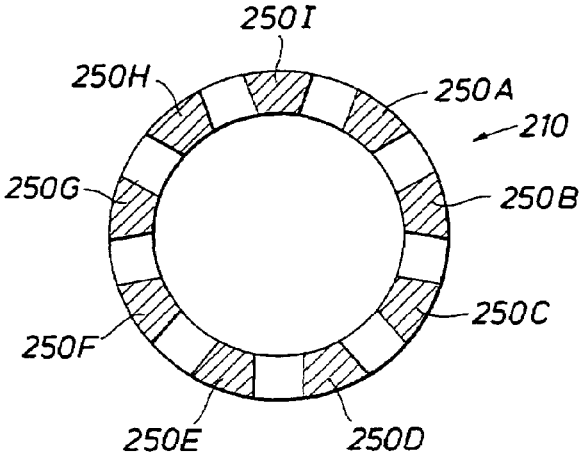
FIG. 2A is a cross-section view of a portion of one embodiment of the hydraulic latch assembly of FIG. 2 illustrating using a plurality of dog members as a retainer member.
Figure 2B:
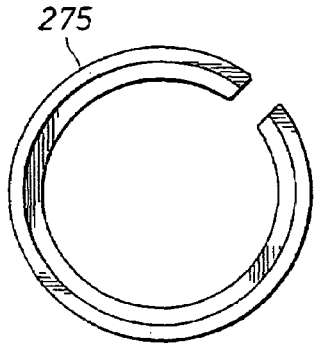
FIG. 2B is a plan view of a "C-shaped" retainer member.

FIG. 2 shows the latch assembly 210 latched to the rotating control device 100. A retainer member 218 extends radially inwardly from the latch assembly 210, engaging a latching formation 216 in the rotating control device 100, latching the rotating control device 100 with the latch assembly 210 and therefore with the housing section 200 bolted with the latch assembly 210. In some embodiments, the retainer member 218 can be "C-shaped", such as retainer ring 275 in FIG. 2B, that can be compressed to a smaller diameter for engagement with the latching formation 216. However, other types and shapes of retainer rings are contemplated. In other embodiments, the retainer member 218 can be a plurality of dog, key, pin, or slip members, spaced apart and positioned around the latch assembly 210, as illustrated by dog members 250A, 250B, 250C, 250D, 250E, 250F, 250G, 250H, and 2501 in FIG. 2A. In embodiments where the retainer member 218 is a plurality of dog or key members, the dog or key members can optionally be spring-biased. The number, shape, and arrangement of dog members 250 illustrated in FIG. 2A is illustrative and exemplary only, and other numbers, arrangements, and shapes can be used. Although a single retainer member 218 is described herein, a plurality of retainer members 218 can be used. The retainer member 218 has a cross section sufficient to engage the latching formation 216 positively and sufficiently to limit axial movement of the rotating control device 100 and still engage with the latch assembly 210.

An annular piston 220 is shown in a first position in FIG. 2, in which the piston 220 blocks the retainer member 218 in the radially inward position for latching with the rotating control device 100. Movement of the piston 220 from a second position to the first position compresses or moves the retainer member 218 radially inwardly to the engaged or latched position shown in FIG. 2. Although shown in FIG. 2 as an annular piston 220, the piston 220 can be implemented, for example, as a plurality of separate pistons disposed about the latch assembly 210.

Figure 6:
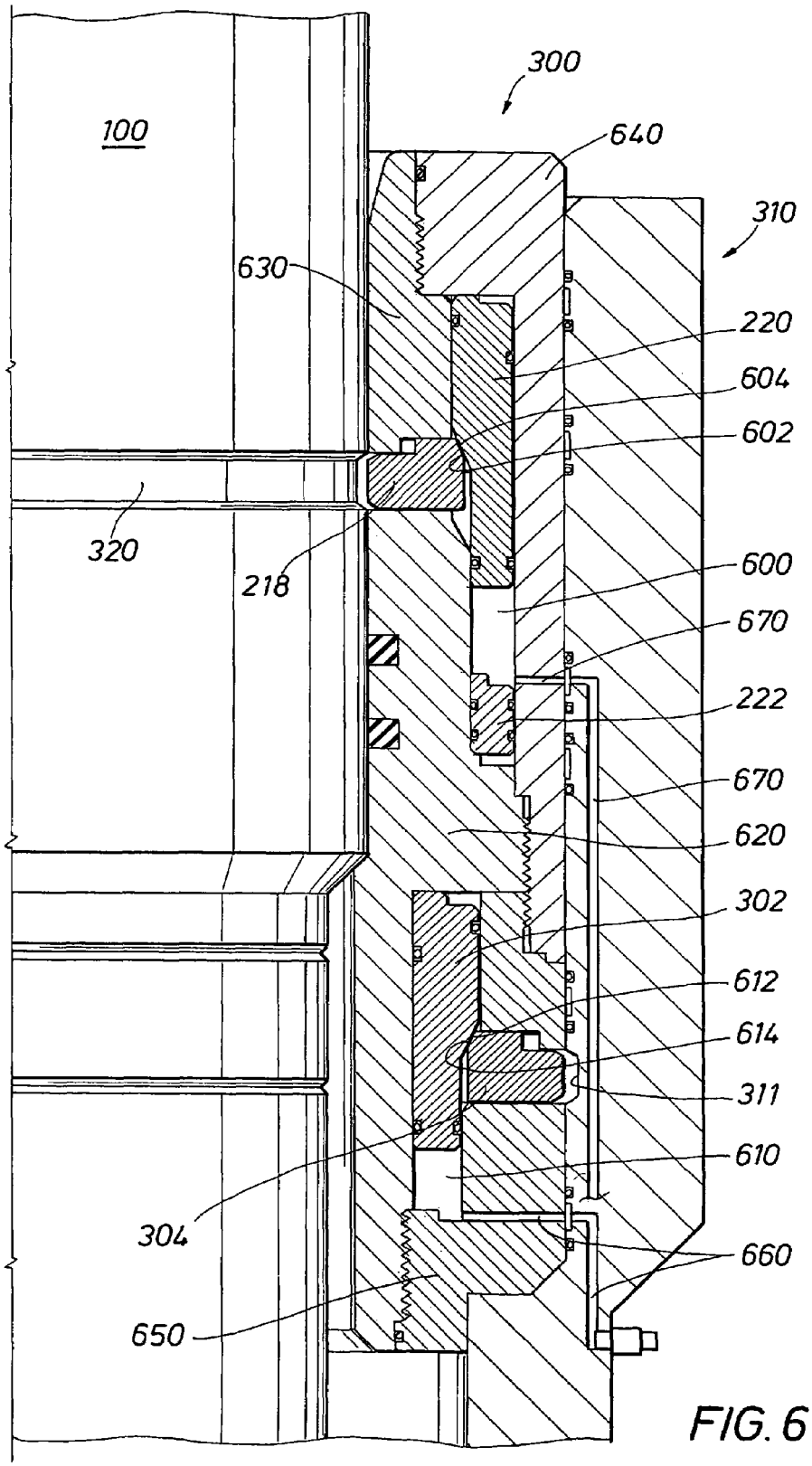
FIG. 6 is an enlarged cross-section detail view of one side of the dual hydraulic latch assembly of FIG. 3, with both the rotating control device and the housing section unlatched from the latch assembly.

As best shown in the dual hydraulic latch assembly embodiment of FIG. 6, when the piston 220 moves to a second position, the retainer member 218 can expand or move radially outwardly to disengage from and unlatch the rotating control device 100 from the latch assembly 210. The retainer member 218 and latching formation 216 (FIG. 2) or 320 (FIG. 6) can be formed such that a predetermined upward force on the rotating control device 100 will urge the retainer member radially outwardly to unlatch the rotating control device 100. A second or auxiliary piston 222 can be used to urge the first piston 220 into the second position to unlatch the rotating control device 100, providing a backup unlatching capability. The shape and configuration of pistons 220 and 222 are exemplary and illustrative only, and other shapes and configurations can be used.

Returning now to FIG. 2, hydraulic ports 232 and 234 and corresponding gun-drilled passageways allow hydraulic actuation of the piston 220. Increasing the relative pressure on port 232 causes the piston 220 to move to the first position, latching the rotating control device 100 to the latch assembly 210 with the retainer member 218. Increasing the relative pressure on port 234 causes the piston 220 to move to the second position, allowing the rotating control device 100 to unlatch by allowing the retainer member 218 to expand or move and disengage from the rotating control device 100. Connecting hydraulic lines (not shown in the figure for clarity) to ports 232 and 234 allows remote actuation of the piston 220.

The second or auxiliary annular piston 222 is also shown as hydraulically actuated using hydraulic port 230 and its corresponding gun-drilled passageway. Increasing the relative pressure on port 230 causes the piston 222 to push or urge the piston 220 into the second or unlatched position, should direct pressure via port 234 fail to move piston 220 for any reason.

The hydraulic ports 230, 232 and 234 and their corresponding passageways shown in FIG. 2 are exemplary and illustrative only, and other numbers and arrangements of hydraulic ports and passageways can be used. In addition, other techniques for remote actuation of pistons 220 and 222, other than hydraulic actuation, are contemplated for remote control of the latch assembly 210.

Thus, the rotating control device 100 illustrated in FIG. 2 can be positioned, latched, unlatched, and removed from the housing section 200 and latch assembly 210 without sending personnel below the rotary table into the moon pool to manually connect and disconnect the rotating control device 100.

An assortment of seals is used between the various elements described herein, such as wiper seals and O-rings, known to those of ordinary skill in the art. For example, each piston 220 preferably has an inner and outer seal to allow fluid pressure to build up and force the piston in the direction of the force. Likewise, seals can be used to seal the joints and retain the fluid from leaking between various components. In general, these seals will not be further discussed herein.

For example, seals 224A and 224B seal the rotating control device 100 to the latch assembly 210. Although two seals 224A and 224B are shown in FIG. 2, any number and arrangement of seals can be used. In one embodiment, seals 224A and 224B are Parker Polypak® ¼-inch cross section seals from Parker Hannifin Corporation. Other seal types can be used to provide the desired sealing.

Figure 3:
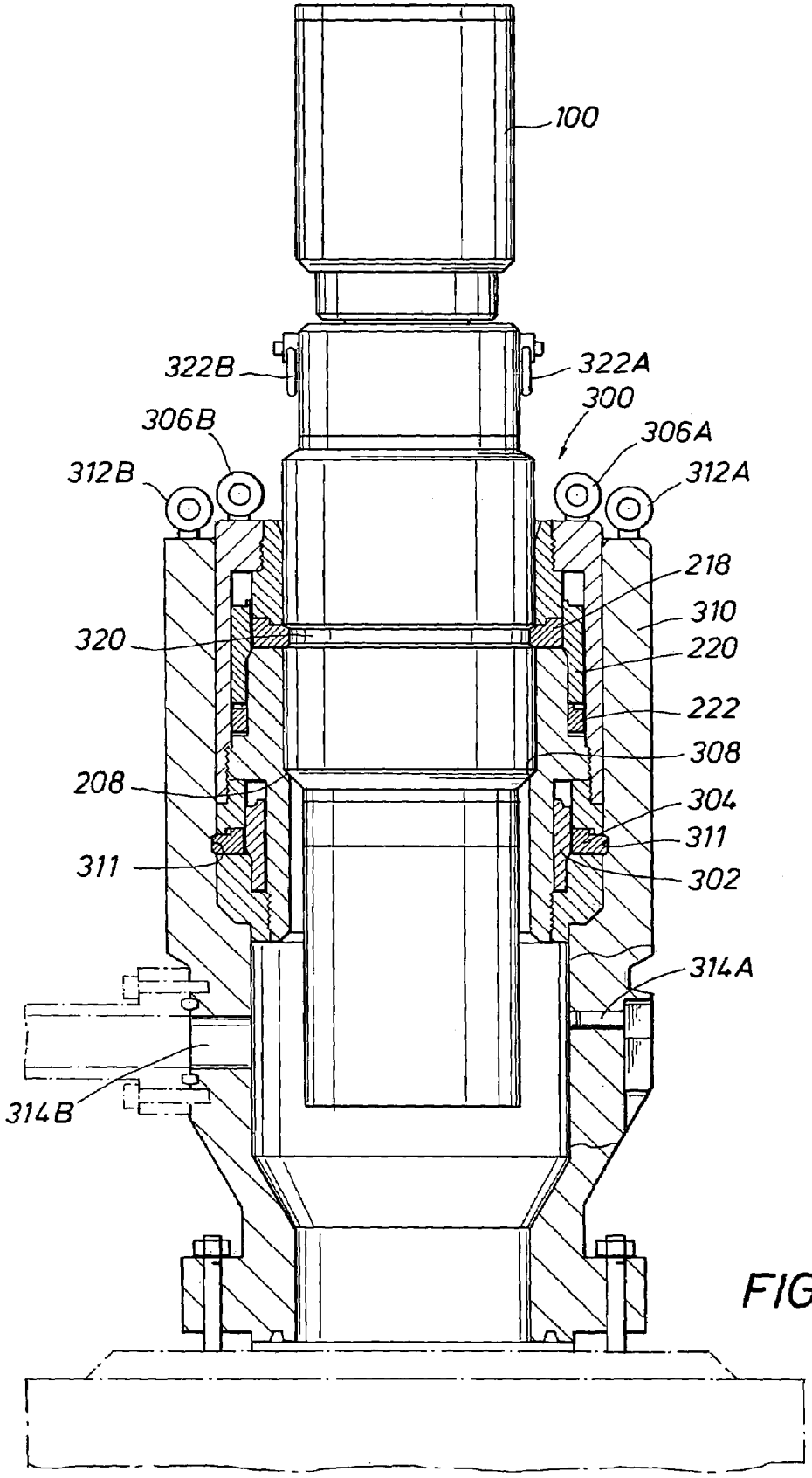
FIG. 3 is a cross-section view of the rotating control device and a second embodiment of a single diverter housing and a dual hydraulic latch assembly.

FIG. 3 illustrates a second embodiment of a latch assembly, generally indicated at 300, that is a dual hydraulic latch assembly. As with the single latch assembly 210 embodiment illustrated in FIG. 2, piston 220 compresses or moves retainer member 218 radially inwardly to latch the rotating control device 100 to the latch assembly 300. The retainer member 218 latches the rotating control device 100 in a latching formation, shown as an annular groove 320, in an outer housing of the rotating control device 100 in FIG. 3. The use and shape of annular groove 320 is exemplary and illustrative only and other latching formations and formation shapes can be used. The dual hydraulic latch assembly includes the pistons 220 and 222 and retainer member 218 of the single latch assembly embodiment of FIG. 2 as a first latch subassembly. The various embodiments of the dual hydraulic latch assembly discussed below as they relate to the first latch subassembly can be equally applied to the single hydraulic latch assembly of FIG. 2.

In addition to the first latch subassembly comprising the pistons 220 and 222 and the retainer member 218, the dual hydraulic latch assembly 300 embodiment illustrated in FIG. 3 provides a second latch subassembly comprising a third piston 302 and a second retainer member 304. In this embodiment, the latch assembly 300 is itself latchable to a housing section 310, shown as a riser nipple, allowing remote positioning and removal of the latch assembly 300. In such an embodiment, the housing section 310 and dual hydraulic latch assembly 300 are preferably matched with each other, with different configurations of the dual hydraulic latch assembly implemented to fit with different configurations of the housing section 310. A common embodiment of the rotating control device 100 can be used with multiple dual hydraulic latch assembly embodiments; alternately, different embodiments of the rotating control device 100 can be used with each embodiment of the dual hydraulic latch assembly 300 and housing section 310.

As with the first latch subassembly, the piston 302 moves to a first or latching position. However, the retainer member 304 instead expands radially outwardly, as compared to inwardly, from the latch assembly 300 into a latching formation 311 in the housing section 310. Shown in FIG. 3 as an annular groove 311, the latching formation 311 can be any suitable passive formation for engaging with the retainer member 304. As with pistons 220 and 222, the shape and configuration of piston 302 is exemplary and illustrative only and other shapes and configurations of piston 302 can be used. In some embodiments, the retainer member 304 can be "C-shaped", such as retainer ring 275 in FIG. 2B, that can be expanded to a larger diameter for engagement with the latching formation 311. However, other types and shapes of retainer rings are contemplated. In other embodiments, the retainer member 304 can be a plurality of dog, key, pin, or slip members, positioned around the latch assembly 300. In embodiments where the retainer member 304 is a plurality of dog or key members, the dog or key members can optionally be spring-biased. Although a single retainer member 304 is described herein, a plurality of retainer members 304 can be used. The retainer member 304 has a cross section sufficient to engage positively the latching formation 311 to limit axial movement of the latch assembly 300 and still engage with the latch assembly 300.

Shoulder 208 of the rotating control device 100 in this embodiment lands on a landing formation 308 of the latch assembly 300, limiting downward or downhole movement of the rotating control device 100 in the latch assembly 300. As stated above, the latch assembly 300 can be manufactured for use with a specific housing section, such as housing section 310, designed to mate with the latch assembly 300. In contrast, the latch assembly 210 of FIG. 2 can be manufactured to standard sizes and for use with various generic housing sections 200, which need no modification for use with the latch assembly 210.

Cables (not shown) can be connected to eyelets or rings 322A and 322B mounted on the rotating control device 100 to allow positioning of the rotating control device 100 before and after installation in a latch assembly. The use of cables and eyelets for positioning and removal of the rotating control device 100 is exemplary and illustrative, and other positioning apparatus and numbers and arrangements of eyelets or other attachment apparatus, such as discussed below, can be used.

Similarly, the latch assembly 300 can be positioned in the housing section 310 using cables (not shown) connected to eyelets 306A and 306B, mounted on an upper surface of the latch assembly 300. Although only two such eyelets 306A and 306B are shown in FIG. 3, other numbers and placements of eyelets can be used. Additionally, other techniques for mounting cables and other techniques for positioning the unlatched latch assembly 300, such as discussed below, can be used. As desired by the operator of a rig, the latch assembly 300 can be positioned or removed in the housing section 310 with or without the rotating control device 100. Thus, should the rotating control device 100 fail to unlatch from the latch assembly 300 when desired, for example, the latched rotating control device 100 and latch assembly 300 can be unlatched from the housing section 310 and removed as a unit for repair or replacement. In other embodiments, a shoulder of a running tool, tool joint 260A of a string 260 of pipe, or any other shoulder on a tubular that could engage lower stripper rubber 246. can be used for positioning the rotating control device 100 instead of the above-discussed eyelets and cables. An exemplary tool joint 260A of a string of pipe 260 0is illustrated in phantom in FIG. 2.

Figure 4:
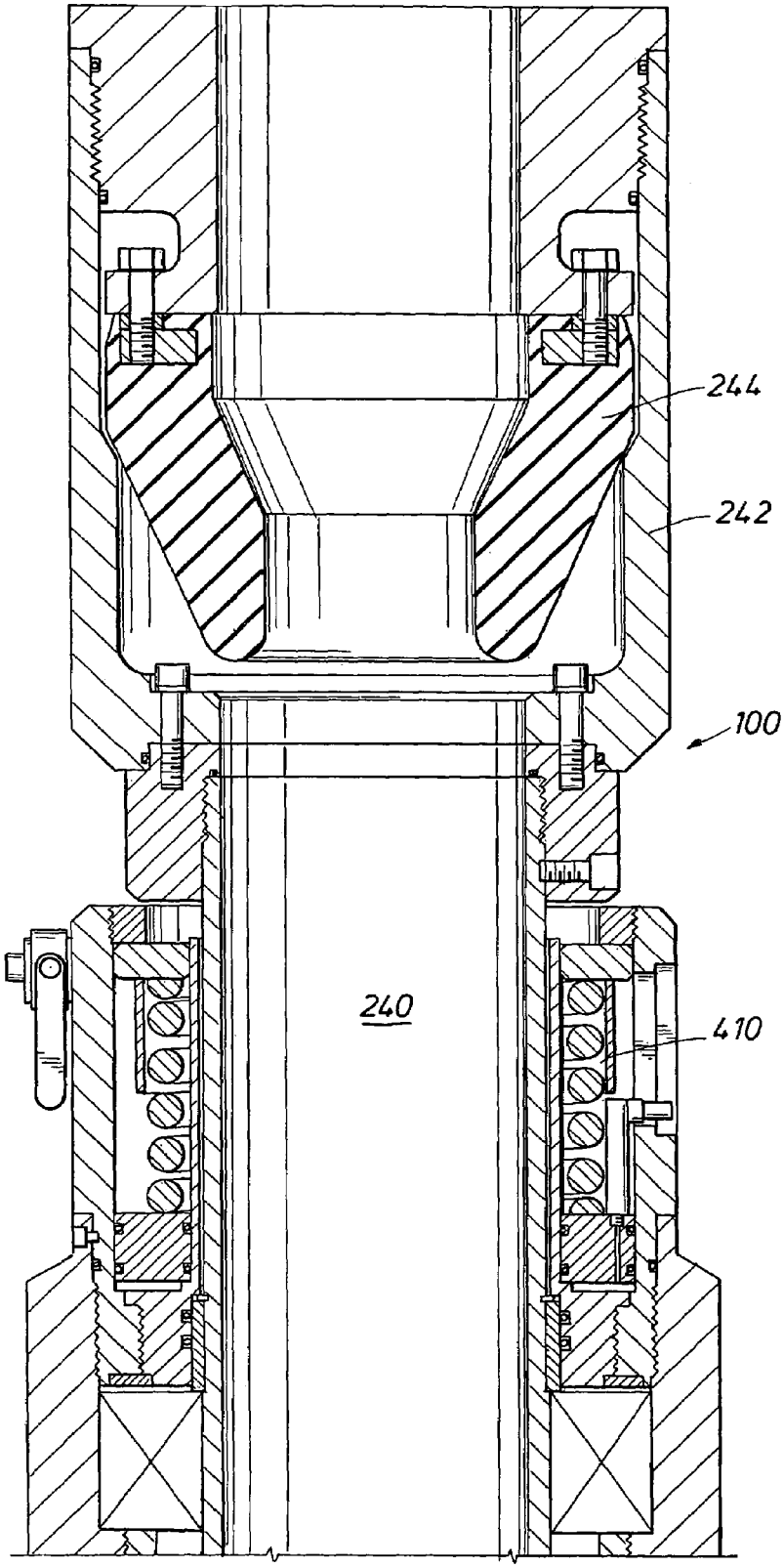
FIG. 4 is an enlarged cross-section detail view of an upper end of the rotating control device of FIGS. 1, 2, and 3 with an accumulator.
Figure 5:
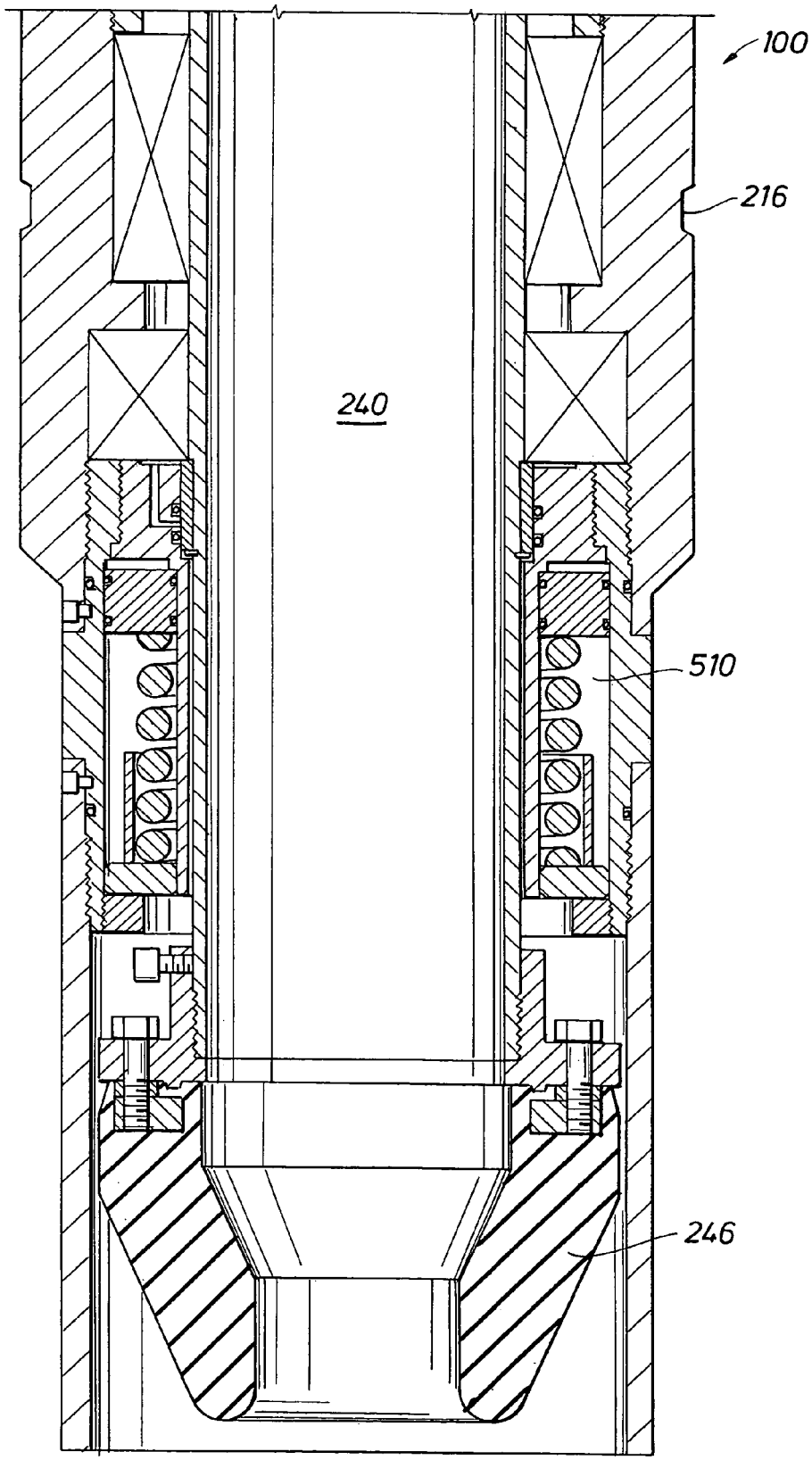
FIG. 5 is an enlarged cross-section detail view of a lower end of the rotating control device of FIGS. 1, 2, and 3 with an accumulator.

As best shown in FIGS. 2, 4, and 5, the rotating control device 100 includes a bearing assembly 240. The bearing assembly 240 is similar to the Weatherford-Williams model 7875 rotating control device, now available from Weatherford International, Inc., of Houston, Tex. Alternatively, Weatherford-Williams models 7000, 7100, IP-1000, 7800, 8000/9000, and 9200 rotating control devices or the Weatherford RPM SYSTEM 3000™, now available from Weatherford International, Inc., could be used. Preferably, a rotating control device 240 with two spaced-apart seals, such as stripper rubbers, is used to provide redundant sealing. The major components of the bearing assembly 240 are described in U.S. Pat. No. 5,662,181, now owned by Weatherford/Lamb, Inc., which is incorporated herein by reference in its entirety for all purposes. Generally, the bearing assembly 240 includes a top rubber pot 242 that is sized to receive a top stripper rubber or inner member seal 244; however, the top rubber pot 242 and seal 244 can be omitted, if desired. Preferably, a bottom stripper rubber or inner member seal 246 is connected with the top seal 244 by the inner member of the bearing assembly 240. The outer member of the bearing assembly 240 is rotatably connected with the inner member. In addition, the seals 244 and 246 can be passive stripper rubber seals, as illustrated, or active seals as known by those of ordinary skill in the art.

In the embodiment of a single hydraulic latch assembly 210, such as illustrated in FIG. 2, the lower accumulator 510 as shown in FIG. 5 is required, because hoses and lines cannot be used to maintain hydraulic fluid pressure in the bearing assembly 100 lower portion. In addition, the accumulator 510 allows the bearings (not shown) to be self-lubricating. An additional accumulator 410, as shown in FIG. 4, can be provided in the upper portion of the bearing assembly 100 if desired.

Turning to FIG. 6, an enlarged cross-section view illustrates one side of the latch assembly 300. Both the first retainer member 218 and the second retainer member 304 are shown in their unlatched position, with pistons 220 and 302 in their respective second, or unlatched, position. Sections 640 and 650 form an outer housing for the latch assembly 300, while sections 620 and 630 form an inner housing, illustrated in FIG. 6 as threadedly connected to the outer housing 640 and 650. Other types of connections can be used to connect the inner housing and outer housing of the latch assembly 300. Furthermore, the number, shape, relative sizes, and structural interrelationships of the sections 620, 630, 640 and 650 are exemplary and illustrative only and other relative sizes, numbers, shapes, and configurations of sections, and arrangements of sections can be used to form inner and outer housings for the latch assembly 300. The inner housings 620 and 630 and the outer housings 640 and 650 form chambers 600 and 610, respectively. Pistons 220 and 222 are slidably positioned in chamber 600 and piston 302 is slidably positioned in chamber 610. The relative size and position of chambers 600 and 610 are exemplary and illustrative only. In particular, some embodiments of the latch assembly 300 can have the relative position of chambers 610 and 600 reversed, with the first latch subassembly of pistons 220, 222, and retainer member 218 being lower (relative to FIG. 6) than the second latch subassembly of piston 302 and retainer member 304.

As illustrated in FIG. 6, the piston 220 is axially aligned in an offset manner from the retainer member 218 by an amount sufficient to engage a tapered surface 604 on the outer periphery of the retainer member 218 with a corresponding tapered surface 602 on the inner periphery of the piston 220. The force exerted between the tapered surfaces 602 and 604 compresses the retainer member 218 radially inwardly to engage the groove 320. Similarly, the piston 302 is axially aligned in an offset manner from the retainer member 304 by an amount sufficient to engage a tapered surface 614 on the inner periphery of the retainer member 304 with a corresponding tapered surface 612 on the outer periphery of the piston 302. The force exerted between the tapered surfaces 612 and 614 expands the retainer member 304 radially outwardly to engage the groove 311.

Although no piston is shown for urging piston 302 similar to the second or auxiliary piston 222 used to disengage the rotating control device from the latch assembly 300, it is contemplated that an auxiliary piston (not shown) to urge piston 302 from the first, latched position to the second, unlatched position could be used, if desired.

Figure 7:
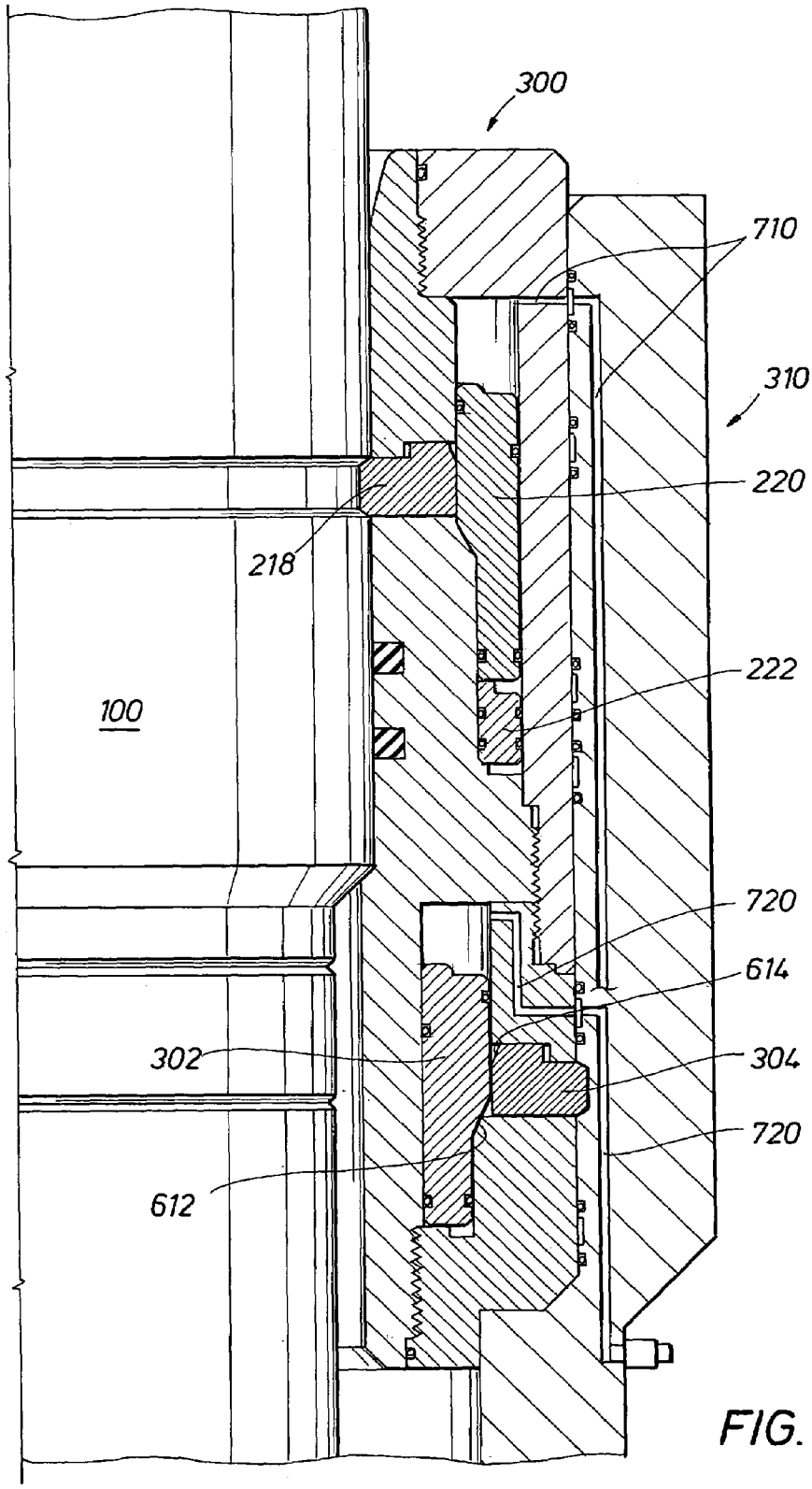
FIG. 7 is an enlarged cross-section detail view similar to FIG. 6 with the dual hydraulic latch assembly shown in the latched position with both the rotating control device and the housing section.
Figure 8:
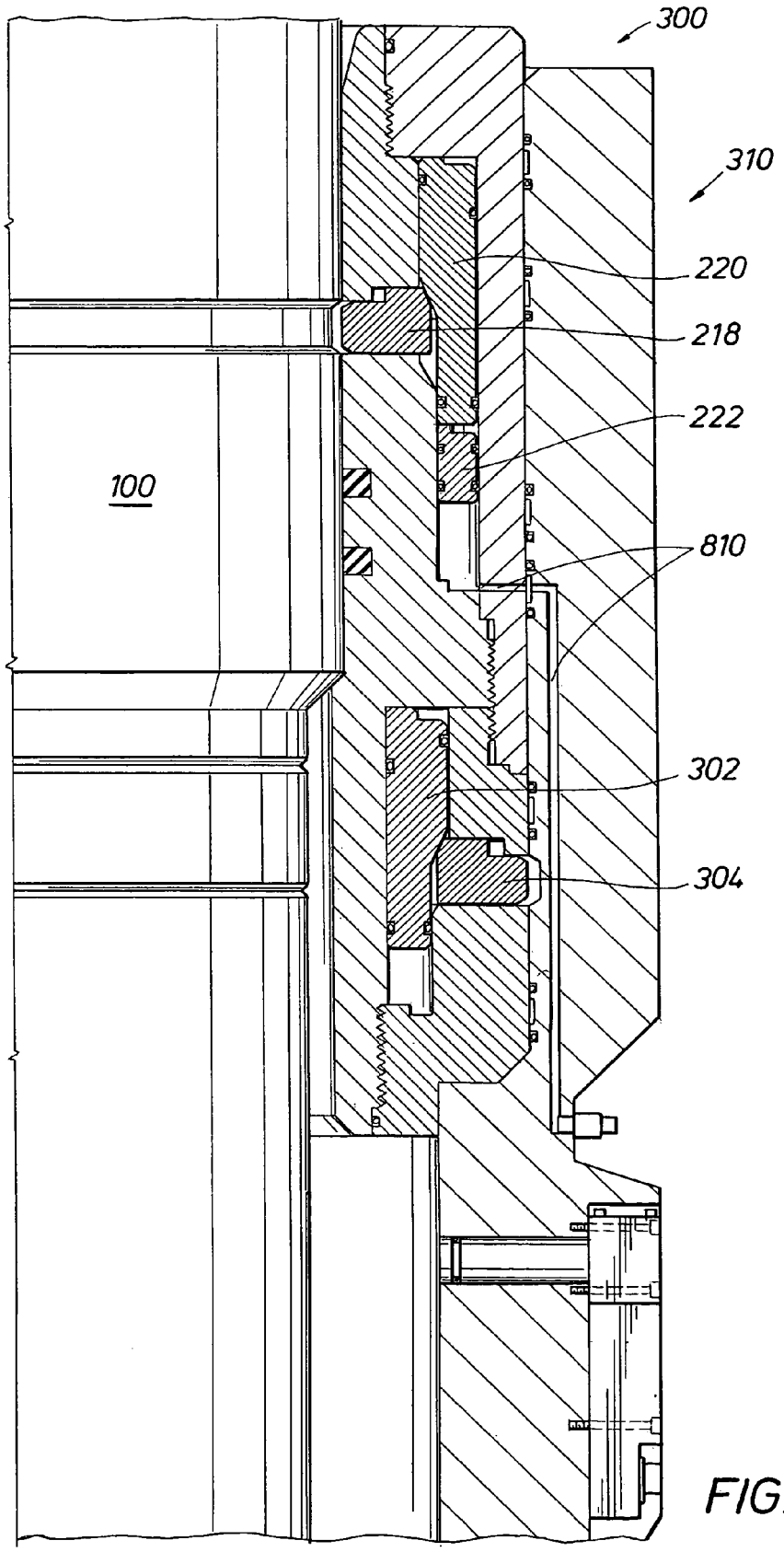
FIG. 8 is an enlarged cross-section detail view similar to FIG. 6 with the dual hydraulic latch assembly shown in the unlatched position from both the rotating control device and the housing section and an auxiliary piston in an unlatched position.

FIGS. 6 to 8 illustrate the latch assembly 300 in three different positions. In FIG. 6, both the retainer members 218 and 304 are in their retracted or unlatched position. Hydraulic fluid pressure in passageways 660 and 670 (the port for passageway 670 is not shown) move pistons 220 and 302 upward relative to the figure, allowing retainer member 218 to move radially outwardly and retainer member 304 to move radially inwardly to unlatch the rotating control device 100 from the latch assembly 300 and the latch assembly 300 from the housing section 310. No direct manipulation is required to move the retainer members 218 and 304 to their unlatched position.

In FIGS. 6 to 8, the passageways 660, 670, 710, 720, and 810 that traverse the latch assembly 300 and the housing section 310 connect to ports on the side of the housing section 310. However, other positions for the connection ports can be used, such as on the top surface of the riser nipple as shown in FIG. 2, with corresponding redirection of the passageways 660, 670, 710, 720, and 810 without traversing the housing section 310. Therefore, the position of the hydraulic ports and corresponding passageways shown in FIGS. 6 to 8 are illustrative and exemplary only, and other hydraulic ports and passageways and location of ports and passageways can be used. In particular, although FIGS. 6 to 8 show the passageways 660, 670, 710, 720, and 810 traversing the latch assembly 300 and housing section 310, the passageways can be contained solely within the latch assembly 300.

FIG. 7 shows both retainer members 218 and 304 in their latched position. Hydraulic pressure in passageway 710 (port not shown) and 720 move pistons 220 and 302 to their latched position, urging retainer members 218 and 304 to their respective latched positions.

FIG. 8 shows use of the auxiliary or secondary piston 222 to urge or move the piston 220 to its second, unlatched position, allowing radially outward expansion of retainer member 218 to unlatch the rotating control device 100 from the latch assembly 300. Hydraulic passageway 810 provides fluid pressure to actuate the piston 222.

Furthermore, although FIGS. 6 to 8 illustrate the retainer member 218 and the retainer member 304 with both retainer members 218 and 304 being latched or both retainer members 218 and 304 being unlatched, operation of the latch assembly 300 can allow retainer member 218 to be in a latched position while retainer member 304 is in an unlatched position and vice versa. This variety of positioning is achieved since each of the hydraulic passageways 660,670, 710, 720, and 810 can be selectively and separately pressurized.

Figure 9:
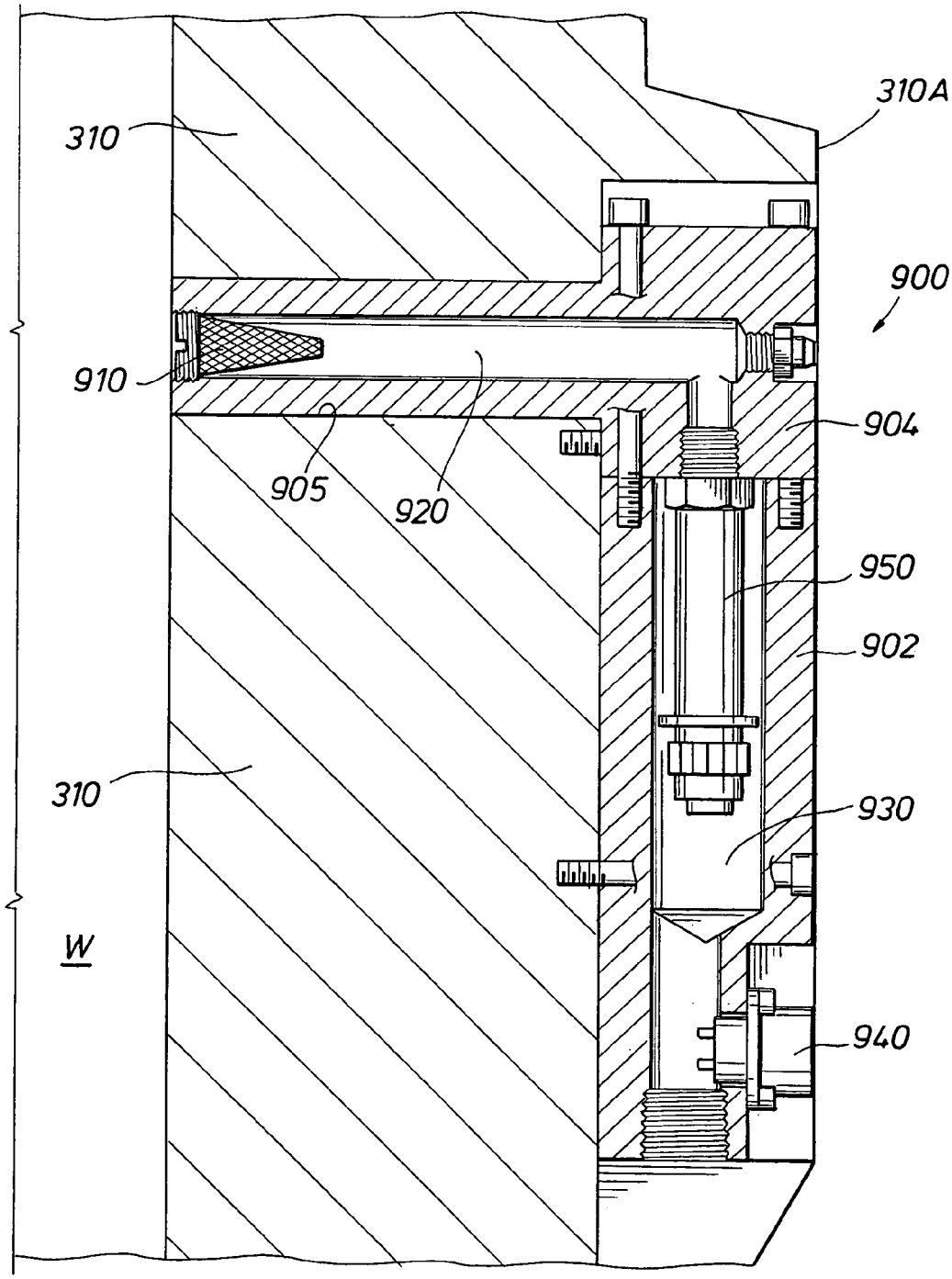
FIG. 9 is a enlarged cross-section detail view of a transducer protector assembly in a housing section.

Turning to FIG. 9, a pressure transducer protector assembly, generally indicated at 900, attached to a sidewall of the housing section 310 protects a pressure transducer 950. A passage 905 extends through the sidewall of the housing section 310 between a wellbore W or an inward surface of the housing section 310 to an external surface 310A of the housing section 310. A housing for the pressure transducer protector assembly 900 comprises sections 902 and 904 in the exemplary embodiment illustrated in FIG. 9. Section 904 extends through the passage 905 of the housing section 310 to the wellbore W, positioning a conventional diaphragm 910 at the wellbore end of section 904. A bore or chamber 920 formed interior to section 904 provides fluid communication from the diaphragm 910 to a pressure transducer 950 mounted in chamber 930 of section 902. Sections 902 and 904 are shown bolted to each other and to the housing section 310, to form the pressure transducer protector assembly 900. Other ways of connecting sections 902 and 904 to each other and to the housing section 310 or other housing section can be used. Additionally, the pressure transducer protector assembly 900 can be unitary, instead of comprising the two sections 902 and 904. Other shapes, arrangements, and configurations of sections 902 and 904 can be used.

Pressure transducer 950 is a conventional pressure transducer and can be of any suitable type or manufacture. In one embodiment, the pressure transducer 950 is a sealed gauge pressure transducer. Additionally, other instrumentation can be inserted into the passage 905 for monitoring predetermined characteristics of the wellbore W.

A plug 940 allows electrical connection to the transducer 950 for monitoring the pressure transducer 950. Electrical connections between the transducer 950 and plug 940 and between the plug 940 to an external monitor are not shown for clarity of the figure.

Figure 10B:
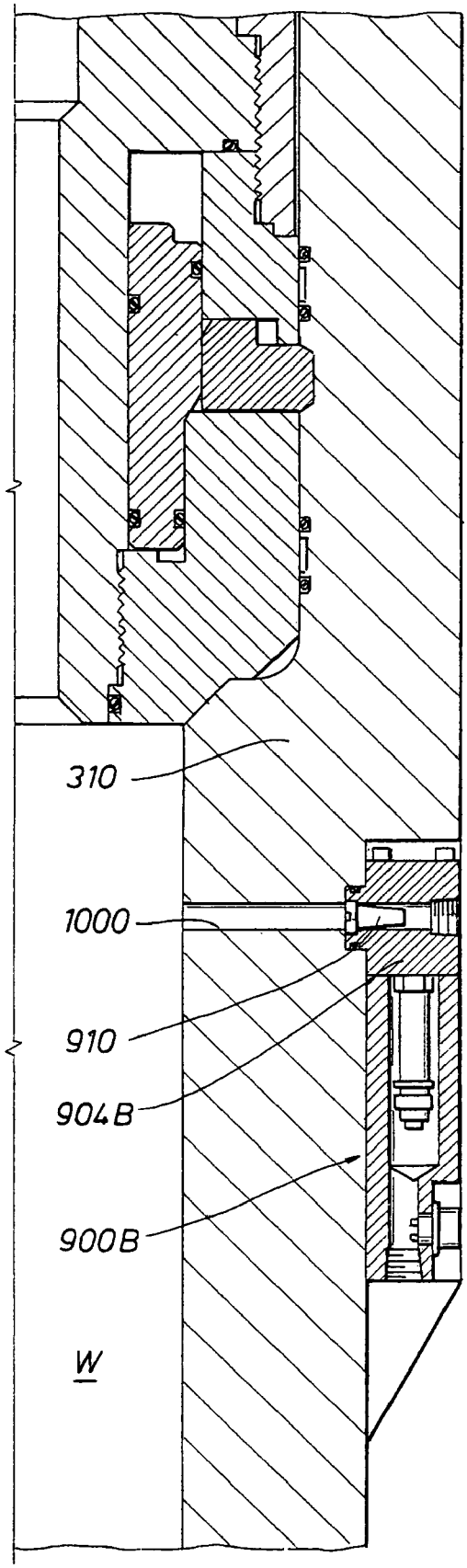
FIGS. 10A and 10B are enlarged cross-section views of two configurations of the transducer protector assembly in a housing section in relation to the dual hydraulic latch assembly of FIGS. 6-8.
Figure 10A:
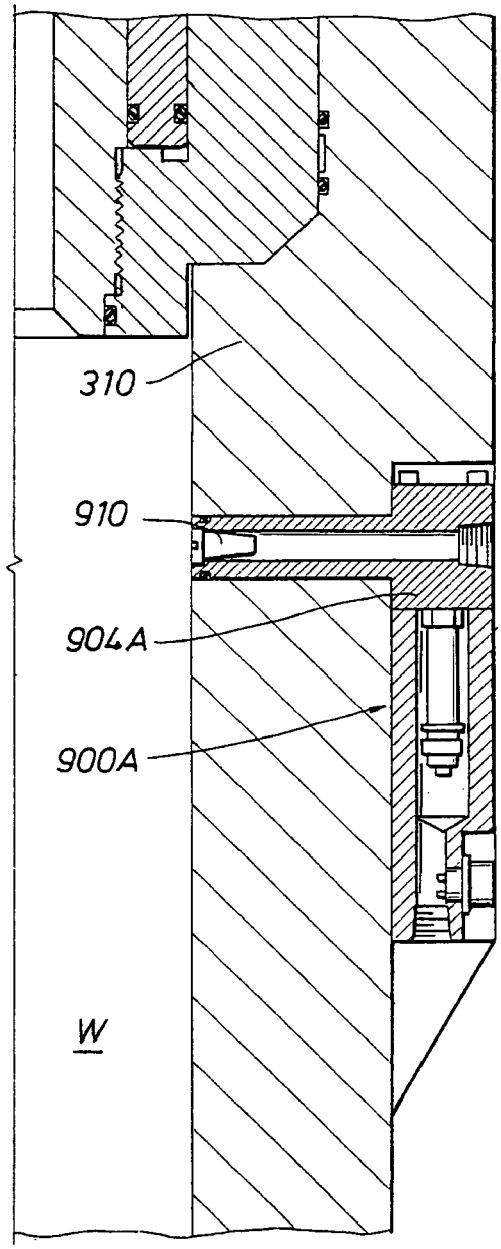

FIGS. 10A and 10B illustrate two alternate embodiments of the pressure transducer protector assembly 900 and illustrate an exemplary placement of the pressure transducer protector assembly 900 in the housing section 310. The placement of the pressure transducer protector assembly 900 in FIGS. 10A and 10B is exemplary and illustrative only, and the assembly 900 can be placed in any suitable location of the housing section 310. The assembly 900A of FIG. 10A differs from the assembly 900B of FIG. 10B only in the length of the section 904 and position of the diaphragm 910. In FIG. 10A, the section 904A extends all the way through the housing section 310, placing the diaphragm 910 at the interior or wellbore W surface of the housing section 310. The alternate embodiment of FIG. 10B instead limits the length of section 904B, placing the diaphragm 910 at the exterior end of a bore 1000 formed in the housing section 310. The alternate embodiments of FIGS. 10A and 10B are exemplary only and other section 904 lengths and diaphragm 910 placements can be used, including one in which diaphragm 910 is positioned interior to the housing section 310 at the end of a passage similar to passage 1000 extending part way through the housing section 310. The embodiment of FIG. 10A is preferable, to avoid potential problems with mud or other substances clogging the diaphragm 910. The wellbore pressure measured by pressure transducer 950 can be used to protect against unlatching the selected latching assembly 300 if the wellbore pressure is above a predetermined amount. One value contemplated for the predetermined wellbore pressure is a range of above 20-30 PSI. Although illustrated with the dual hydraulic latch assembly 300 in FIGS. 10A and 10B, the pressure transducer protector assembly 900 can be used with the single hydraulic latch assembly 210 of FIG. 2.

FIGS. 11A-17 illustrate various alternate embodiments for a latch position indicator system that can allow a system or rig operator to determine remotely whether the dual hydraulic latch assembly 300 is latched or unlatched to the housing section, such as housing section 310, and the rotating control device 100. Although FIGS. 11A-17 are configured for the dual hydraulic latch assembly 300, one skilled in the art would recognize that the relevant portions of the latch position indicator system can also be used with the single hydraulic latch assembly 210 of FIG. 2, using only those elements related to latching the latch assembly to the rotating control device 100.

In one embodiment, illustrated in FIGS. 11A-11H and FIG. 12, hydraulic lines (not shown) provide fluid to the latch assembly 300 for determining whether the latch assembly 300 is latched or unlatched from the rotating control device 100 and the housing section 310. Hydraulic lines also provide fluid to the latch assembly 300 to move the pistons 220, 222, and 302. In the illustrated embodiment, hydraulic fluid is provided from a fluid source (not shown) through a hydraulic line (not shown) to ports, best shown in FIG. 12. Passageways internal to the housing section 310 and latch assembly 300 communicate the fluid to the pistons 220, 222, and 302 for moving the pistons 220, 222, and 302 between their unlatched and latched positions. In addition, passageways internal to the housing section 310 and latch assembly 300 communicate the fluid to the pistons 220, 222, and 302 for the latch position indicator system. Channels are formed in a surface of the pistons 220 and 302. As illustrated in FIGS. 11A-11H, these channels in an operating orientation are substantially horizontal grooves that traverse a surface of the pistons 220 and 302. If piston 220 or 302 is in the latched position, the channel aligns with at least two of the passageways, allowing a return passageway for the hydraulic fluid. As described below in more detail with respect to FIG. 13, a hydraulic fluid pressure in the return line can be used to indicate whether the piston 220 or 302 is in the latched or unlatched position. If the piston 220 or 302 is in the latched position, a hydraulic fluid pressure will indicate that the channel is providing fluid communication between the input hydraulic line and the return hydraulic line. If the piston 220 or 302 is in the unlatched position, the channel is not aligned with the passageways, producing a lower pressure on the return line. As described below in more detail, the pressure measurement could also be on the input line, with a higher pressure indicating non-alignment of the channel and passageways, hence the piston 220 or 302 is in the unlatched position, and a lower pressure indicating alignment of the channel and passageways, hence the piston 220 or 302 is in the latched position. As described below in more detail, a remote latch position indicator system can use these pressure values to cause indicators to display whether the pistons 220 and 302 are latched or unlatched.

Typically, the passageways are holes formed by drilling the applicable element, sometimes known as "gun-drilled holes." More than one drilling can be used for passageways that are not a single straight passageway, but that make turns within one or more element. However, other techniques for forming the passageways can be used. The positions, orientations, and relative sizes of the passageways illustrated in FIGS. 11A-11H are exemplary and illustrative only and other position, orientations, and relative sizes can be used.

The channels of FIG. 11A-11H are illustrated as grooves, but any shape or configuration of channel can be used as desired. The positions, shape, orientations, and relative sizes of the channels illustrated in FIGS. 11A-11H are exemplary and illustrative only and other position, orientations, and relative sizes can be used.

Figure 11A:
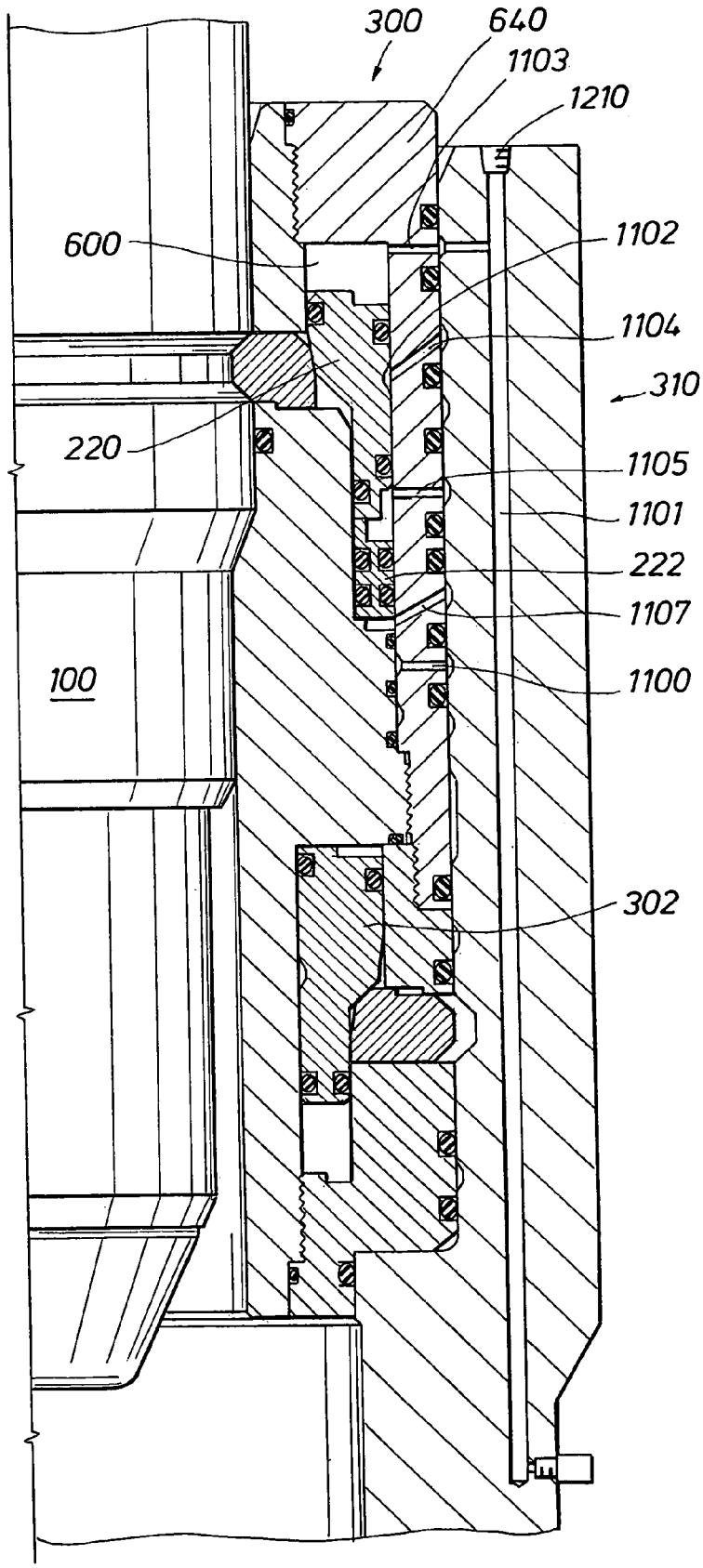
FIGS. 11A-11H are enlarged cross-section detail views of the dual hydraulic latch assembly of FIGS. 6-8 taken along lines 11A-11A, llB-11B, 11C-11C, 1lD-llD, 11E-11E, 1lF-11F, 11G- 11G, and 11H-11H of FIG. 12, illustrating passageways of a hydraulic fluid pressure- sensing system for communicating whether the dual latch assembly is unlatched or latched.

Turning to FIG. 11A, which illustrates a slice of the latch assembly 300 and housing section 310 along line A-A, passageway 1101 formed in housing section 310 provides fluid communication from a hydraulic line (not shown) to the latch assembly 300 to provide hydraulic fluid to move piston 220 from the unlatched position to the latched position. A passageway 1103 formed in outer housing element 640 communications passageway 1101 and the chamber 600, allowing fluid to enter the chamber 600 and move piston 220 to the latched position. Passageway 1103 may actually be multiple passageways in multiple radial slices of latch assembly 300, as illustrated in FIGS. 11A, 11D, 11E, 11F, and 11H, allowing fluid communication between passageway 1101 and chamber 600 in various rotational orientations of latch assembly 300 relative to housing section 310. In some embodiments, corresponding channels (not labeled) in the housing section 310 can be used to provide fluid communication between the multiple passageways 1103.

Also shown in FIG. 11A, passageway 1104 is formed in outer housing element 640, which communicates with a channel 1102 formed on a surface of piston 220 when piston 220 is in the latched position. Although, as shown in FIG. 11A, the passageway 1104 does not directly communicate with a hydraulic line input or return passageway in the housing section 310, a plurality of passageways 1104 in the various slices of FIGS. 11A-11H are in fluid communication with each other via the channel 1102 when the piston 220 is in the latched position.

Another plurality of passageways 1105 formed in outer housing element 640 provides fluid communication to chamber 600 between piston 220 and piston 222. Fluid pressure in chamber 600 through passageway 1105 urges piston 220 into the unlatched position, and moves piston 222 away from piston 220. Yet another plurality of passageways 1107 formed in outer housing element 640 provides fluid communication to chamber 600 such that fluid pressure urges piston 222 towards piston 220, and can, once piston 222 contacts piston 220, cause piston 220 to move into the unlatched position as an auxiliary or backup way of unlatching the latch assembly 300 from the rotating control device 100, should fluid pressure via passageway 1105 fail to move piston 220. Although as illustrated in FIG. 11A, pistons 220 and 222 are in contact with each other when piston 220 is in the latched position, pistons 220 and 222 can be separated by a gap between them when the piston 220 is in the latched position, depending on the size and shape of the pistons 220 and 222 and the chamber 600.

In addition, a passageway 1100 is formed in outer housing element 640. This passageway forms a portion of passageway 1112 described below with respect to FIG. 11C.

Figure 11B:
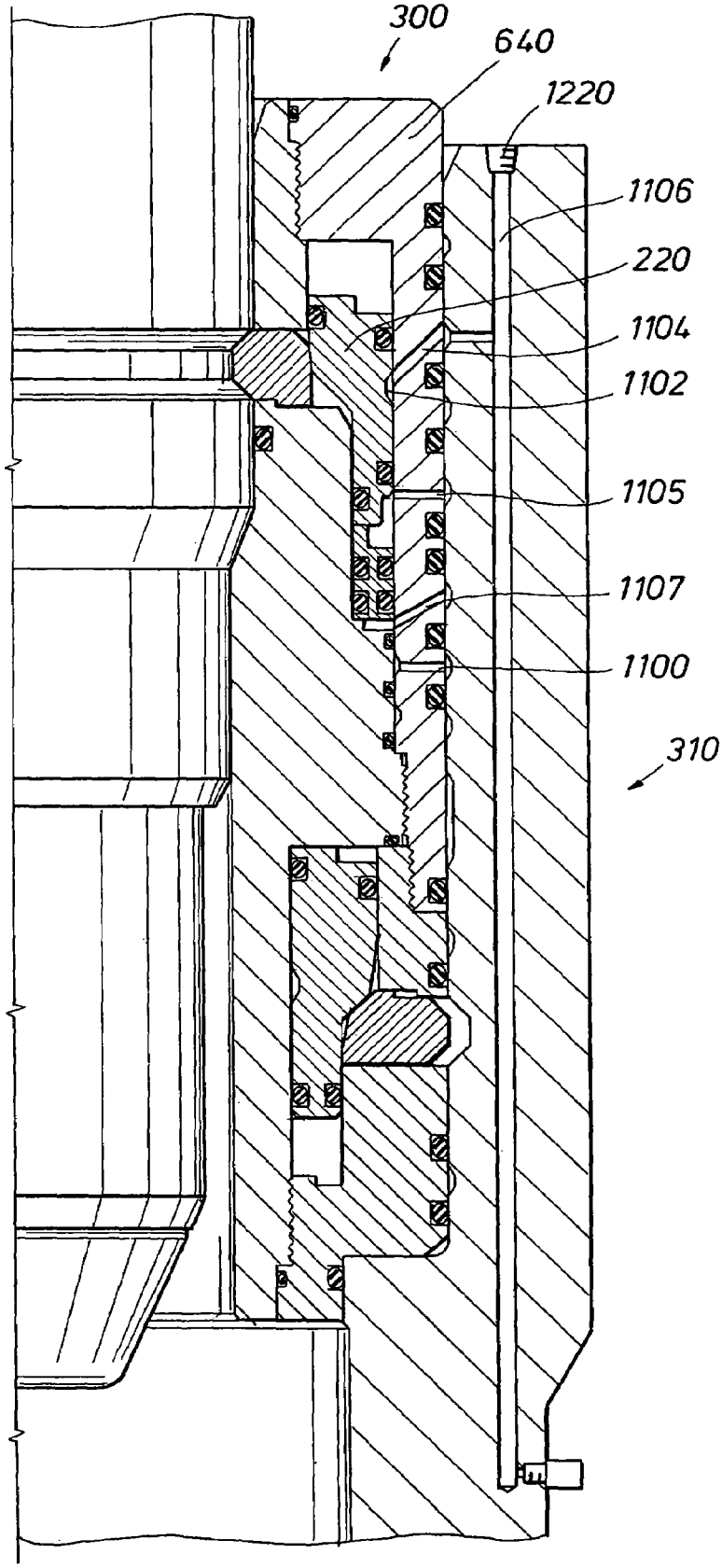
Figure 11C:
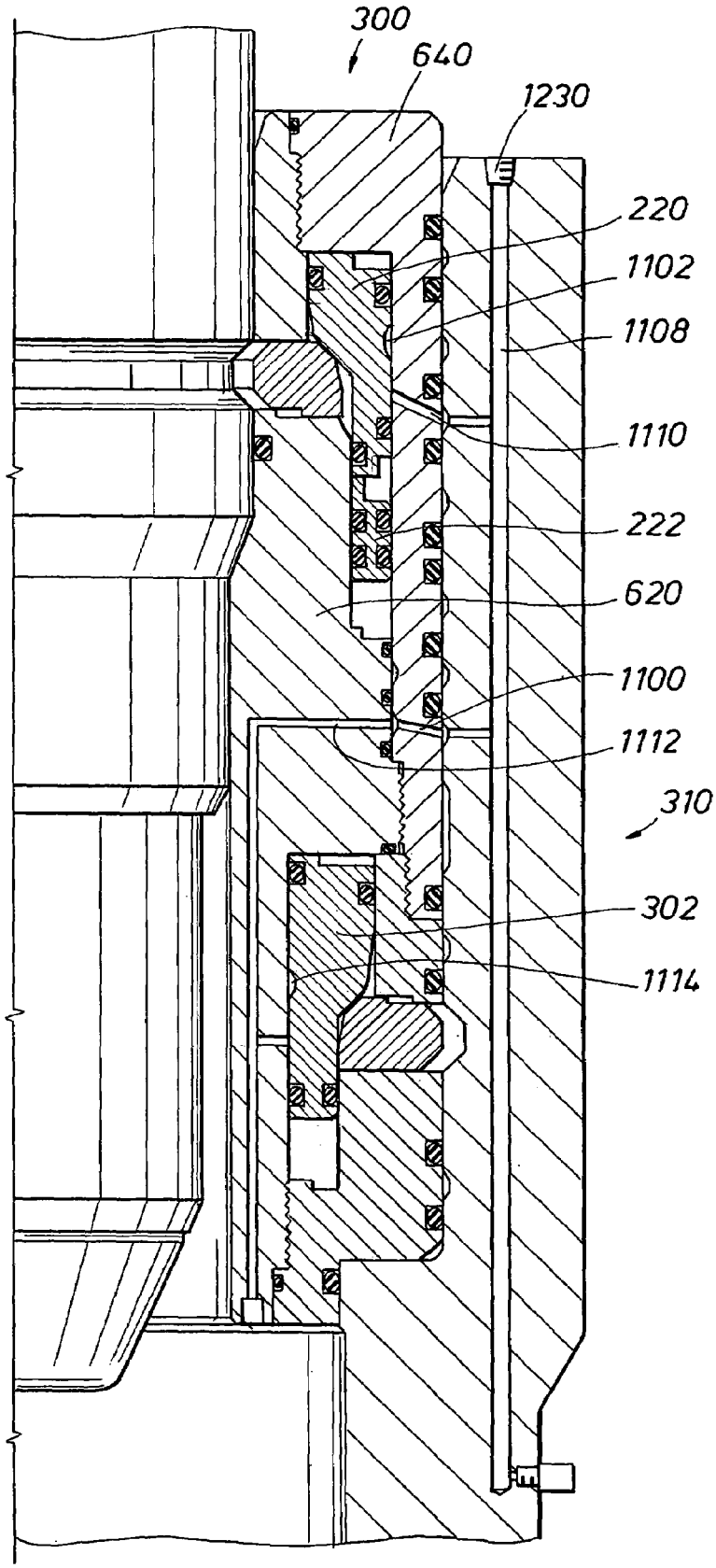

Turning now to FIG. 11B, piston 220 is shown in the latched position, as in FIG. 11A, causing the passageway 1104 to be in fluid communication with the channel 1102 in piston 220. As illustrated in FIG. 11B, passageway 1104 is further in fluid communication with passageway 1106 formed in housing section 310, which can be connected with a hydraulic line for supply or return of fluid to the latch assembly 300. If passageway 1106 is connected to a supply line, then hydraulic fluid input through passageway 1106 traverses passageway 1104 and channel 1102, then returns via passageways 1108 and 1110 to a return hydraulic line, as shown in FIG. 11C. If passageway 1106 is connected to a return line, then hydraulic fluid input through passageways 1108 and 1110 traverses the channel 1102 to return via passageways 1104 and 1106 to the return line. Because fluid communication between passageways 1106 and 1108 is interrupted when piston 220 moves to the unlatched position, as shown in FIG. 11C, pressure in the line (supply or return) connected to passageway 1106 can indicate the position of piston 220. For example, if passageway 1106 is connected to a supply hydraulic line, a measured pressure value in the supply line above a predetermined pressure value will indicate that the piston 220 is in the unlatched position. Alternately, if passageway 1106 is connected to a return hydraulic line, a measured pressure value in the return line below a predetermined pressure value will indicate that the piston 220 is in the unlatched position.

FIG. 11C illustrates a passageway 1108 in housing section 310 that is in fluid communication with passageway 1110 in outer housing element 640 of the latch assembly 300. As described above, when piston 220 is in the latched position, passageways 1108 and 1106 are in fluid communication with each other, via passageways 1104 and 1110, together with channel 1102 and are not in fluid communication when piston 220 is in the unlatched position. In addition, passageway 1108 is in fluid communication with passageway 1112. Turning to both FIG. 11C and FIG. 11F, when piston 302 is in the latched position, as shown in FIG. 11F, passageway 1112 is in fluid communication with passageways 1116 and 1118 via channel 1114 formed in piston 302. Thus, when piston 302 is in the latched position, hydraulic fluid supplied by a hydraulic supply line connected to one of passageways 1108 and 1118 flows through the housing section 310 and latch assembly 300 to a hydraulic return line connected to the other of passageways 1108 and 1118. As with the passageways for indicating the position of piston 220, such fluid communication between passageways 1108 and 1118 can indicate that piston 302 is in the latched position, and lack of fluid communication between passageways 1108 and 1118 can indicate that piston 302 is in the unlatched position. For example, if passageway 1108 is connected to a hydraulic supply line, then if the measured pressure value in the supply line exceeds a predetermined pressure value, piston 302 is in the unlatched position, and if the measured pressure value in the supply line is below a predetermined pressure value, piston 302 is in the unlatched position. Alternately, if passageway 1108 is connected to a hydraulic return line, if the measured pressure value in the return line is equal to or above a predetermined pressure value, then piston 302 is in the latched position, and if the pressure in the return line is equal to or less than a predetermined pressure value, then piston 302 is in the unlatched position.

Figure 11D:
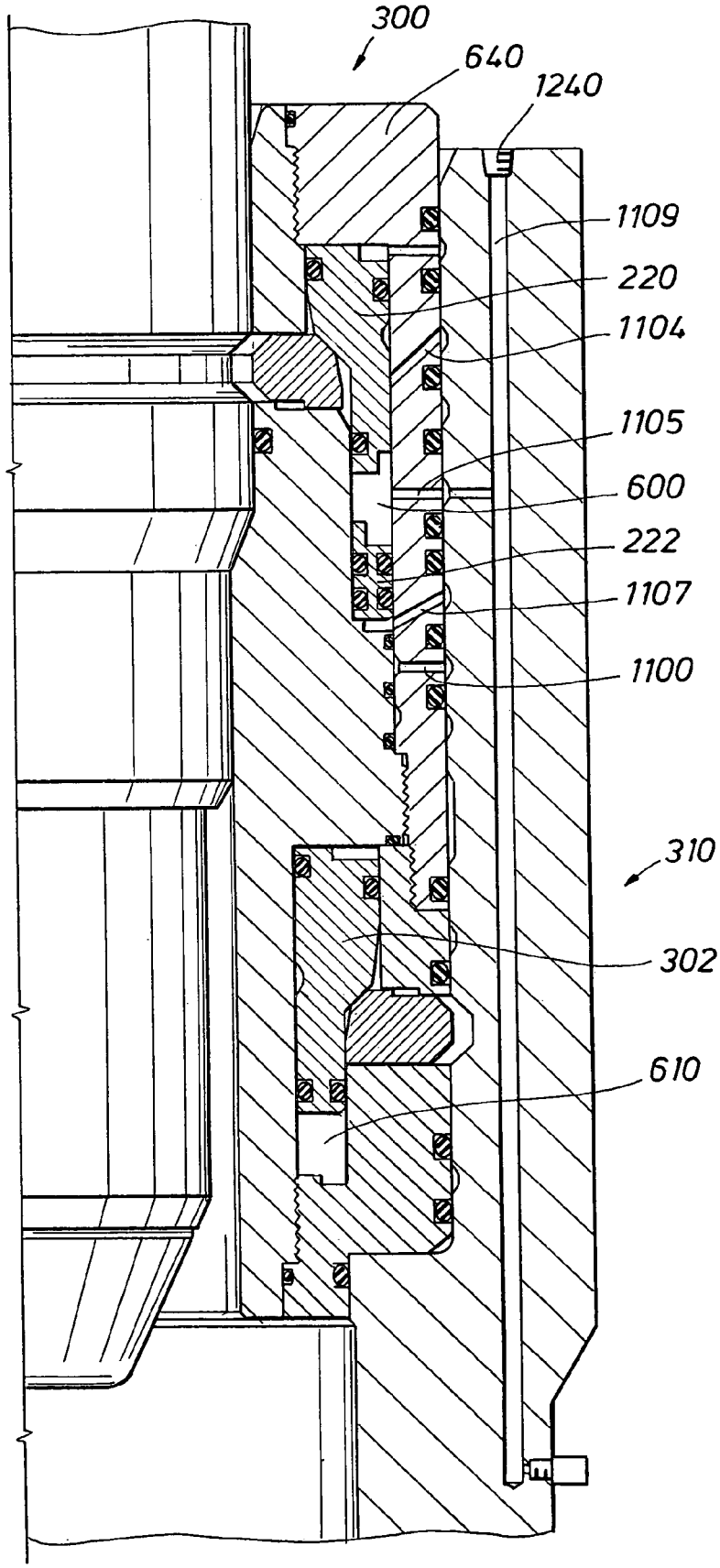
Figure 11E:
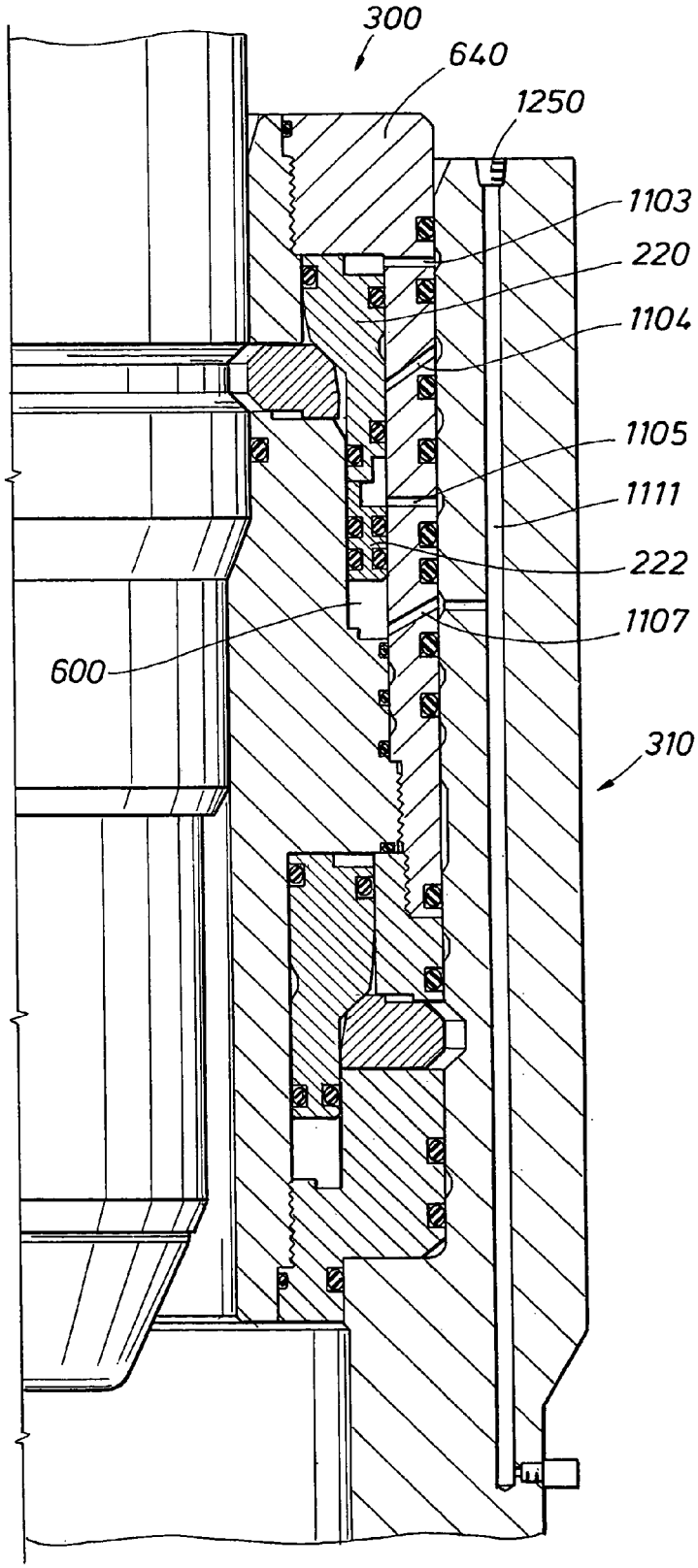
Figure 11F:
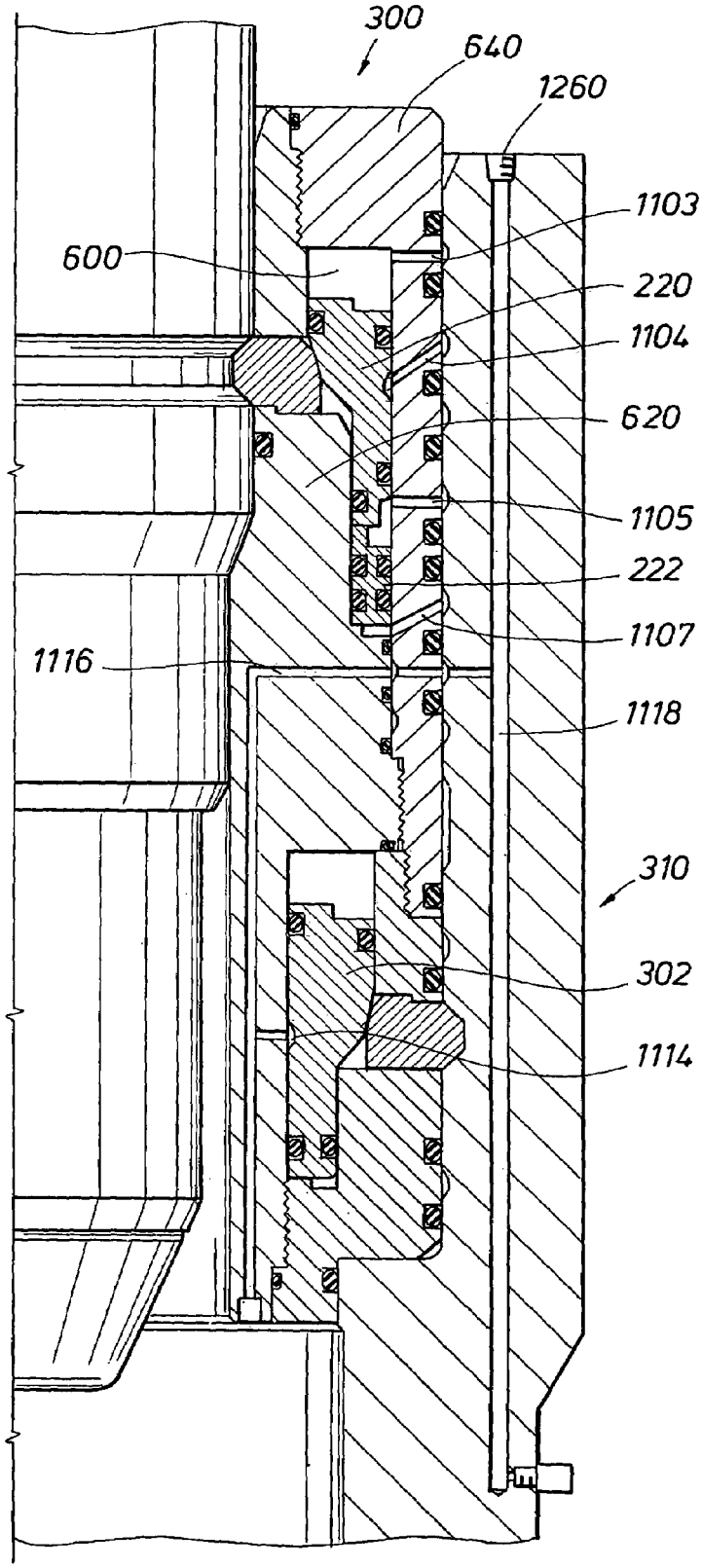
Figure 11G:
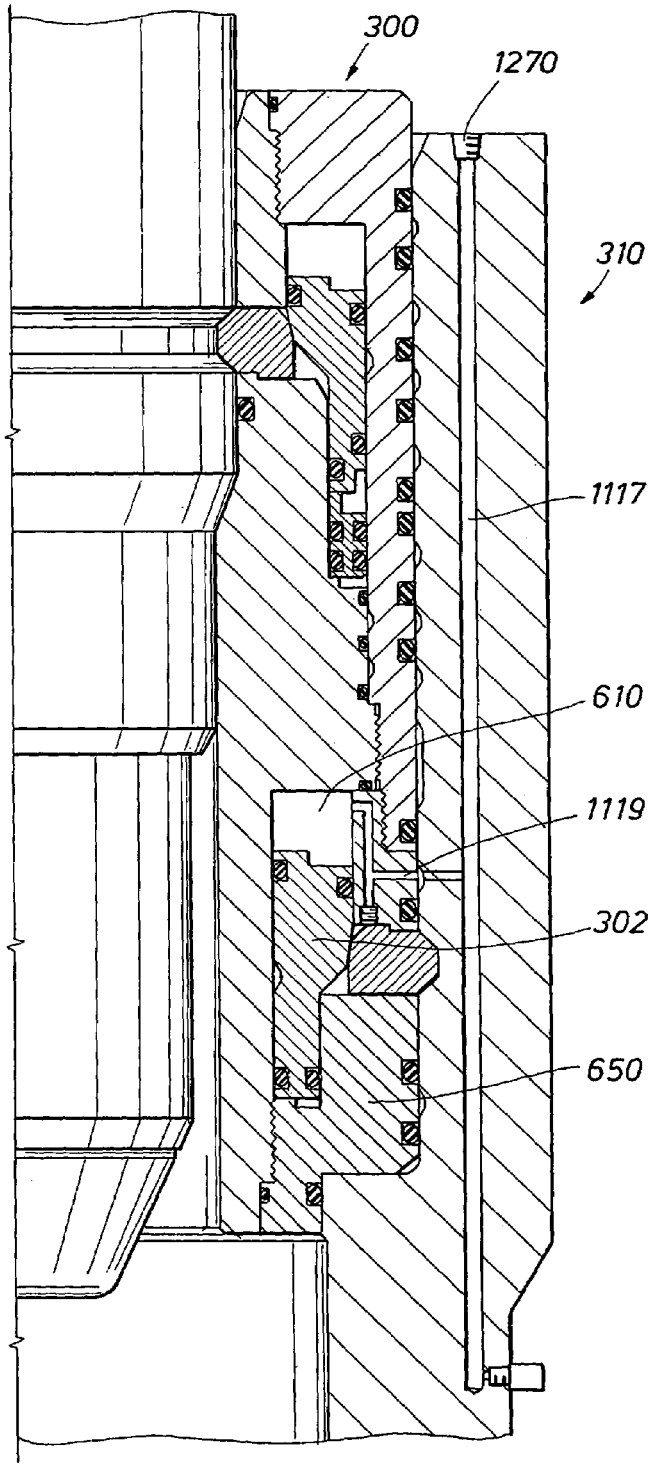

Turning now to FIG. 11D, passageway 1109 in the housing section 310 can provide hydraulic fluid through passageway 1105 in the latch assembly 300 to chamber 600, urging piston 220 from the latched position to the unlatched position, as well as to move piston 222 away from piston 220. Similarly, in FIG. 11E, passageway 1111 in the housing section 310 can provide hydraulic fluid through passageway 1107 in the latch assembly 300, urging piston 222, providing a backup technique for moving piston 220 from the latched position into the unlatched position, once piston 222 contacts piston 220. Likewise, as illustrated in FIG. 11G, hydraulic fluid in passageway 1117 in the housing section 310 traverses passageway 1119 to enter chamber 610, moving piston 302 from the unlatched position to the latched position, while hydraulic fluid in passageway 1121 in the housing section 310, illustrated in FIG. 11H, traverses passageway 1123 to enter chamber 610, moving piston 302 from the latched position to the unlatched position.

Although described above in each case as entering chamber 600 or 610 from the corresponding passageways, one skilled in the art will recognize that fluid can also exit from the chambers when the piston is moved, depending on the direction of the move. For example, viewing FIG. 11A and FIG. 11D, pumping fluid through passageways 1101 and 1103 into chamber 600 can cause fluid to exit chamber 600 via passageways 1105 and 1109, while pumping fluid through passageways 1109 and 1105 into chamber 600 can cause fluid to return from chamber 600 via passageways 1103 and 1101, as the piston 220 moves within chamber 600.

Figure 11H:
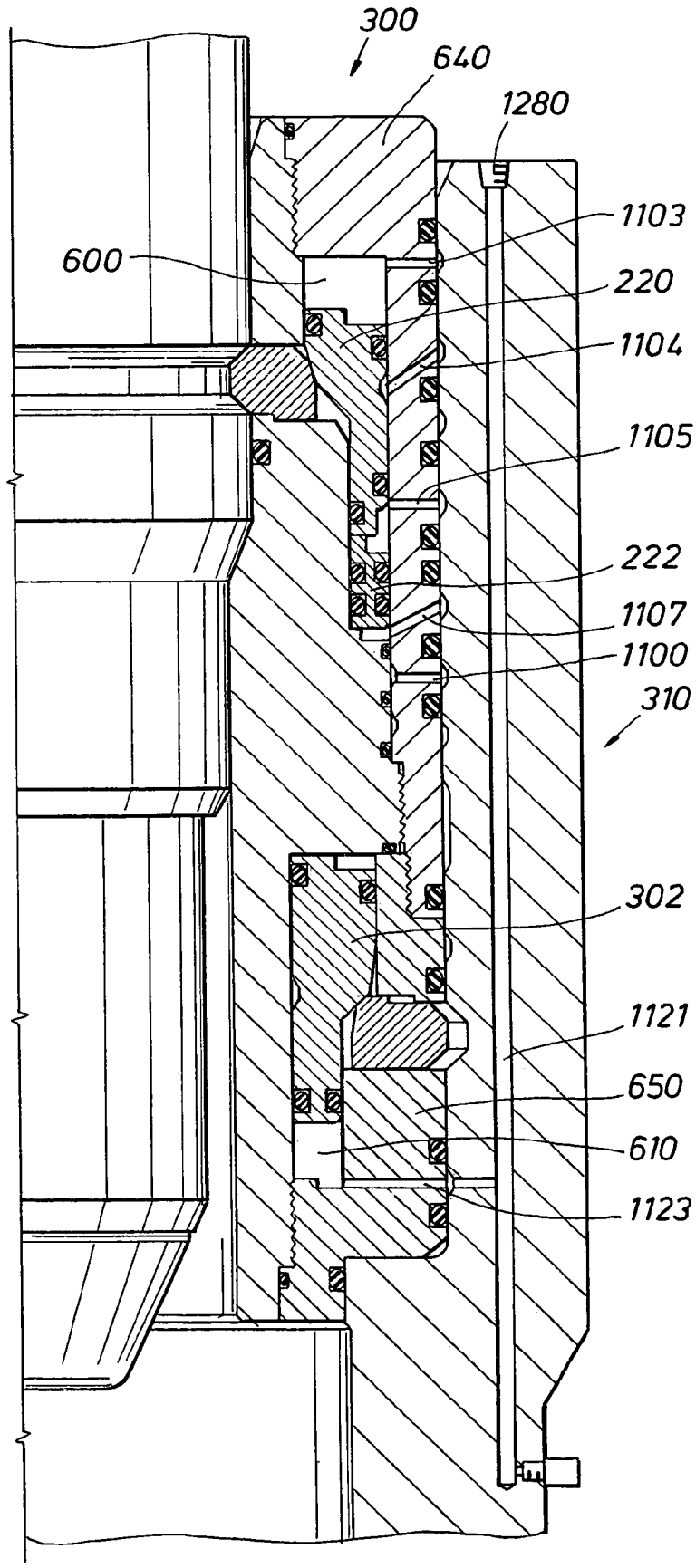
Figure 12:
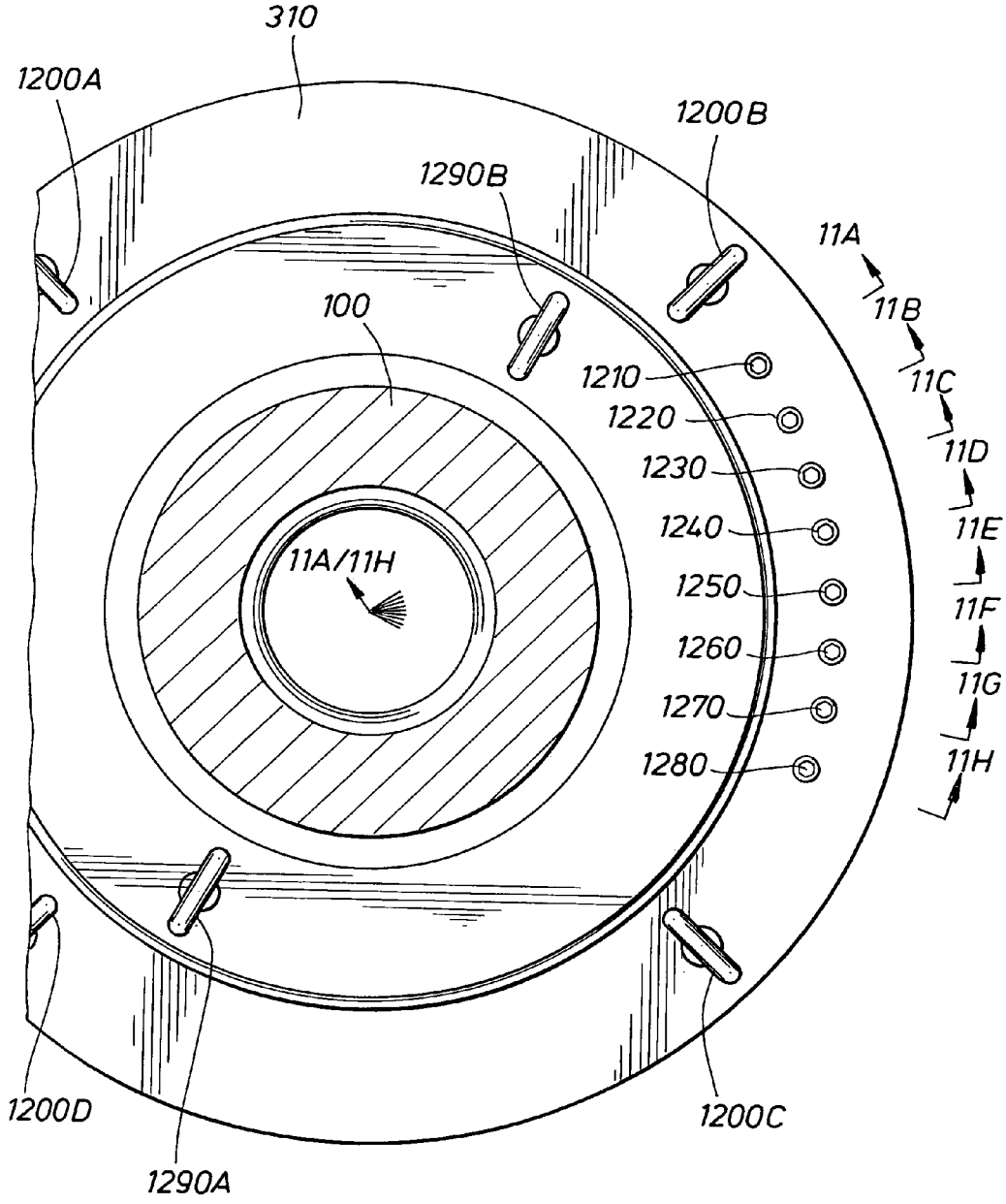
FIG. 12 is an end view of the dual hydraulic latch assembly of FIGS. 6-8 illustrating hydraulic connection ports corresponding to the cross-section views of FIGS. 11A-11H.

Turning now to FIG. 12, port 1210 is connected to passageway 1101, port 1220 is connected to passageway 1106, port 1230 is connected to passageway 1108, port 1240 is connected to passageway 1109, port 1250 is connected to passageway 1111, port 1260 is connected to passageway 1118, port 1270 is connected to passageway 1117, and port 1280 is connected to passageway 1121. The arrangement of ports and order of the slices illustrated in FIGS. 11A-11H is exemplary and illustrative only, and other orders and arrangements of ports can be used. In addition, the placement of ports 1210 to 1280 illustrated in end view in FIG. 12 is exemplary only, and other locations for the ports 1210 to 1280 can be used, such as discussed above on the side of the housing section 310, as desired.

In addition to the ports 1210 to 1280, FIG. 12 illustrates eyelets that can be used to connect cables or other equipment to the housing section 310 and latch assembly 300 for positioning the housing section 310 and latch assembly 300. Because the housing section 310 and latch assembly 300 can be latched and unlatched from each other and to the rotating control device 100 remotely using hydraulic line connected to ports 1210, 1240, 1250, 1270, and 1280, the housing section 310, the latch assembly 300 and the rotating control device 100 can be latched to or unlatched from each other and repositioned as desired without sending personnel below the rotary table 130. Likewise, because ports 1220, 1230, and 1260 can provide supply and return lines to a remote latch position indicator system, an operator of the rig does not need to send personnel below the rotary table 130 to determine the position of the latch assembly 300, but can do so remotely.

Figure 13:
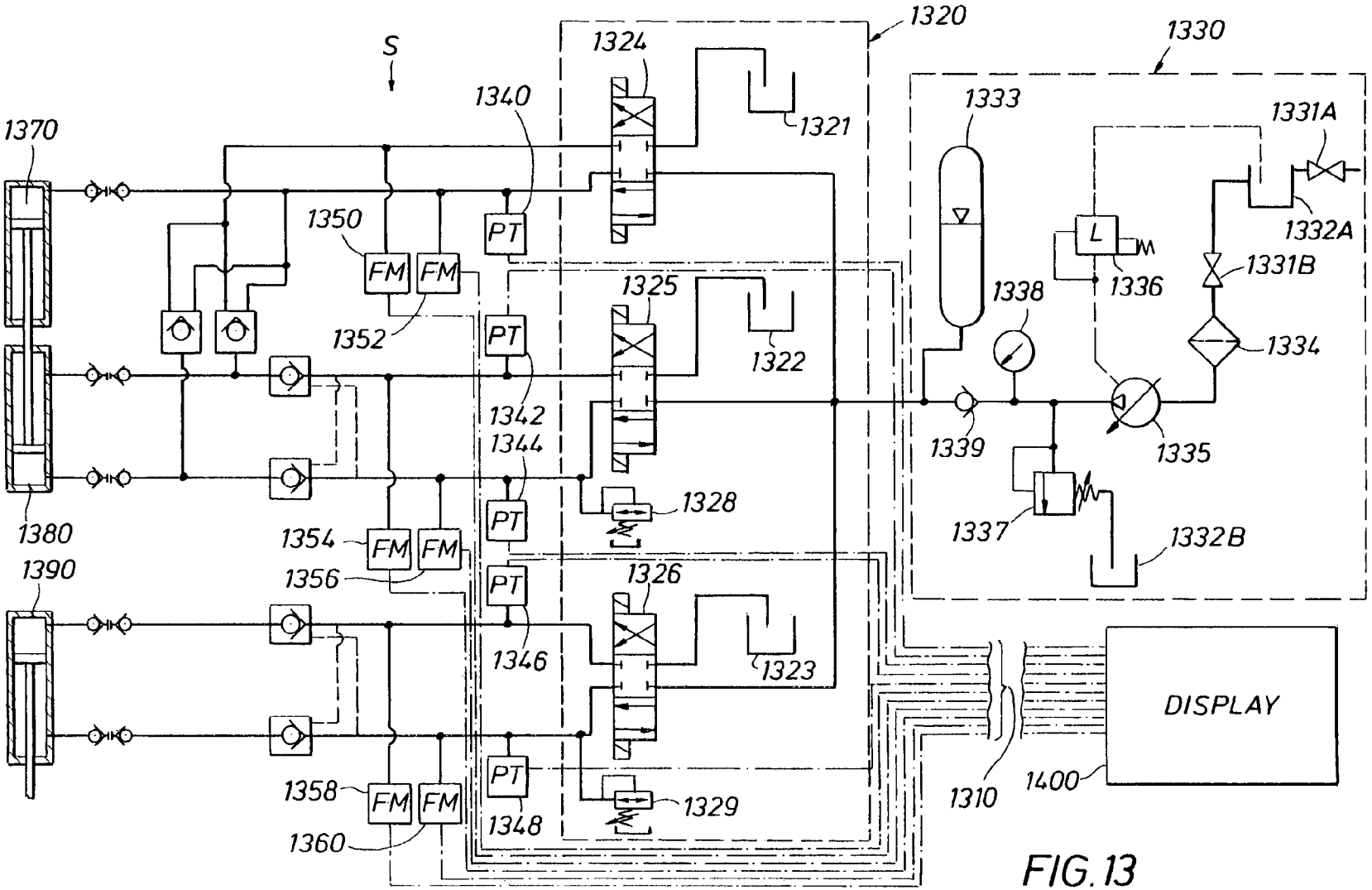
FIG. 13 is a schematic view of a latch position indicator system for the dual hydraulic latch assembly of FIGS. 6-8.

Turning now to FIG. 13, a schematic diagram for an alternate embodiment of a system S for controlling the latch assembly 300 of FIGS. 6 to 8, including a latch position indicator system for remotely indicating the position of the latch assembly 300. The elements of FIG. 13 represent functional characteristics of the system S rather than actual physical implementation, as is conventional with such schematics.

Figure 14:
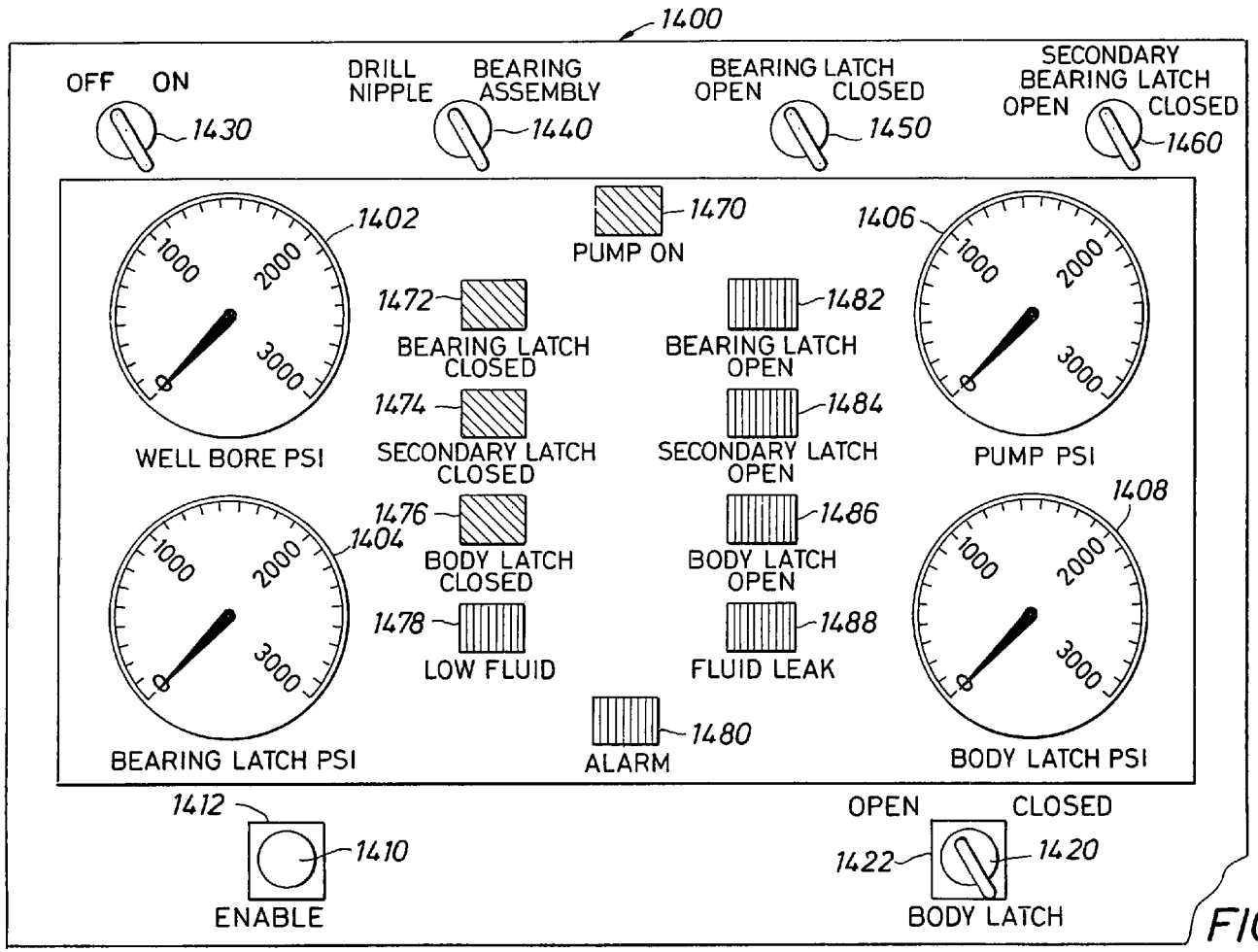
FIG. 14 is a front view of an indicator panel for use with the latch position indicator system of FIG. 13.

Block 1400 represents a remote control display for the latch position indicator subsystem of the system S, and is further described in one embodiment in FIG. 14. Control lines 1310 connect pressure transducers (PT) 1340, 1342, 1344, 1346, and 1348 and flow meters (FM) 1350, 1352, 1354, 1356, 1358, and 1360. The flow meters FM can be totalizing flow meters. Typically, a programmable logic controller (PLC) or other similar measurement and control device, either at each pressure transducer PT and flow meter FM or remotely in the block 1400 reads an electrical output from the pressure transducer PT or flow meter FM and converts the output into a signal for use by the remote control display 1400, possibly by comparing a flow value or pressure value measured by the flow meter FM or pressure transducer PT to a predetermined flow value or pressure value, controlling the state of an indicator in the display 1400 according to a relative relationship between the measured value and the predetermined value. For example, if the measured flow value is less than a predetermined value, the display 1400 may indicate one state of the flow meter FM or corresponding device, and if the measured flow value is greater than a predetermined value, the display 1400 may indicate another state of the flow meter FM or corresponding device.

A fluid supply subsystem 1330 provides a controlled hydraulic fluid pressure to a fluid valve subsystem 1320. As illustrated in FIG. 13, the fluid supply subsystem 1330 includes shutoff valves 1331A and 1331B, reservoirs 1332A and 1332B, an accumulator 1333, a fluid filter 1334, a pump 1335, pressure relief valves 1336 and 1337, a gauge 1338, and a check valve 1339, connected as illustrated. However, the fluid supply subsystem 1330 illustrated in FIG. 13 can be any convenient fluid supply subsystem for supplying hydraulic fluid at a controlled pressure.

A fluid valve subsystem 1320 controls the provision of fluid to hydraulic fluid lines (unnumbered) that connect to the chambers 1370, 1380 and 1390. FIG. 13 illustrates the subsystem 1320 using three directional valves 1324, 1325 and 1326, each connected to one of reservoirs 1321, 1322 and 1323. Each of the valves 1324, 1325, and 1326 are illustrated as three-position, four-way electrically actuated hydraulic valves. Valves 1325 and 1326, respectively, can be connected to pressure relief valves 1328 and 1329. The elements of the fluid valve subsystem 1320 as illustrated in FIG. 13 are exemplary and illustrative only, and other components, and numbers, arrangements, and connections of components can be used as desired.

Turning now to FIG. 14, an exemplary indicator panel is illustrated for remote control display 1400 for the system S of FIG. 13. In the following, the term "switch" will be used to indicate any type of control that can be activated or deactivated, without limitation to specific types of controls. Exemplary switches are toggle switches and push buttons, but other types of switches can be used. Pressure gauges 1402, 1404, 1406, and 1408 connected by control lines 1310 to the pressure transducers, such as the pressure transducers PT of FIG. 13, indicate the pressure in various parts of the system S. Indicators on the panel include wellbore pressure gauge 1402, bearing latch pressure gauge 1404, pump pressure gauge 1406, and body latch pressure gauge 1408. The rotating control device or bearing latch pressure 1404 indicates the pressure in the chamber 600 at the end of the chamber where fluid is introduced to move the piston 220 into the latched position. The housing section or body latch pressure gauge 1408 indicates the pressure in the chamber 610 at the end of the chamber where fluid is introduced to move the piston 302 into the latched position. A switch or other control 1420 can be provided to cause the system S to manipulate the fluid valve subsystem 1320 to move the piston 302 between the latched (closed) and unlatched (open) positions. For safety reasons, the body latch control 1420 is preferably protected with a switch cover 1422 or other apparatus for preventing accidental manipulation of the control 1420. For safety reasons, in some embodiments, an enable switch 1410 can be similarly protected by a switch cover 1412. The enable switch 1410 must be simultaneously or closely in time engaged with any other switch, except the Off/On control 1430 to enable the other switch. In one embodiment, engaging the enable switch allows activation of other switches within 10 seconds of engaging the enable switch. This technique helps prevent accidental unlatching or other dangerous actions that might otherwise be caused by accidental engagement of the other switch.

An Off/On control 1430 controls the operation the pump 1335. A Drill Nipple/Bearing Assembly control 1440 controls a pressure value produced by the pump 1335. The pressure value can be reduced if a drilling nipple or other thin walled apparatus is installed. For example, when the control 1440 is in the "Drill Nipple" position, the pump 1335 can pressurize the fluid to 200 PSI, but when the control is in the "Bearing Assembly" position, the pump 1335 can pressurize the fluid to 1000 PSI. Additionally, an "Off" position can be provided to set the pump pressure to 0 PSI. Other fluid pressure values can be used. For example, in one embodiment, the "Bearing Assembly" position can cause pressurization depending on the position of the Bearing Latch switch 1450, such as 800 PSI if switch 1450 is closed and 2000 PSI if switch 1450 is open.

Control 1450 controls the position of the piston 220, latching the rotating control device 100 to the latch assembly 300 in the "closed" position by moving the piston 220 to the latched position. Likewise, the control 1460 controls the position of the auxiliary or secondary piston 222, causing the piston 222 to move to urge the piston 220 to the unlatched position when the bearing latch control 1460 is in the "open" position. Indicators 1470, 1472, 1474, 1476, 1478, 1480, 1482, 1484, 1486, and 1488 provide indicators of the state of the latch assembly and other useful indicators. As illustrated in FIG. 14, the indicators are single color lamps, which illuminate to indicate the specific condition. In one embodiment, indicators 1472, 1474, 1476, and 1478 are green lamps, while indicators 1470, 1480, 1482, 1484, 1486, and 1488 are red lamps; however, other colors can be used as desired. Other types of indicators can be used as desired, including multicolor indicators that combine the separate open/closed indicators illustrated in FIG. 14. Such illuminated indicators are known to the art. Indicator 1470 indicates whether the hydraulic pump 1335 of FIG. 13 is operating. Specifically, indicators 1472 and 1482 indicate whether the bearing latch is closed or open, respectively, corresponding to the piston 220 being in the latched or unlatched position, indicating the rotating control device 100 is latched to the latch assembly 300. Indicators 1474 and 1484 indicate whether the auxiliary or secondary latch is closed or open, respectively, corresponding to the piston 222 being in the first or second position. Indicators 1476 and 1486 indicate whether the body latch is closed or open, respectively, i.e., whether the latch assembly 300 is latched to the housing section 310, corresponding to whether the piston 302 is in the unlatched or latched positions. Additionally, hydraulic fluid indicators 1478 and 1488 indicate low fluid or fluid leak conditions, respectively.

An additional alarm indicator indicates various alarm conditions. Some exemplary alarm conditions include: low fluid, fluid leak, pump not working, pump being turned off while wellbore pressure is present and latch switch being moved to open when wellbore pressure is greater than a predetermined value, such as 25 PSI. In addition, a horn (not shown) can be provided for an additional audible alarm for safety purposes. The display 1400 allows remote control of the latch assembly 210 and 300, as well as remote indication of the state of the latch assembly 210 and 300, as well as other related elements.

Figure 18:
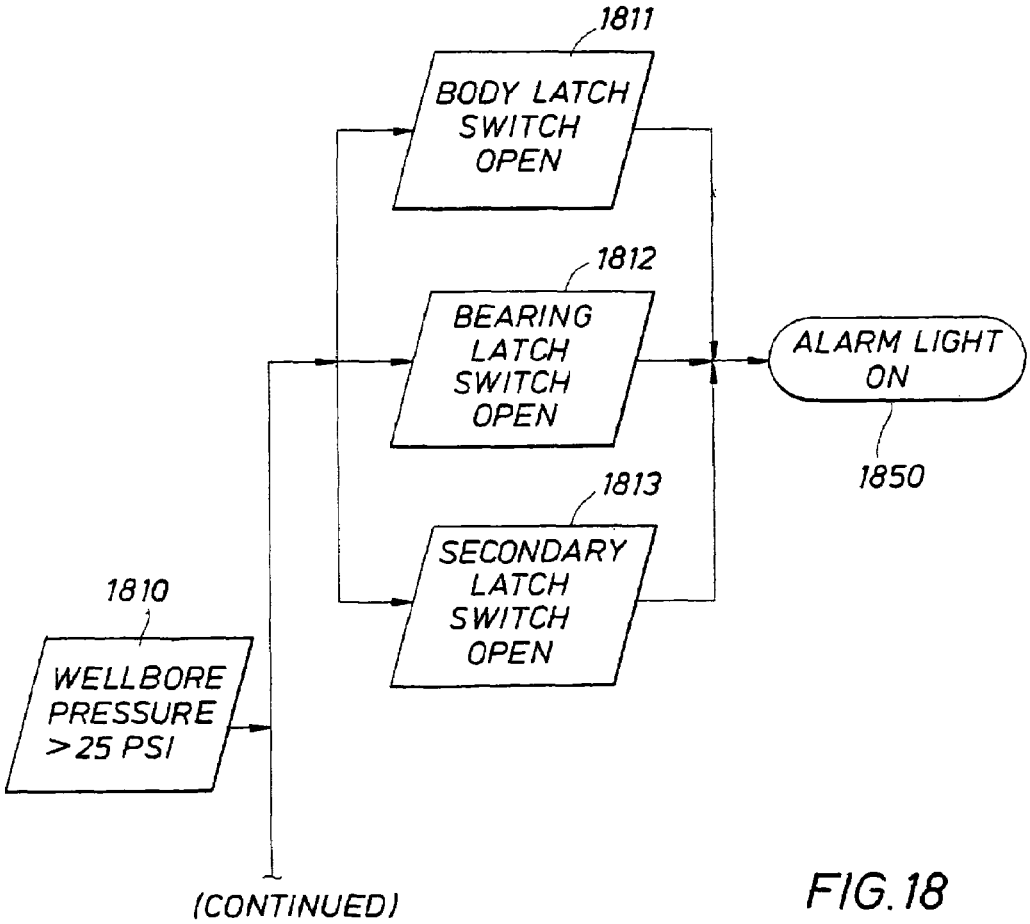
FIG. 18 is a diagram illustrating exemplary conditions for activating an alarm or a horn of the indicator panel of FIG. 14 for safety purposes.

FIG. 18 illustrates an exemplary set of conditions that can cause the alarm indicator 1480 and horn to be activated. As shown by blocks 1830 and 1840, if any of the flow meters FM of FIG. 13 indicate greater than a predetermined flow rate, illustrated in FIG. 18 as 3 GPM, then both the alarm light 1480 and the horn will be activated. As shown by blocks 1820, 1822, 1824, 1826, and 1840, if the wellbore pressure is in a predetermined relative relation to a predetermined pressure value, illustrated in FIG. 18 as greater than 100 PSI, and any of the bearing latch switch 1450, the body latch switch 1420, or the secondary latch switch 1460 are open, then both the alarm 1480 and the horn are activated. As shown by blocks 1810, 1814, 1815, 1816, and 1840, if the wellbore pressure is in a predetermined relative relationship to a predetermined pressure value, illustrated in FIG. 18 as greater than 25 PSI, and either the pump motor is not turned on by switch 1430, the fluid leak indicator 1488 is activated for a predetermined time, illustrated in FIG. 18 as greater than 1 minute, or the low fluid indicator 1478 is activated for a predetermined time, illustrated in FIG. 18 as greater than 1 minute, then both the alarm 1480 and horn are activated. Additionally, as indicated by blocks 1810, 1811, 1812, 1813, and 1850, if the wellbore pressure is in a predetermined relative relationship to a predetermined pressure value, illustrated in FIG. 18 as greater than 25 PSI, and either the body latch switch 1420 is open, the bearing latch switch 1450 is open, or the secondary latch switch 1460 is open, then the alarm indicator 1480 is activated, but the horn is not activated. The conditions that cause activation of the alarm 1480 and horn of FIG. 18 are illustrative and exemplary only, and other conditions and combinations of conditions can cause the alarm 1480 or horn to be activated.

Figure 15K:
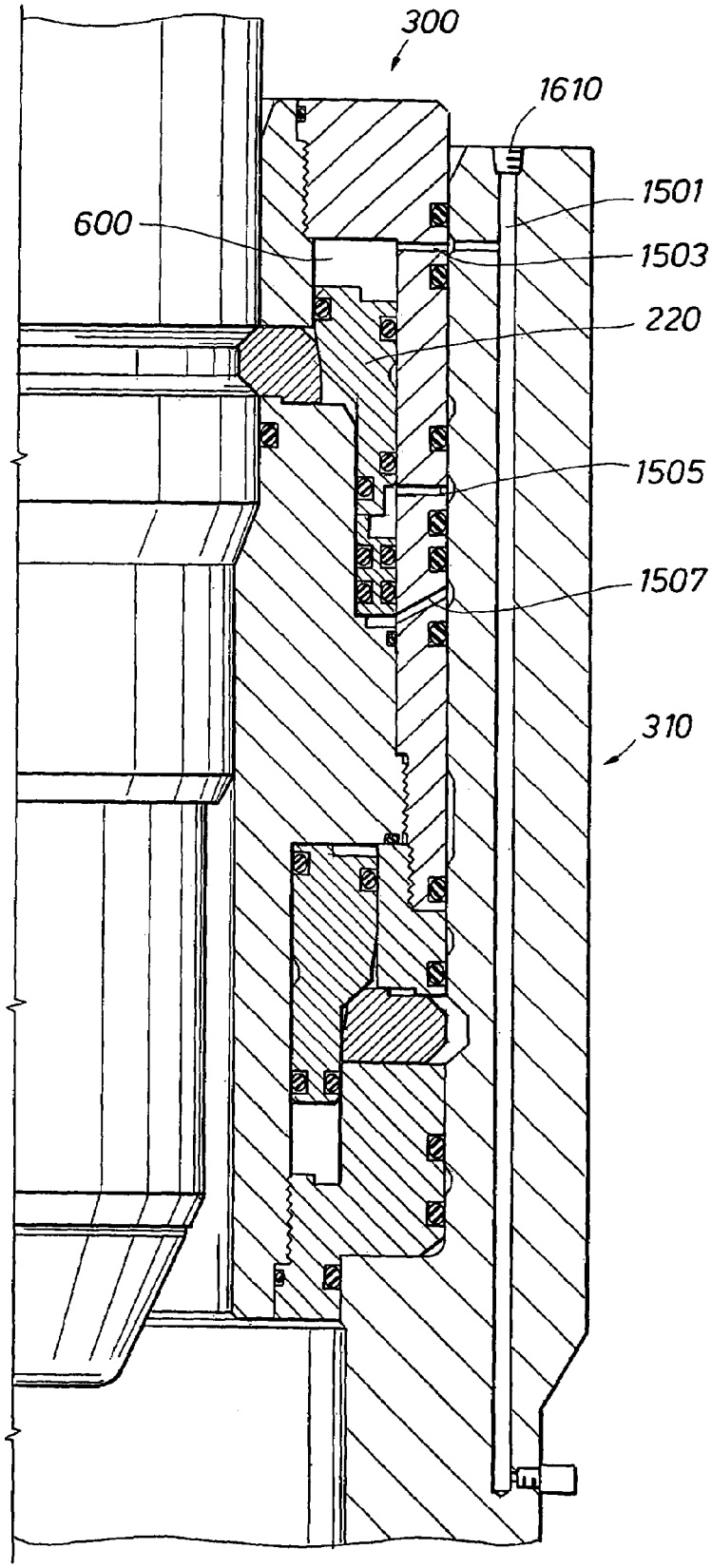
FIGS. 15K-150 are enlarged cross-section views of the dual hydraulic latch assembly of FIGS. 6-8 taken along lines 15K-15K, 15L-15L, 15M-15M, 15N-15N, and 150-150 of FIG. 16, illustrating passageways of a hydraulic fluid volume-sensing system for communicating whether the dual latch assembly is unlatched or latched.
Figure 15L:
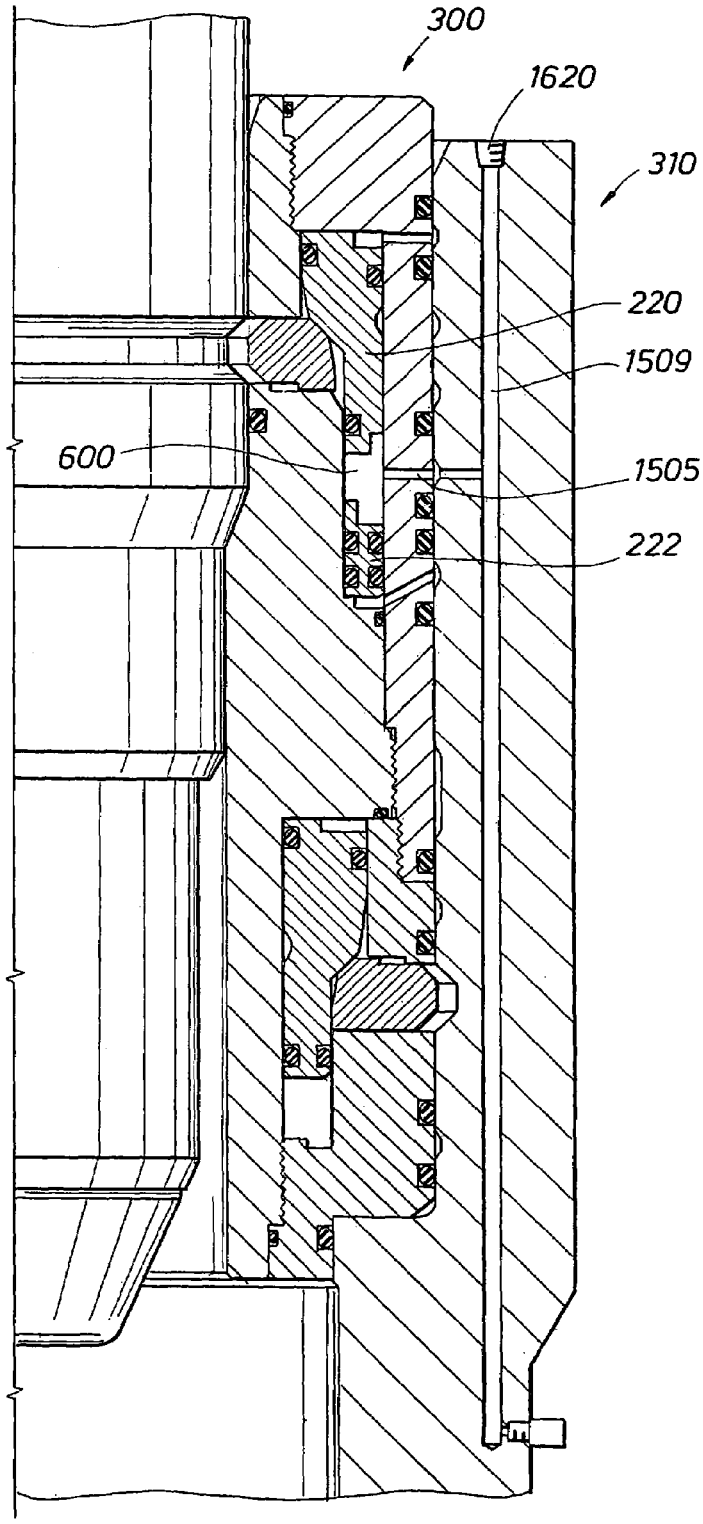
Figure 15M:
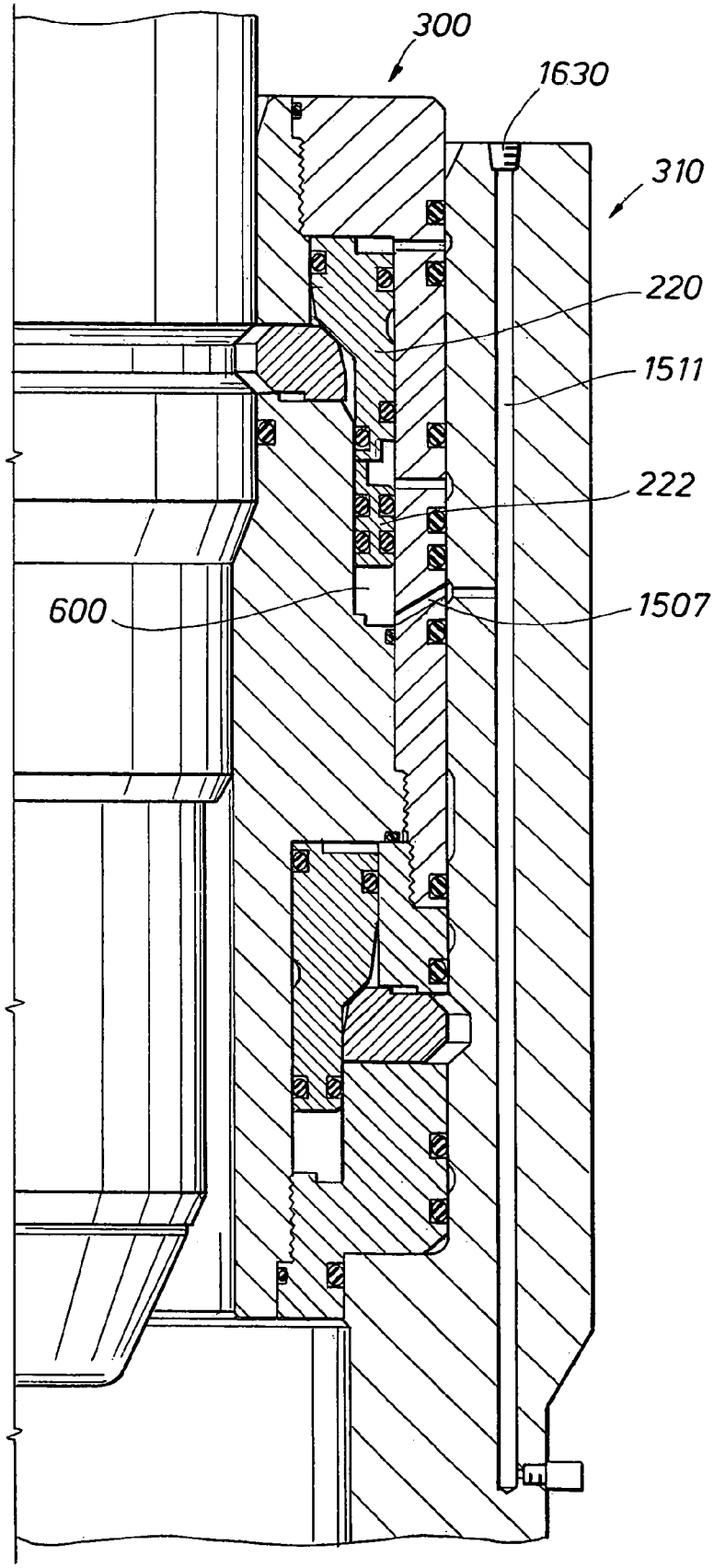
Figure 15N:
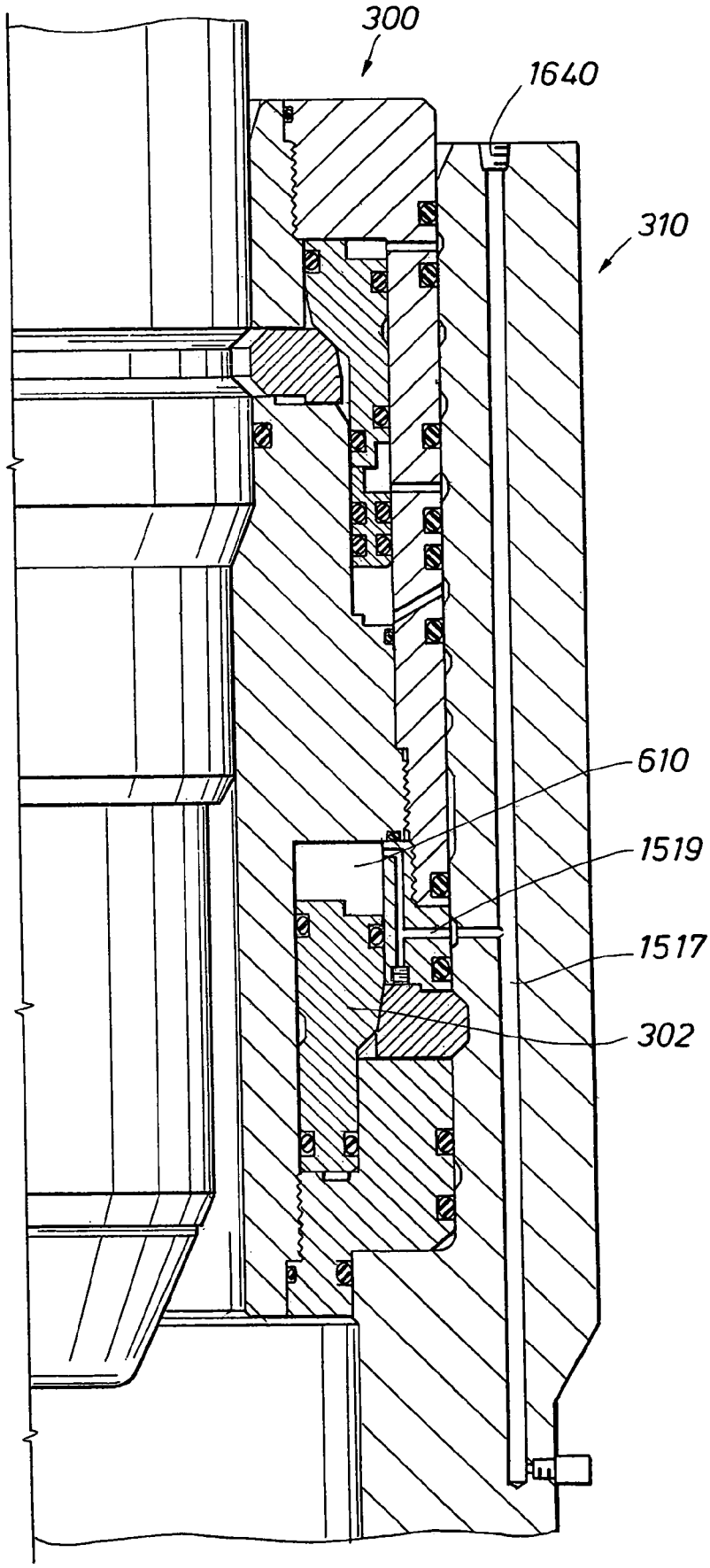
Figure 150:
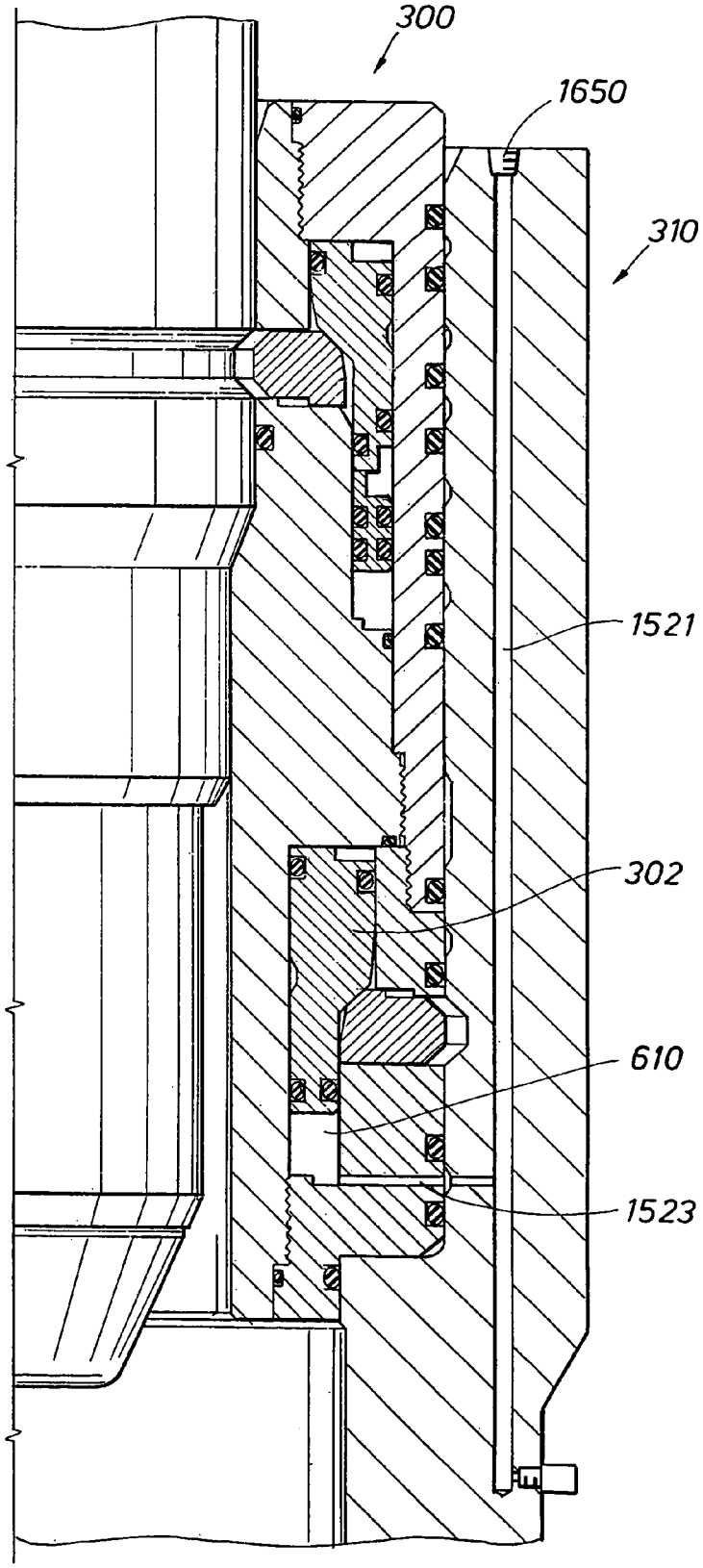
Figure 16:
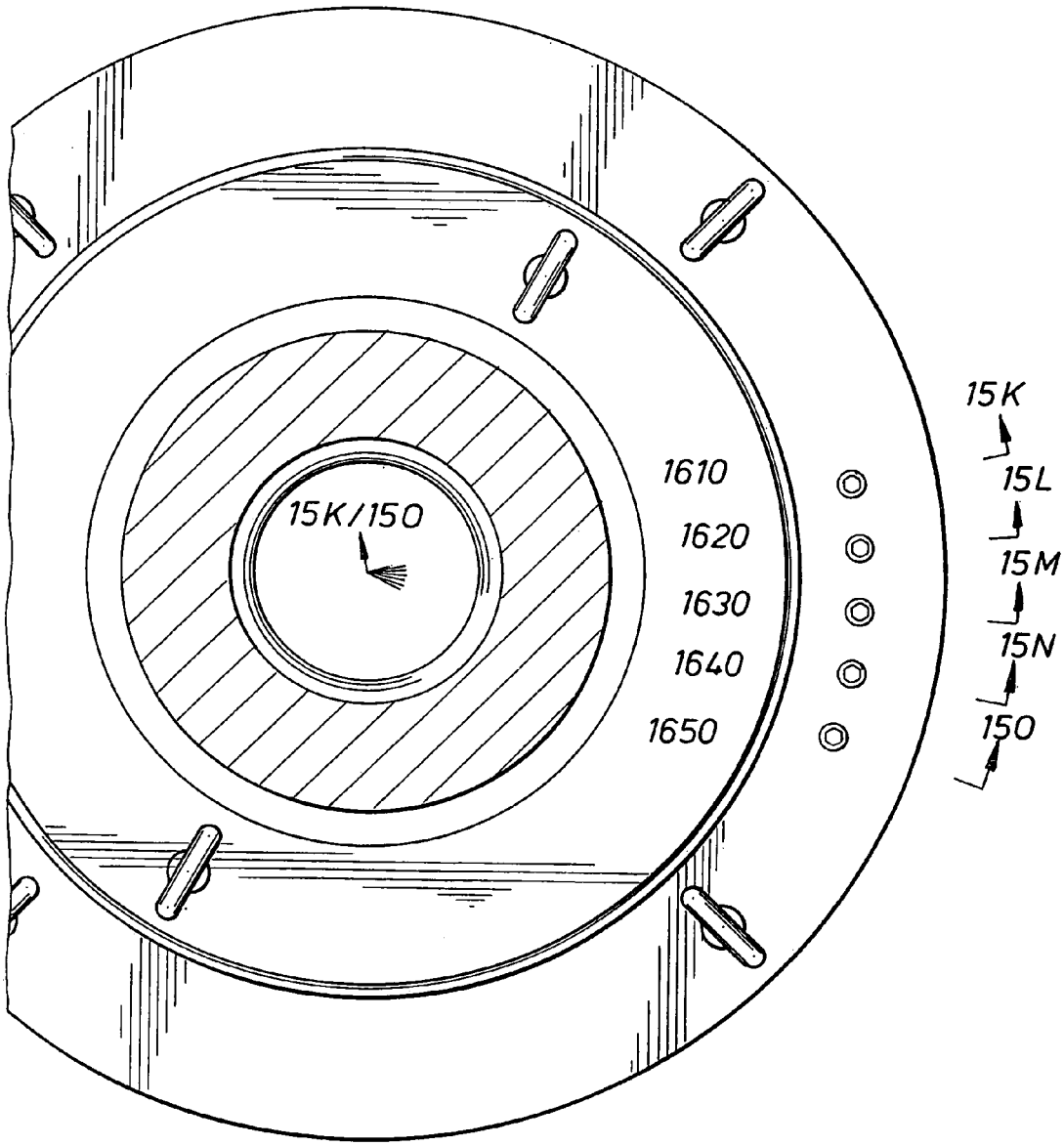
FIG. 16 is an end view of the dual hydraulic latch assembly of FIGS. 6-8 illustrating hydraulic connection ports corresponding to the cross-section views of FIGS. 15K-15O.

FIGS. 15K, 15L, 15M, 15N, 15O and 16 illustrate an embodiment in which measurement of the volume of fluid pumped into chambers 600 and 610 can be used to indicate the state of the latch assembly 300. Passageways 1501 and 1503 as shown in FIG. 15K, corresponding to passageways 1101 and 1103 as shown in FIG. 11A, allow hydraulic fluid to be pumped into chamber 600, causing piston 220 to move to the latched position. Passageways 1505 and 1509 as shown in FIG. 15L, corresponding to passageways 1105 and 1109, allow hydraulic fluid to be pumped into chamber 600, causing piston 220 to move to the unlatched position and piston 222 to move away from piston 220. Passageways 1507 and 1511 as shown in FIG. 15M, corresponding to passageways 1107 and 1111 as shown in FIG. 11E, allow hydraulic fluid to be pumped into chamber 600, causing piston 222 to urge piston 220 from the latched to the unlatched position. Passageways 1517 and 1519 as shown in FIG. 15N, corresponding to passageways 1117 and 1119 as shown in FIG. 11G, allow hydraulic fluid to be pumped into chamber 610, causing piston 302 to move to the latched position. Passageways 1521 and 1523 as shown in FIG. 150, corresponding to passageways 1121 and 1123 as shown in FIG. 11H, allow hydraulic fluid to be pumped into chamber 610, causing piston 302 to move to the unlatched position. Ports 1610, 1620, 1630, 1640, and 1650 allow connection of hydraulic lines to passageways 1501, 1509, 1511, 1517 and 1521, respectively. By measuring the flow of fluid with flow meters FM, the amount or volume of fluid pumped through passageways 1501, 1509, 1511, 1517 and 1521 can be measured and compared to a predetermined volume. Based on the relative relationship between the measured volume value and the predetermined volume value, the system S of FIG. 13 can determine and indicate on display 1400 the position of the pistons 220, 222 and 302, hence whether the latch assembly 300 is latched to the rotating control device 100 and whether the latch assembly 300 is latched to the housing section, such as housing section 310, as described above.

In one embodiment, the predetermined volume value is a range of predetermined volume values. The predetermined volume value can be experimentally determined. An exemplary range of predetermined volume values is 0.9 to 1.6 gallons of hydraulic fluid, including ½ gallon to account for air that may be in either the chamber or the hydraulic line. Other ranges of predetermined volume values are contemplated.

Figure 17:
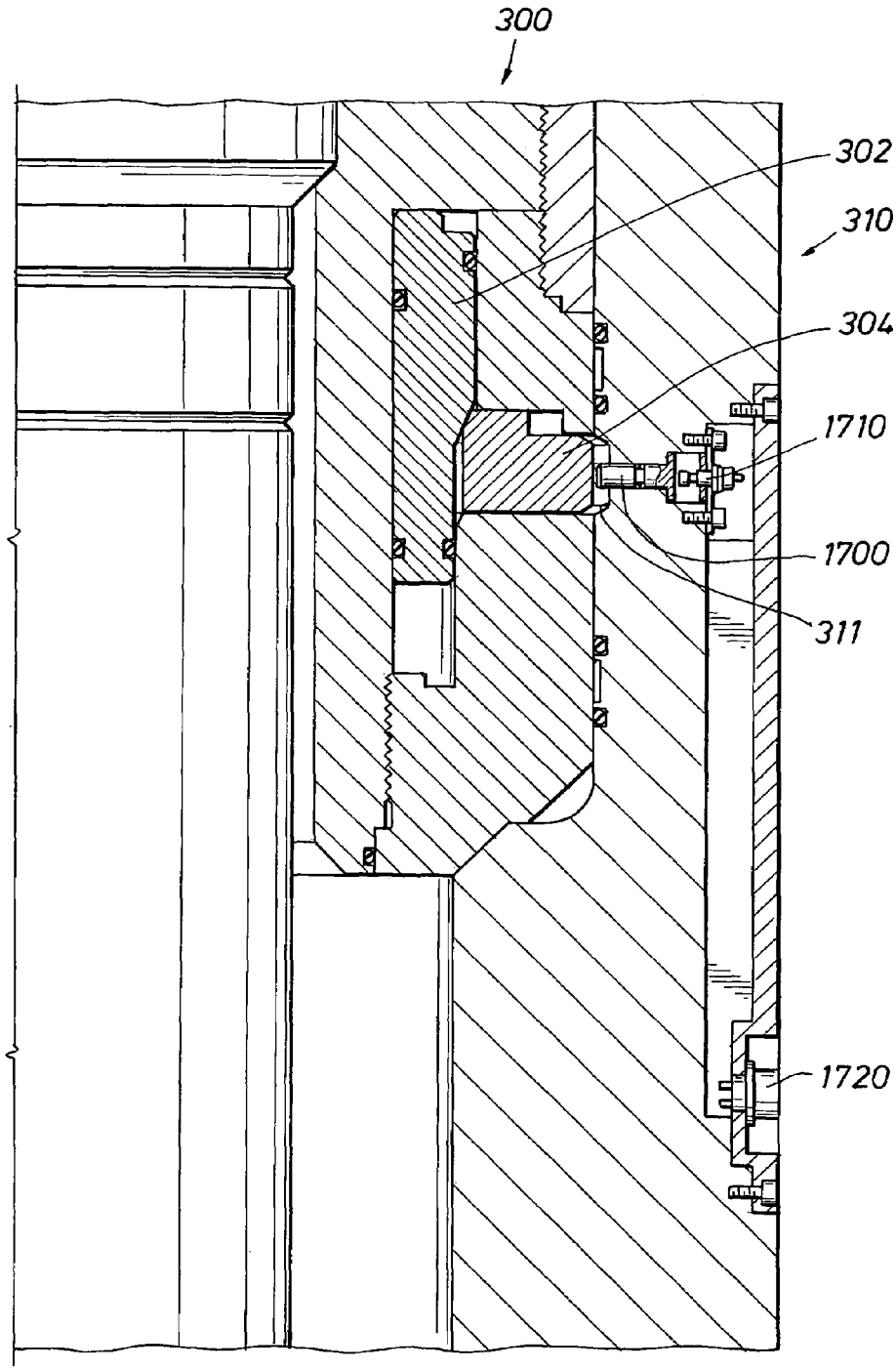
FIG. 17 is an enlarged cross-section detail view illustrating an electrical indicator system for transmitting whether the dual hydraulic latch assembly is unlatched or latched to the indicator panel of FIG. 14.
Figure 18:
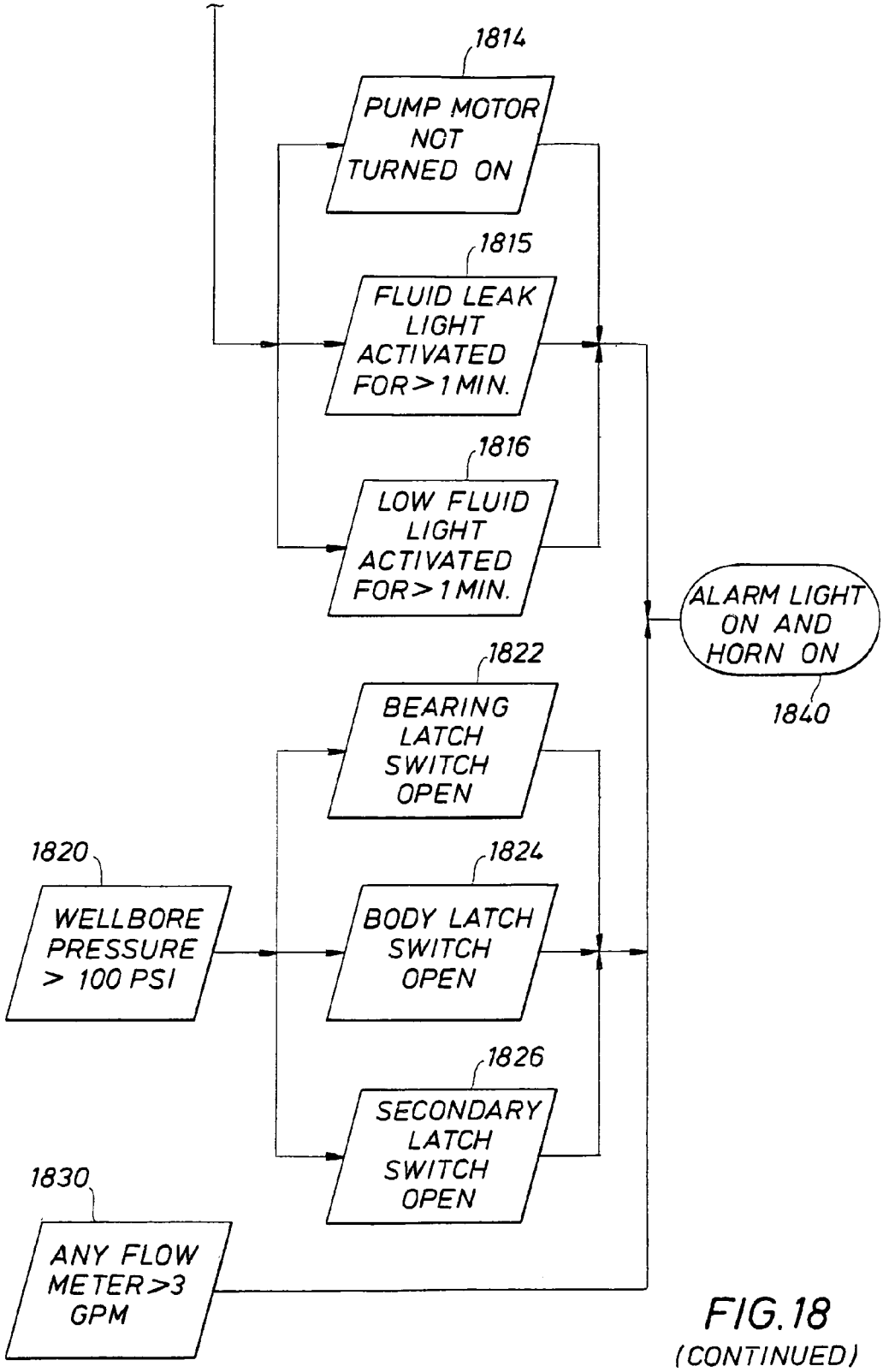

FIG. 17 illustrates an alternate embodiment that uses an electrical switch to indicate whether the latch assembly 300 is latched to the housing section 310. Movement of the retainer member 304 by the piston 302 can be sensed by a piston 1700 protruding in the latching formation 311. The piston 1700 is moved outwardly by the retainer member 304. Movement of the piston 1700 causes electrical switch 1710 to open or close, which can in turn cause an electrical signal via electrical connector 1720 to a remote indicator position system and to display 1400. Internal wiring is not shown in FIG. 17 for clarity of the drawing. Any convenient type of switch 1710 and electrical connector 1720 can be used. Preferably, piston 1700 is biased inwardly toward the latch assembly 300, either by switch 1710 or by a spring or similar apparatus, so that piston 1700 will move inwardly toward the latch assembly 300 when the retainer member 304 retracts upon unlatching the latch assembly 300 from the housing section 310.

The foregoing disclosure and description of the invention are illustrative and explanatory thereof, and various changes in the details of the illustrated apparatus and construction and the method of operation may be made without departing from the spirit of the invention.

In particular, variations in the orientation of the rotating control device 100, latch assemblies 210, 300, housing section 310, and other system components are possible. For example, the retainer members 218 and 304 can be biased radially inward or outward. The pistons 220, 222, and 302 can be a continuous annular member or a series of cylindrical pistons disposed about the latch assembly. Furthermore, while the embodiments described above have discussed rotating control devices, the apparatus and techniques disclosed herein can be used to advantage on other tools, including rotating blowout preventers.

All movements and positions, such as "above," "top," "below," "bottom," "side," "lower," and "upper" described herein are relative to positions of objects as viewed in the drawings such as the rotating control device. Further, terms such as "coupling," "engaging," "surrounding," and variations thereof are intended to encompass direct and indirect "coupling," "engaging," "surrounding," and so forth. For example, the retainer member 218 can engage directly with the rotating control device 100 or can be engaged with the rotating control device 100 indirectly through an intermediate member and still fall within the scope of the disclosure.

The foregoing disclosure and description of the invention are illustrative and explanatory thereof, and various changes in the details of the illustrated apparatus and construction and the method of operation may be made without departing from the spirit of the invention.

We claim:

1. An apparatus, comprising:

a latch assembly comprising:

a retainer member movable between an unlatched position and a latched position; and a first piston movable between a first position and a second position, the first piston causing the retainer member to move to the latched position when the first piston is in the first position and the first piston allowing the retainer member to move to the unlatched position when the first piston is in the second position, wherein the latch assembly is remotely actuatable for moving the first piston to the latched position; and a measuring device coupled to the latch assembly, said measuring device used to indicate the position of the first piston.

2. The apparatus of claim 1, further comprising:

a rotating control device, wherein the retainer member latches the rotating control device to the latch assembly when the retainer member is in the latched position.

3. The apparatus of claim 1, wherein the retainer member is radially compressed to move to the latched position.

4. The apparatus of claim 1, further comprising:

a housing section, the latch assembly removably connectable to the housing section.

5. The apparatus of claim 4, wherein the housing section is a riser nipple.

6. The apparatus of claim 4, wherein the latch assembly is boltable to the housing section.

7. The apparatus of claim 4, the latch assembly further comprising:

a housing, the housing forming a chamber, wherein the first piston is positioned within the chamber.

8. The apparatus of claim 1, wherein the first piston is an annular piston.

9. The apparatus of claim 1, wherein the retainer member is a C-shaped ring.

10. The apparatus of claim 1, wherein the retainer member is a plurality of spaced-apart dog members.

11. The apparatus of claim 1, wherein the first piston is hydraulically actuated to move between the first position and the second position.

12. The apparatus of claim 11, wherein the first piston is an annular piston.

13. The apparatus of claim 1, the latch assembly further comprising:

an inner housing; and an outer housing connected to the inner housing and forming a chamber between the inner housing and the outer housing, the first piston positioned within the chamber.

14. The apparatus of claim 13, wherein the inner housing comprises an inner housing thread, the outer housing comprises an outer housing thread, and the inner housing thread is connected directly with the outer housing thread.

15. The apparatus of claim 1, further comprising:

a predetermined fluid volume value;

a fluid line operatively coupled to the latch assembly for delivering a fluid to the latch assembly;

wherein the measuring device is coupled to the latch assembly with the fluid line, the measuring device measuring a fluid volume value for the fluid delivered to the latch assembly; and a comparator configured to compare the measured fluid volume value to the predetermined fluid volume value.

16. The apparatus of claim 15, further comprising a predetermined relative relationship, wherein the latch assembly is unlatched when the measured fluid volume value is in the predetermined relative relationship to the predetermined fluid volume value.

17. The apparatus of claim 15, further comprising a display coupled to the comparator, the display comprising an indicator light.

18. The apparatus of claim 17, the indicator light comprising a multicolor light, wherein a first color of the multicolor light indicates the latch assembly is latched wherein a second color of the multicolor light indicates the latch assembly is unlatched.

19. The apparatus of claim 1, further comprising:

a predetermined fluid pressure value;

a first fluid line operatively coupled to the latch assembly for delivering a fluid to the latch assembly;

second fluid line operatively coupled to the latch assembly for returning the fluid from the latch assembly, wherein the measuring device is coupled to the latch assembly with the second fluid line, the measuring device measuring a fluid pressure value for fluid returned from the latch assembly; and a comparator configured to compare the measured fluid pressure value to the predetermined fluid pressure value.

20. The apparatus of claim 19, further comprising a predetermined relative relationship, wherein the latch assembly is latched when the measured fluid pressure value is in the predetermined relative relationship to the predetermined fluid pressure value.

21. The apparatus of claim 1, further comprising:

a predetermined fluid flow rate value;

a first fluid line operatively coupled to the latch assembly for delivering a fluid to the latch assembly;

a second fluid line operatively coupled to the latch assembly for returning the fluid from the latch assembly;

wherein the measuring device is coupled to the latch assembly with the second fluid line, the measuring device measuring a fluid flow rate value for the fluid returned from the latch assembly; and a comparator configured to compare the measured fluid flow rate value to the predetermined fluid flow rate value.

22. The apparatus of claim 21, further comprising a first predetermined relative relationship and a second predetermined relative relationship, wherein the latch assembly is latched when the measured fluid flow rate value is in the first predetermined relative relationship to the predetermined fluid flow rate value, and wherein the latch assembly is unlatched when the measured fluid flow rate value is in the second predetermined relative relationship to the predetermined fluid flow rate value.

23. The apparatus of claim 1, the latch assembly further comprising:

a second piston positioned with the first piston and movable between a first position and a second position, wherein moving the second piston to the second position of the second piston urges the first piston into the second position of the first piston.

24. The apparatus of claim 23, wherein the second piston is hydraulically actuated.

25. The apparatus of claim 23, wherein the second piston is an annular piston.

26. An apparatus, comprising:

a housing section;

a rotating control device having a rotatable inner member and an outer member, and adapted to seal with the housing section; and a latch assembly latchable to the rotating control device outer member radially outwardly from the rotating control device rotatable inner member, sealable with the rotating control device, and adapted to connect to the housing section, wherein the latch assembly is remotely and hydraulically actuatable to latch the rotating control device with the housing section.

27. The apparatus of claim 26, wherein the latch assembly is adapted to bolt to the housing section.

28. The apparatus of claim 26, wherein the latch assembly can be remotely actuated to unlatch the rotating control device from the housing section.

29. The apparatus of claim 26, the latch assembly comprising:

a housing adapted to connect with the housing section; and a remotely actuated latch positioned with the housing, the remotely actuated latch latching the rotating control device to the housing.

30. The apparatus of claim 26, the latch assembly comprising:

a retainer member radially movable between an unlatched position and a latched position, the retainer member latched with the rotating control device in the latched position; and a first piston movable between a first position and a second position, the first piston causing the retainer member to move to the latched position when the first piston is in the first position and the first piston allowing the retainer member to move to the unlatched position when the first piston is in the second position.

31. The apparatus of claim 30, wherein the retainer member is a C-shaped ring.

32. The apparatus of claim 30, wherein the retainer member is a plurality of spaced-apart dog members.

33. The apparatus of claim 30 wherein the first piston is hydraulically actuated to move between the first position and the second position.

34. The apparatus of claim 30, wherein the first piston is an annular piston.

35. The apparatus of claim 30, the latch assembly further comprising:

a second piston positioned with the first piston and movable between a first position and a second position, wherein moving the second piston to the second position of the second piston urges the first piston into the second position of the first piston.

36. The apparatus of claim 35, wherein the second piston is hydraulically actuated.

37. The apparatus of claim 35, wherein the second piston is an annular piston.

38. The apparatus of claim 30, the latch assembly further comprising:

a latch assembly inner housing adapted to seal with the rotating control device when the rotating control device is positioned with the latch assembly, and a latch assembly outer housing connected to the latch assembly inner and forming a chamber between the latch assembly inner and the latch assembly outer housing the first piston positioned within the chamber.

39. The apparatus of claim 38, wherein the latch assembly inner housing comprises a latch assembly inner housing thread, the latch assembly outer housing comprises a latch assembly outer housing thread, and the latch assembly inner housing thread is connected directly with the latch assembly outer housing thread.

40. The apparatus of claim 26, the rotating control device comprising:

a latching formation adapted to latch the rotating control device with the latch assembly.

41. The apparatus of claim 40, the latching formation comprising:

an annular groove.

42. The apparatus of claim 26, the rotating control device comprising:

a shoulder configured to land on a landing formation of the housing section, limiting downhole positioning of the rotating control device.

43. The apparatus of claim 26, wherein the apparatus is positioned from a drilling platform.

44. The apparatus of claim 26, the latch assembly comprising:

a housing; and an eyelet directly connected to an upper surface of the housing, and adapted for positioning the latch assembly.

45. The apparatus of claim 26, further comprising:

a measuring device coupled to the latch assembly.

46. The apparatus of claim 45, further comprising:

a predetermined fluid volume value;

a fluid line operatively coupled to the latch assembly for delivering a fluid to the latch assembly;

wherein the measuring device coupled is to the latch assembly with the fluid line, the measuring device measuring a fluid volume value for the fluid delivered to the latch assembly; and a comparator configured to compare the measured fluid volume value to the predetermined fluid volume value.

47. The apparatus of claim 46, further comprising a predetermined relative relationship, wherein the latch assembly is unlatched when the measured fluid volume value is in the predetermined relative relationship to the predetermined fluid volume value.

48. The apparatus of claim 46, further comprising a display coupled to the comparator, the display comprising an indicator light.

49. The apparatus of claim 48, the indicator light comprising a multicolor light, wherein a first color of the multicolor light indicates the latch assembly is latched to the rotating control device, and wherein a second color of the multicolor light indicates the latch assembly is unlatched from the rotating control device.

50. The apparatus of claim 45, further comprising:

a predetermined fluid pressure value;

a first fluid line operatively coupled to the latch assembly for delivering a fluid to the latch assembly;

a second fluid line operatively coupled to the latch assembly for returning the fluid from the latch assembly;

wherein the measuring device coupled to the latch assembly with the second fluid line, the measuring device measuring a fluid pressure value for fluid returned from the latch assembly; and a comparator configured to compare the measured fluid pressure value to the predetermined fluid pressure value, 51. The apparatus of claim 50, further comprising a predetermined relative relationship, wherein the latch assembly is latched when the fluid pressure value is in the predetermined relative relationship to the predetermined fluid pressure value.

52. The apparatus of claim 45, further comprising: a predetermined fluid flow rate value:

a first fluid line operatively coupled to the latch assembly for delivering a fluid to the latch assembly;

a second fluid line operatively coupled to the latch assembly for returning the fluid from the latch assembly;

wherein the measuring device is coupled to the latch assembly with the second fluid line, the measuring device measuring a fluid flow rate value for fluid returned from the latch assembly; and a comparator configured to compare the measured fluid flow rate value to the predetermined fluid flow rate value.

53. The apparatus of claim 52, further comprising a first predetermined relative relationship and a second predetermined relative relationship, and a display coupled to the comparator, wherein the display indicates the latch assembly is latched when the measured fluid flow rate value is in the first predetermined relative relationship to the predetermined fluid flow rate value, and wherein the display indicates the latch assembly is unlatched when the fluid flow rate value is in the second predetermined relative relationship to the predetermined fluid flow rate value.

54. The apparatus of claim 26, further comprising a first predetermined fluid volume value, a second predetermined fluid volume value, and a third predetermined fluid volume value, the latch assembly further comprising:

a first piston having a first side and a second side and movable between a first position and a second position; and a second piston having a first side, positioned with the first piston, and movable between a first position and a second position;

a latch position indicator system remotely coupled to the latch assembly, comprising:

a first fluid line operatively connected to fluidicly communicate with the first side of the first piston, a second fluid line operatively connected to fluidicly communicate with the second side of the first piston; a third fluid line operatively connected to fluidicly communicate with the first side of the second piston;

a first measuring device coupled to the first fluid line for measuring a first fluid volume value for fluid delivered to the first side of the first piston;

a second measuring device coupled to the second fluid line for measuring a second fluid volume value for fluid delivered to the second side of the first piston;

a third measuring device coupled to the third fluid line for measuring a third fluid volume value for fluid delivered to the first side of the second piston;

a second comparator, coupled to the second measuring device , configured to compare the measured second fluid volume value to the second predetermined fluid volume value;

a third comparator, coupled to the third measuring device configured to compare the measured third fluid volume value to the third predetermined fluid volume value;

wherein moving the second piston to the second position of the second piston urges the first piston into the second position of the first piston.

55. The apparatus of claim 54, further comprising a relative relationship, wherein the first piston is in the first piston first position when the measured first fluid volume value is in the relative relationship with the first predetermined fluid volume value.

56. The apparatus of claim 26, the latch assembly comprising:

a piston, movable between a first position and a second position; and a latch position indicator system, remotely coupled to the latch assembly, comprising:

a predetermined fluid value;

a first fluid line operatively coupled to communicate fluid to a chamber defined by the piston;

a measuring device coupled to the first fluid line, for measuring a fluid and a comparator, coupled to the measuring device, configured to compare the measured fluid value to the predetermined fluid value.

57. The apparatus of claim 56, wherein the measured fluid value is a measured fluid volume value for fluid delivered to the chamber defined by the piston, and wherein the predetermined fluid value is a predetermined fluid volume value.

58. The apparatus of claim 56, wherein the measured fluid value is a measured fluid pressure value, and wherein the predetermined fluid value is a predetermined fluid pressure value.

59. The apparatus of claim 56, wherein the measured fluid value is a measured fluid flow rate value, and wherein the predetermined fluid value is a predetermined fluid flow rate value.

60. The apparatus of claim 56, further comprising a first relative relationship and a second relative relationship, wherein the piston is in the first position when the measured fluid value is in a first relative relationship with the predetermined fluid value, and wherein the piston is in the second position when the measured fluid value is in a second relative relationship with the predetermined fluid value.

61. The apparatus of claim 56, further comprising a display coupled to the comparator, the display comprising a first indicator adapted to indicate the piston is in the first position; and a second indicator adapted to indicate the piston is in the second position.

62. An apparatus, comprising:

a housing section;

a rotating control device adapted for positioning with the housing section; and a latch assembly latchable to the rotating control device, sealable with the rotating control device, and adapted to connect to the housing section, comprising:

a retainer member movable between an unlatched position and a latched position, the retainer member latched with the rotating control device in the latched position; and a piston, movable between a first position and a second position, the piston causing the retainer member to move to the latched position when the piston is in the first position and the first piston allowing the retainer member to move to the unlatched position when the piston is in the second position; a predetermined fluid value;

a latch position indicator system coupled to the latch assembly, comprising:

a fluid line operatively coupled to communicate fluid to the latch assembly;

a measuring device, coupled to the fluid line for measuring a fluid value; and a comparator, coupled to the measuring device, configured to compare the measured fluid value to predetermined fluid value.

63. The apparatus of claim 62, wherein the measured fluid value is a measured fluid volume value, and wherein the predetermined fluid value is a predetermined fluid volume value.

64. The apparatus of claim 62, wherein the measured fluid value is a measured fluid pressure value, and wherein the predetermined fluid value is a predetermined fluid pressure value.

65. The apparatus of claim 62, wherein the measured fluid value is a measured fluid flow rate value, and wherein the predetermined fluid value is a predetermined fluid flow rate value.

66. A method, comprising the steps of, connecting a latch assembly to a housing section;

positioning a rotating control device having a rotatable inner member and an outer member with the latch assembly;

hydraulically latching the latch assembly with the rotating control device outer member radially outwardly from the rotating control device rotatable inner member; and sealing the rotating control device to the latch assembly.

67. The method of claim 66, the step of positioning a rotating control device having a rotatable inner member and an outer member with the latch assembly comprising:

moving the rotating control device into the latch assembly; and landing a shoulder of the rotating control device on a landing formation of the latch assembly.

68. The method of claim 66, the step of connecting a latch assembly to a housing section comprising:

bolting the latch assembly to the housing section.

69. The method of claim 66, the step of hydraulically latching the latch assembly with the rotating control device outer member radially outwardly from the rotating control device rotatable inner member comprising:

radially moving a retainer member inward from the latch assembly; and engaging the retainer member with a latching formation of the rotating control device.

70. The method of claim 69, the step of radially moving a retainer member inward from the latch assembly comprising:

moving a first piston from a second position to a first position; and urging the retainer member radially inward with the first piston.

71. The method of claim 69, the step of radially moving a retainer member inward from the latch assembly comprising:

compressing the retainer member radially inward with the first piston.

72. The method of claim 69, wherein the retainer member is a C-shaped ring.

73. The method of claim 69, wherein the retainer member is a plurality of spaced-apart dog members.

74. The method of claim 70, the step of moving a first piston from a second position to a first position comprising:

hydraulically actuating the first piston to move from the second position to the first position.

75. The method of claim 70, the step of moving a first piston from a second position to a first position comprising:

remotely actuating the first piston to move from the second position to the first position.

76. The method of claim 66, further comprising the step of urging a first piston from a first position of the first piston towards a second position of the first piston.

77. The method of claim 76, the step of urging a first piston from a first position of the first piston towards a second position of the first piston comprising:

hydraulically actuating second piston to move.

78. The method of claim 76, the step of urging a first piston from a first position of the first piston towards a second position of the first piston comprising:

remotely actuating a second piston to move.

79. The method of claim 70, further comprising the steps of:

unlatching the rotating control device from the latch assembly; and removing the rotating control device from the latch assembly.

80. The method of claim 79, the step of unlatching the rotating control device from the latch assembly comprising:

moving the first piston from the first position to the second position; and allowing the retainer member to move radially outward away from the rotating control device.

81. The method of claim 80, the step of allowing the retainer member to move radially outward comprising:

expanding the retainer member away from the rotating control device.

82. The method of claim 80, the step of moving the first piston from the first position to the second position comprising:

hydraulically actuating the first piston to move from the first position to the second position.

83. The method of claim 80, the step of moving the first piston from the first position to the second position comprising:

remotely actuating the first piston to move from the first position to the second position.

84. The method of claim 66, the step of connecting a latch assembly to a housing section comprising:

positioning the latch assembly with the housing section;

latching the latch assembly with the housing section; and sealing the latch assembly with the housing section.

85. The method of claim 84, the step of positioning the latch assembly with the housing section comprising:

landing a shoulder of the latch assembly on a landing formation of the housing section.

86. The method of claim 84, the step of latching the latch assembly with the housing section comprising:

radially extending a retainer member from the latch assembly; and engaging the retainer member with a latching formation of the housing section.

87. The method of claim 86, the step of radially extending a retainer member from the latch assembly comprising:

moving a third piston from a first position to a second position in the latch assembly; and urging the retainer member radially outwardly with the third piston.

88. The method of claim 86, the step of radially extending a retainer member from the latch assembly comprising:

expanding the retainer member.

89. The method of claim 87, the step of moving a piston in the latch assembly comprising:

hydraulically actuating the piston to move

90. The method of claim 87, the step of moving a piston in the latch assembly comprising:

remotely actuating the piston to move

91. The method of claim 87, further comprising the steps of:

unlatching the latch assembly from the housing section; and removing the latch assembly from the housing section.

92. The method of claim 91, the steps of unlatching the latch assembly from the housing section comprising:

moving the piston from a first the position of the piston to a second position of the piston; and allowing the retainer member to move radially inward away from the housing section.

93. The method of claim 92, the step of moving the piston from a first position of the piston to a second position of the piston comprising:

hydraulically actuating the piston to move.

94. The method of claim 92, the step of moving the piston from a first position of the piston to a second position of the piston comprising:

remotely actuating the piston to move.

95. The method of claim 66, the step of positioning a rotating control device having a rotatable inner member and an outer member with the latch assembly comprising:

connecting a cable to an eyelet on the rotating control device; and lowering the rotating control device with the cable.

96. The method of claim 66, the step of connecting a latch assembly to a housing section comprising:

connecting a cable to an eyelet on the latch assembly; and lowering the latch assembly with the cable.

97. An apparatus, comprising:

a rotating control device having a rotatable inner member and an outer member; and a latch assembly comprising:

a retainer member movable between an unlatched position and a latched position; and a first piston movable between a first position and a second position, the first piston causing the retainer member to move to the latched position when the first piston is in the first position and the first piston allowing the retainer member to move to the unlatched position when the first piston is in the second position, wherein the latch assembly is remotely and hydraulically actuatable for moving the first piston to the latched position, and wherein the retainer member latches the latch assembly with the rotating control device outer member when the retainer member is in the latched position.

98. The apparatus of claim 97, wherein the retainer member latches the latch assembly to the rotating control device outer member radially outwardly from the rotating control device inner member when the retainer member is in the latched position.

99. An apparatus, comprising:

a housing section; and a latch assembly comprising:

a retainer member movable between an unlatched position and a latched position; and a first piston movable between a first position and a second position, the first piston causing the retainer member to move to the latched position when the first piston is in the first position and the first piston allowing the retainer member to move to the unlatched position when the first piston is in the second position, wherein the latch assembly is remotely and hydraulically actuatable for moving the first piston to the first position, wherein the latch assembly is removably boltable to the housing section.

100. An apparatus, comprising:

a latch assembly comprising:

a C-shaped ring retainer member movable between an unlatched position and a latched position; and a first piston movable between a first position and a second position, the first piston causing the C-shaped ring retainer member to compress to the latched position when the first piston is in the first position and the first piston allowing the retainer member to expand to the unlatched position when the first piston is in the second position, wherein the latch assembly is remotely and hydraulically actuatable for moving the first piston to the first position.

101. The apparatus of claim 100, wherein the C-shaped ring is compressible while moving to the first position.

102. An apparatus, comprising:

a latch assembly comprising:

a retainer member movable between an unlatched position and a latched position;

a first piston movable between a first position and a second position, the first piston causing the retainer member to move to the latched position when the first piston is in the first position and the first piston allowing the retainer member to move to the unlatched position when the first piston is in the second position, wherein the latch assembly is remotely and hydraulically actuatable for moving the first piston to the first position; and a second piston positioned with the first piston and movable between a first position and a second position, wherein moving the second piston to the second position of the second piston urges the first piston into the second position of the first piston.

103. The apparatus of claim 102, wherein the latch assembly having a chamber and the first piston and the second piston are positioned in the chamber.

104. An apparatus, comprising:

a housing section;

a rotating control device having a rotatable inner member and an outer member, and adapted to seal with the housing section; and a latch assembly latchable to the rotating control device, sealable with the rotating control device, and adapted to connect to the housing section, wherein the latch assembly is remotely and hydraulically actuatable to latch the rotating control device with the housing section, and a latch position indicator system remotely and hydraulically coupled to the latch assembly.

105. The apparatus of claim 104, wherein the latch assembly is boltable to the housing section.

106. The apparatus of claim 104, wherein the latch position indicator system comprises a measuring device used to indicate the position of the latch assembly.

107. The apparatus of claim 106, wherein the measuring device is a meter.

108. The apparatus of claim 106, wherein the measuring device is a pressure transducer.

109. An apparatus, comprising:

a latch assembly comprising:

a retainer member movable between an unlatched position and a latched position;

a first piston movable between a first position and a second position, the first piston causing the retainer member to move to the latched position when the first piston is in the first position and the first piston allowing the retainer member to move to the unlatched position when the first piston is in the second position, wherein the latch assembly is remotely and hydraulically actuatable for moving the first piston to the first position; and a second annular piston positioned with the first piston and hydraulically actuated to move between a first position and a second position, wherein moving the second piston to the second position of the second piston urges the first piston into the second position of the first piston.

110. The apparatus of claim 109, wherein the latch assembly having a chamber and the first piston and the second piston are positioned in the chamber.

111. A method for use with a rotating control device, comprising the steps of, connecting a latch assembly to a housing section;

positioning the rotating control device with the latch assembly;

urging the first piston to move towards the first position of the first piston;

hydraulically latching a rotating control device with a latch assembly;

sealing the rotating control device with the latch assembly;

remotely actuating a second piston to move; and urging the first piston with the second piston to move from a first position of the first piston to the second position of the first piston.

112. The method of claim 111, further comprising the step of: removing the rotating control device from the latch assembly.

113. The method of claim 111, the step of connecting a latch assembly to a housing section comprising the steps of:

positioning the latch assembly with the housing section;

latching the latch assembly with the housing section; and sealing the latch assembly with the housing section.

114. The method of claim 113, the step of positioning the latch assembly with the housing section comprising the step of:

landing a shoulder of the latch assembly on a landing formation of the housing section.

115. The method of claim 113, the step of latching the latch assembly with the housing section comprising:

radially extending a retainer member from the latch assembly; and engaging the retainer member with a latching formation of the housing section.

116. The method of claim 115, the step of radially extending a retainer member from the latch assembly comprising:

moving a third piston in the latch assembly; and urging the retainer member radially outwardly from the latch assembly

117. An apparatus, comprising: a latch assembly comprising:

a retainer member movable between a unlatched position and a latched position;

a first piston movable between a first position and a second position, the first piston causing the retainer member to move to the latched position when the first piston is moved to the first position and the first piston allowing the retainer member to move to the unlatched position when the first piston is in the second position, wherein the latch assembly is remotely and hydraulically actuatable for moving the first piston to the latched position; and a second piston positioned with the first piston and hydraulically actuated to urge the first piston to the second position.

118. The apparatus of claim 117, wherein the latch assembly having a chamber and the first piston and the second piston are positioned in the chamber.

119. A method for use with a rotating control device, comprising the steps of:

connecting a latch assembly to a housing section;

positioning the rotating contral device with the latch assembly;

urging a first piston to move towards a first position of the first piston;

hydraulically latching the rotating control device with the latch assembly;

sealing the rotating control device with the latch assembly;

remotely actuating a second piston; and urging the first piston with the second piston to move from the first position of the first piston to a second position of the first piston.

120. The method of claim 119, further comprising the step of moving the rotating control device from the latch assembly.

121. The method of claim 119, the step of connecting a latch assembly to a housing section comprising the steps of:

positioning the latch assembly 1 with the housing section;

latching the latch assembly with the housing section; and sealing the latch assembly with the housing section.

122. The method of claim 121, the step of positioning the latch assembly with the housing section comprising the step of:

landing a shoulder of the latch assembly on a landing formation of the housing section.

123. The method of claim 121, the step of latching the latch assembly with the housing section comprising:

radially extending retainer member from the latch assembly; and engaging the retainer member with a latching formation of the housing section.

124. The method of claim 123 the step of radially extending a retainer member from the latch assembly comprising:

moving a third piston in the latch assembly; and urging the retainer member radially outwardly from the latch assembly with the third piston.

* * * * *